US008770712B2

(12) United States Patent
Inoue

(10) Patent No.: US 8,770,712 B2
(45) Date of Patent: Jul. 8, 2014

(54) DROPLET EJECTION APPARATUS

(75) Inventor: Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 150 days.

(21) Appl. No.: 13/221,339

(22) Filed: Aug. 30, 2011

(65) Prior Publication Data

US 2012/0050403 A1 Mar. 1, 2012

(30) Foreign Application Priority Data

Aug. 31, 2010 (JP) ..... 2010-194587

(51) Int. Cl.
*B41J 2/165* (2006.01)

(52) U.S. Cl.
USPC ..... 347/33; 347/22

(58) Field of Classification Search
USPC ..... 347/33, 22
See application file for complete search history.

(56) References Cited

U.S. PATENT DOCUMENTS 5,548,310 A * 8/1996 Binnert et al. ..... 347/33
6,196,653 B1 * 3/2001 Igarashi et al. ..... 347/23
2002/0163554 A1 11/2002 Takahashi
2006/0012629 A1 1/2006 Yoshida
2008/0316252 A1 * 12/2008 Na et al. ..... 347/33
2009/0179955 A1 * 7/2009 Hibbard et al. ..... 347/33

FOREIGN PATENT DOCUMENTS

JP 2003-1836 A 1/2003
JP 2006-51806 A 2/2006

* cited by examiner

*Primary Examiner* — Henok Legesse
(74) *Attorney, Agent, or Firm* — Birch, Stewart, Kolasch & Birch, LLP

(57) ABSTRACT

A droplet ejection apparatus includes: a droplet ejection head having a nozzle surface in which a nozzle aperture is formed; and a wiping device which wipes the nozzle surface of the droplet ejection head by moving relatively to the droplet ejection head. The wiping device includes: a wiping device main body which moves relatively to the droplet ejection head; a drive source which is arranged on the wiping device main body; and wiping units configured to be interchangeably installed on the wiping device main body. The wiping units respectively have wiping members configured to be pressed against the nozzle surface to perform respectively different wiping operations to the nozzle surface. When each of the wiping units is installed on the wiping device main body, a corresponding one of the wiping members receives drive force from the drive source to perform a corresponding one of the wiping operations to the nozzle surface.

11 Claims, 27 Drawing Sheets

DROPLET EJECTION APPARATUS

BACKGROUND OF THE INVENTION

1. Field of the Invention

The present invention relates to a droplet ejection apparatus, and more particularly to a droplet ejection apparatus having a wiping device which wipes a nozzle surface of a droplet ejection head.

2. Description of the Related Art

When a recording operation is carried out continuously in an inkjet recording apparatus, ink adheres and accumulates in the vicinity of the nozzles and blockages occur in the nozzles. The nozzle blockages greatly decrease the print quality and therefore in the inkjet recording apparatus, cleaning of the nozzle surface of the head is carried out periodically.

For example, the nozzle surface is cleaned by wetting the nozzle surface and then wiping the nozzle surface with a blade (wiper) or a web.

Japanese Patent Application Publication No. 2006-051806 discloses a wiping apparatus in which a plurality of wiping devices of different types are arranged in a direction of movement with respect to the nozzle surface of the head, in such a manner that the nozzle surface can be wiped by the wiping devices of different types by selectively pressing each of the wiping devices against the nozzle surface. This wiping apparatus is able to wipe the nozzle surface by means of the wiping devices of different types; however, all the wiping devices wipe the nozzle surface in the same direction, and hence there is a drawback in that it is not possible to sufficiently remove adhering matter caused by the ink that is located on the upstream side of the wiping direction inside the nozzle apertures.

Japanese Patent Application Publication No. 2003-001836 discloses a wiping apparatus having a first blade which wipes the nozzle surface by moving in a main scanning direction, and a second blade which wipes the nozzle surface by moving in a sub-scanning direction, in such a manner that the nozzle surface can be wiped while changing the wiping directions. This wiping apparatus is able to wipe the nozzle surface in the two perpendicular directions; however, there is a drawback in that the wiping device becomes large in size since the wiping device is provided with the two blades.

SUMMARY OF THE INVENTION

The present invention has been contrived in view of these circumstances, an object thereof being to provide a droplet ejection apparatus having a compact composition and a high nozzle surface cleaning capability.

In order to attain the aforementioned object, the present invention is directed to a droplet ejection apparatus, comprising: a droplet ejection head having a nozzle surface in which a nozzle aperture is formed, the droplet ejection head ejecting droplets through the nozzle aperture; and a wiping device which wipes the nozzle surface of the droplet ejection head by moving relatively with respect to the droplet ejection head, wherein the wiping device includes: a wiping device main body which moves relatively with respect to the droplet ejection head; a drive source which is arranged on the wiping device main body; and a plurality of wiping units configured to be interchangeably installed on the wiping device main body, the wiping units respectively having wiping members configured to be pressed against the nozzle surface to perform respectively different wiping operations to the nozzle surface, wherein when each of the wiping units is installed on the wiping device main body, a corresponding one of the wiping members receives drive force from the drive source to perform a corresponding one of the wiping operations to the nozzle surface.

According to this aspect of the present invention, the plurality of wiping units performing the different wiping operations are prepared, and these can be interchangeably used appropriately. Thus, it is possible to change the wiping direction in accordance with requirements, and soiling, and the like, adhering to the nozzle surface (and in particular, the inner edge of the nozzle aperture) can be reliably removed. Moreover, since the interchangeable system is used, then it is possible to make the overall apparatus compact in size. Furthermore, since the wiping units share the drive source, then it is possible to reduce the number of components, as well as being able to simplify the composition of the apparatus.

Preferably, the drive source includes a motor; and when each of the wiping units is installed on the wiping device main body, the corresponding one of the wiping members obtains rotational drive force from the motor to perform the corresponding one of the wiping operations to the nozzle surface.

According to this aspect of the present invention, the motor is used as the drive source. By using a simple motor as the drive source, it is possible to simplify the composition of the drive section.

Preferably, one of the wiping units includes: a band-shaped wiping web which serves as the wiping member; and a pair of reels between which the wiping web travels, wherein the one of the wiping units wipes the nozzle surface by causing the wiping web to travel by rotating at least one of the reels by the rotational drive force obtained from the motor, while pressing the travelling wiping web against the nozzle surface.

According to this aspect of the present invention, one wiping unit adopts the composition in which the wiping web traveling between the pair of reels is pressed against the nozzle surface so as to wipe the nozzle surface. By wiping the nozzle surface through pressing the traveling wiping web against the nozzle surface, it is possible to wipe the nozzle surface with a new wiping member at all times, and the nozzle surface can be effectively wiped.

Preferably, one of the wiping units includes a wiping pad which serves as the wiping member and rotates, and the one of the wiping units wipes the nozzle surface by causing the wiping pad to rotate by the rotational drive force obtained from the motor, while pressing the rotating wiping pad against the nozzle surface.

According to this aspect of the present invention, one wiping unit adopts the composition in which the rotating wiping pad is pressed against the nozzle surface so as to wipe the nozzle surface. By wiping the nozzle surface through pressing the rotating wiping pad against the nozzle surface, it is possible to progressively change the wiping direction and therefore soiling, and the like, which is adhering to the nozzle surface (and especially, the inner edge of the nozzle hole) can be effectively removed.

Preferably, the wiping pad is arranged so as to be advanceable and retractable with respect to the nozzle surface, and is impelled toward the nozzle surface by an impelling device.

According to this aspect of the present invention, the wiping pad is arranged advanceably and retractably with respect to the nozzle surface, and the wiping pad is impelled toward the nozzle surface by the impelling device. Thus, it is possible to prevent excessive force from being applied to the nozzle surface, and the nozzle surface can be efficiently wiped with a suitable force.

Preferably, the wiping pad is replaceable.

According to this aspect of the present invention, it is possible to replace the wiping pad. Thus, the wiping pad can be replaced in accordance with the extent of soiling, and a satisfactory wiping capability can be ensured at all times.

Preferably, one of the wiping units includes a wiping pad which serves as the wiping member and reciprocally moves, and the one of the wiping units wipes the nozzle surface by causing the wiping pad to perform reciprocal movement by converting the rotational drive force obtained from the motor into the reciprocal movement, while pressing the reciprocally moving wiping pad against the nozzle surface.

According to this aspect of the present invention, one wiping unit adopts the composition in which the reciprocally moving wiping pad is pressed against the nozzle surface so as to wipe the nozzle surface. By wiping the nozzle surface through pressing the reciprocally moving wiping pad against the nozzle surface, it is possible to progressively change the wiping direction and therefore soiling, and the like, which is adhering to the nozzle surface (and especially, the inner edge of the nozzle hole) can be effectively removed.

Preferably, the wiping pad is arranged so as to be advanceable and retractable with respect to the nozzle surface, and is impelled toward the nozzle surface by an impelling device.

According to this aspect of the present invention, the wiping pad is arranged advanceably and retractably with respect to the nozzle surface, and the wiping pad is impelled toward the nozzle surface by the impelling device. Thus, it is possible to prevent excessive force from being applied to the nozzle surface, and the nozzle surface can be efficiently wiped with a suitable force.

Preferably, the wiping pad is replaceable.

According to this aspect of the present invention, it is possible to replace the wiping pad. Thus, the wiping pad can be replaced in accordance with the extent of soiling, and a satisfactory wiping capability can be ensured at all times.

Preferably, each of the wiping units is installed detachably by being inserted vertically into a recessed installation section arranged in the wiping device main body.

According to this aspect of the present invention, the wiping unit is installed in the wiping device main body by being inserted vertically into the recessed installation section arranged in the wiping device main body. Thus, the task of replacing the wiping unit can be carried out easily.

Preferably, the droplet ejection head is arranged such that the nozzle surface thereof is inclined with respect to a horizontal plane.

According to this aspect of the present invention, the nozzle surface is arranged at an inclination with respect to the horizontal plane. By adopting the composition in which the wiping unit is installed vertically upright with respect to the droplet ejection head having the inclined nozzle surface, it is possible to make the apparatus compact in size.

According to the present invention, soiling, and the like, which is adhering to the nozzle surface can be wiped reliably by means of a compact composition.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Here, an example is described in which a nozzle surface cleaning device according to an embodiment of the present invention is incorporated in an inkjet recording apparatus which records an image on a cut sheet of paper.

Composition of Image Recording Unit of Inkjet Recording Apparatus

Figure 1:
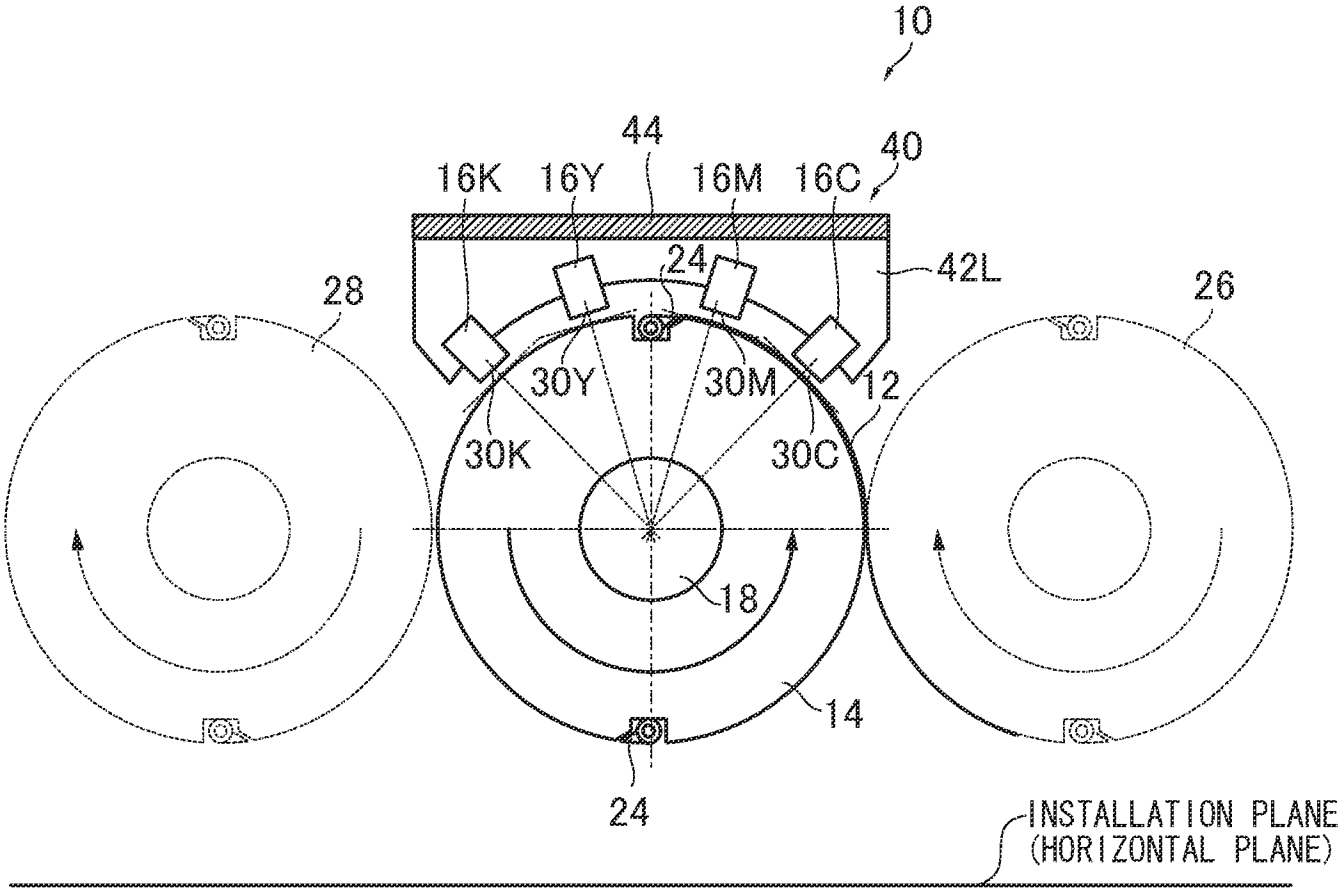
FIG. 1 is a side view diagram showing the general composition of an image recording unit of an inkjet recording apparatus.

FIG. 1 is a side view diagram showing the general composition of an image recording unit of an inkjet recording apparatus.

As shown in FIG. 1, the image recording unit 10 of the inkjet recording apparatus according to the present embodiment conveys a medium (cut sheet of paper) 12 by means of an image recording drum 14. Droplets of inks of respective colors of cyan (C), magenta (M), yellow (Y), black (K) are ejected and deposited on a surface of the medium 12 from inkjet heads (droplet ejection heads) 16C, 16M, 16Y and 16K, which are arranged about the periphery of the image recording drum 14, whereby a color image is recorded on the surface of the medium 12.

Figure 2:
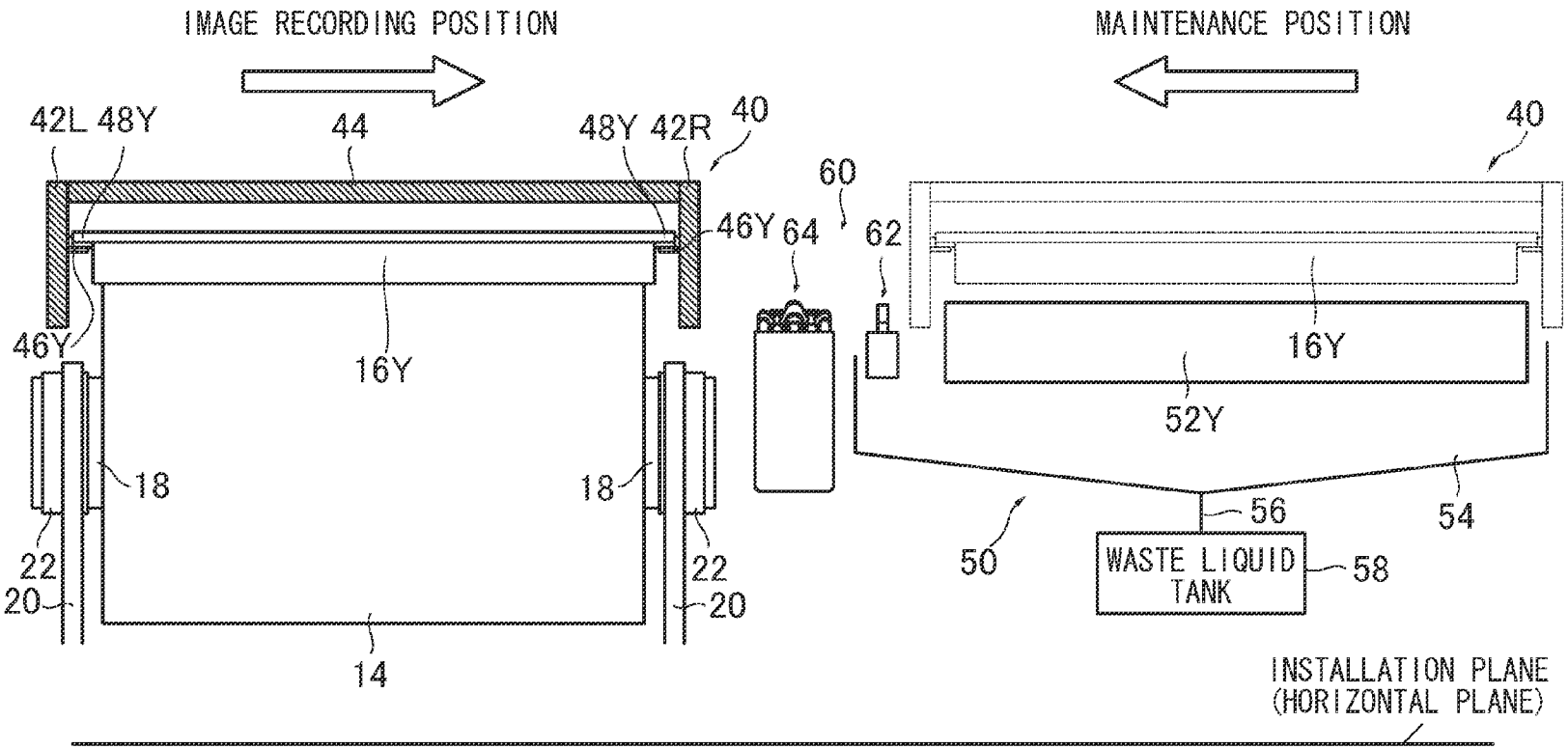
FIG. 2 is a front view diagram of the image recording unit of the inkjet recording apparatus.

The image recording drum 14 is arranged rotatably, and end portions of a rotating shaft 18 of the image recording drum 14 are supported on a pair of bearings 22 (see FIG. 2). The bearings 22 are arranged on an inkjet recording apparatus main frame 20 of the inkjet recording apparatus, and due to the end portions of the rotating shaft 18 being supported on this pair of bearings 22, the image recording drum 14 is installed horizontally (the rotating shaft 18 is installed in parallel with the horizontal installation surface).

A motor is coupled to the rotating shaft 18 of the image recording drum 14 through a rotation transmission mechanism (not illustrated). The image recording drum 14 is driven by the motor to rotate.

The image recording drum 14 is provided with grippers 24 arranged on the circumferential surface thereof (in the present embodiment, at two locations on the outer circumferential surface thereof) so as to grip a leading end portion of the medium 12. The leading end portion of the medium 12 is gripped by the grippers 24 and thereby held on the outer circumferential surface of the image recording drum 14.

The image recording drum 14 is further provided with an attraction holding mechanism which is not illustrated (for example, an electrostatic attraction mechanism or a vacuum suction mechanism). The medium 12 which is wrapped about the outer circumferential surface of the image recording drum 14 and the leading end portion of which is gripped by the gripper 24 is held by attraction on the rear surface side thereof by the attraction holding mechanism and thereby held on the outer circumferential surface of the image recording drum 14.

In the inkjet recording apparatus according to the present embodiment, the medium 12 is transferred to the image recording drum 14 through a conveyance drum 26 from a previous step. The conveyance drum 26 is disposed in parallel with the image recording drum 14 and transfers the medium 12 onto the image recording drum 14 in a synchronized fashion.

Furthermore, the medium 12 after the image recording is transferred to a subsequent step through a conveyance drum 28. The conveyance drum 28 is disposed in parallel with the image recording drum 14 and receives the medium 12 from the image recording drum 14 in a synchronized fashion.

The four inkjet heads 16C, 16M, 16Y and 16K are constituted of line heads having widths corresponding to the width of the medium, and are arranged at uniform intervals apart radially on a circle concentric with the rotating shaft 18 of the image recording drum 14.

In the present embodiment, the four inkjet heads 16C, 16M, 16Y and 16K are horizontally arranged symmetrically about the image recording drum 14. In other words, the cyan inkjet head 16C and the black inkjet head 16K are disposed symmetrically with respect to the vertical line that passes through the center of the image recording drum 14, and the magenta inkjet head 16M and the yellow inkjet head 16Y are also disposed horizontally symmetrically with respect to the same vertical line.

Nozzle surfaces 30C, 30M, 30Y and 30K, which are formed at lower ends of the inkjet heads 16C, 16M, 16Y and 16K disposed as described above, are positioned so as to face the outer circumferential surface of the image recording drum 14, and the nozzle surfaces 30C, 30M, 30Y and 30K are disposed at a prescribed height position from the outer circumferential surface of the image recording drum 14 (a uniform gap is formed between the outer circumferential surface of the image recording drum 14 and each of the nozzle surfaces 30C, 30M, 30Y and 30K). Furthermore, inkjet nozzles are formed in the nozzle surfaces 30C, 30M, 30Y and 30K, and are arranged in rows perpendicular to the conveyance direction of the medium 12.

Ink droplets are ejected perpendicularly toward the outer circumferential surface of the image recording drum 14 from the nozzles which are formed on the nozzle surfaces 30C, 30M, 30Y and 30K of the inkjet heads 16C, 16M, 16Y, 16K disposed as described above.

Figure 3:
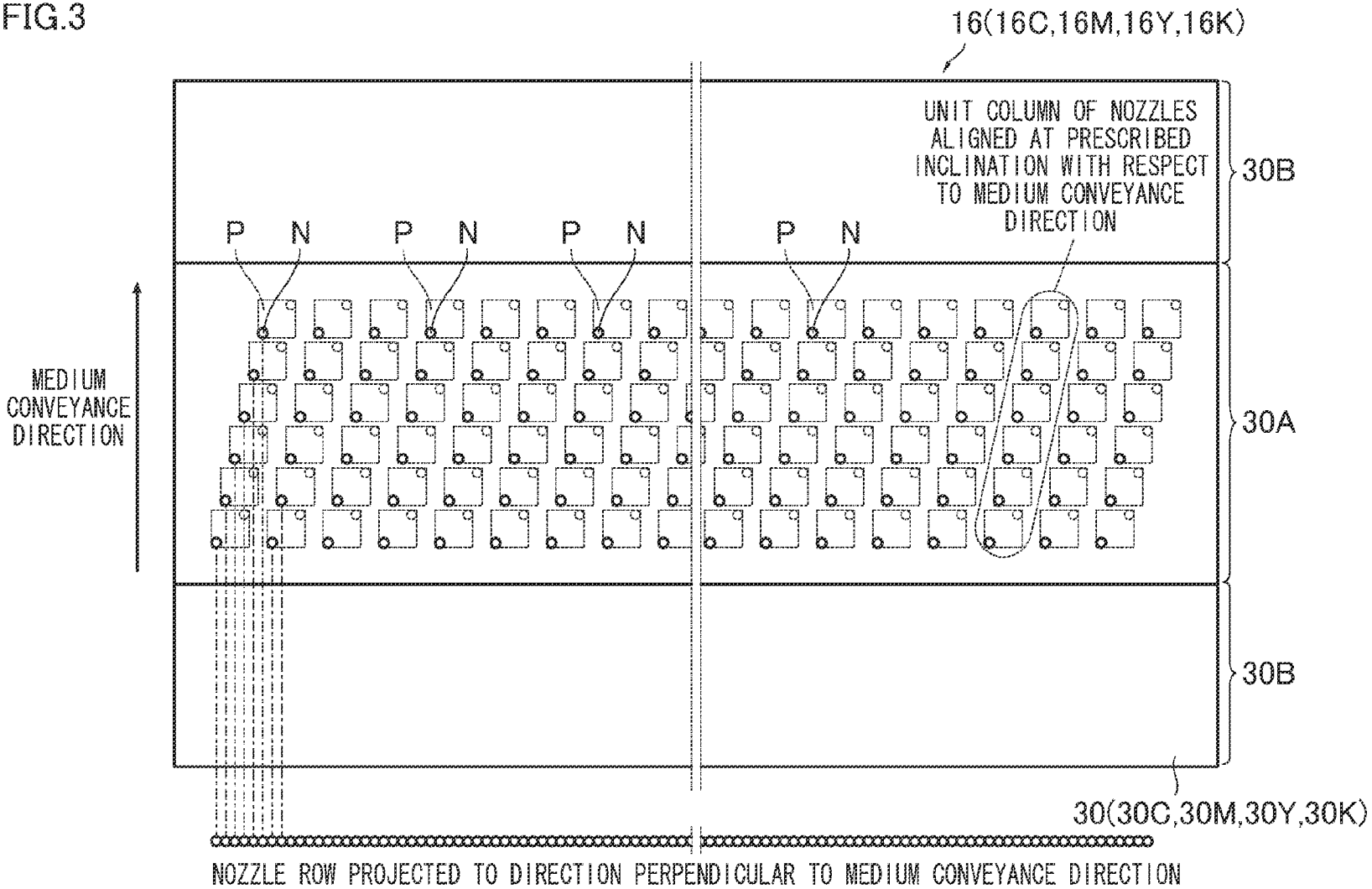
FIG. 3 is a plan view perspective diagram of a nozzle surface of an inkjet head.
Figure 4:
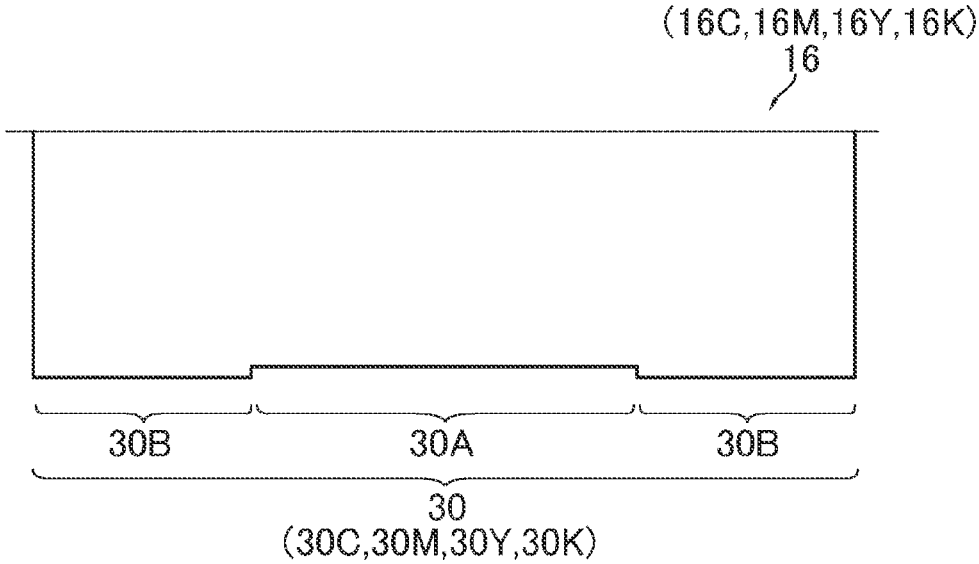
FIG. 4 is a side view diagram of a lower end region of the inkjet head.

FIG. 3 is a plan view perspective diagram of the nozzle surface of the inkjet head, and FIG. 4 is a side view diagram of the lower end region of the inkjet head.

The inkjet heads 16C, 16M, 16Y and 16K have the same composition, and therefore the composition of one inkjet head 16 and the nozzle surface 30 (30C, 30M, 30Y, 30K) thereof is described here.

As shown in FIG. 3, the nozzle surface 30 is formed in a rectangular shape and includes a nozzle forming region 30A having a fixed width in the central portion of the breadthwise direction thereof (media conveyance direction) and nozzle protecting regions 30B arranged symmetrically on either side of the nozzle forming region 30A.

The nozzle forming region 30A is a region where nozzles are formed and a prescribed liquid repelling treatment is applied on the surface of this region (a liquid repelling film is applied thereon).

Here, as shown in FIG. 3, the inkjet head 16 according to the present embodiment is composed as a so-called matrix head and nozzles N are arranged in a two-dimensional matrix configuration in the nozzle forming region 30A. More specifically, the nozzle rows are formed by arranging the nozzles N at a uniform pitch in a direction inclined by a prescribed angle with respect to the direction of conveyance of the medium 12, and furthermore a plurality of the nozzle rows are arranged at uniform pitch in the direction perpendicular to the conveyance direction of the medium 12. By adopting this arrangement for the nozzles, it is possible to reduce the effective pitch between the nozzles N as projected to the lengthwise direction of the head (namely, a direction perpendicular to the conveyance direction of the medium 12), and therefore a high-density configuration of the nozzles N can be achieved.

In the matrix heads, the effective nozzle row is a row of nozzles projected to the lengthwise direction of the head.

The nozzle protecting regions 30B arranged on either side of the nozzle forming region 30A are regions for protecting the nozzle forming region 30A, and the nozzle forming region 30A is formed as a receding part that recedes by a prescribed amount (approximately 0.2 mm) from the nozzle protecting regions 30B.

The inkjet head 16 according to the present embodiment has the liquid repelling treatment applied only on the nozzle forming region 30A (no liquid repelling treatment is applied on the nozzle protecting regions 30B). In this case, when liquid adheres to the nozzle protecting regions 30B, the liquid wets and spreads on the nozzle protecting regions 30B.

The inkjet head 16 according to the present embodiment ejects droplets of ink from the nozzles N by a so-called piezoelectric jet system. The nozzles N formed in the nozzle surface 30 are respectively connected to pressure chambers P, and droplets of the ink are ejected from the nozzles N by expanding and contracting the volume of the pressure chambers P by causing the side walls of the pressure chambers P to vibrate by means of the piezoelectric elements.

The ink ejection method is not limited to this and may also adopt a composition which performs ejection by a thermal method.

The image recording unit 10 has the composition described above. In the image recording unit 10, the medium 12 is received onto the image recording drum 14 from the previous step through the conveyance drum 26, and is conveyed in rotation while being held by attraction on the circumferential surface of the image recording drum 14. The medium 12 passes below the inkjet heads 16C, 16M, 16Y and 16K during this conveyance and ink droplets are ejected and deposited from the inkjet heads 16C, 16M, 16Y and 16K onto the recording surface of the medium 12 as the medium 12 passes, thereby forming a color image on the recording surface of the medium 12. After having completed the image recording, the medium 12 is transferred from the image recording drum 14 to the conveyance drum 28 and is conveyed to the subsequent step.

In the image recording unit 10 having the composition described above, the inkjet heads 16C, 16M, 16Y and 16K are installed on a head supporting frame 40 and are arranged around the image recording drum 14 as shown in FIG. 2.

The head supporting frame 40 is constituted of a pair of side plates 42L and 42R, which are arranged perpendicularly to the rotating shaft 18 of the image recording drum 14, and a linking frame 44, which links the pair of side plate 42L and 42R together at the upper end portions thereof.

Each of the side plates 42L and 42R is formed in a plate shape, and the side plates 42L and 42R are disposed so as to face each other across the image recording drum 14. Installation sections 46C, 46M, 46Y and 46K for installing the respective inkjet heads 16C, 16M, 16Y and 16K are provided on the inner side faces of the pair of side plates 42L and 42R (only the installation section 46Y is depicted in FIG. 2 for convenience).

The installation sections 46C, 46M, 46Y and 46K are disposed at a uniform spacing apart radially on a circle concentric with the rotating shaft 18 of the image formation drum 14. The inkjet heads 16C, 16M, 16Y and 16K are installed on the head supporting frame 40 by fixing attachment sections 48C, 48M, 48Y and 48K, which are formed on the respective ends of the heads (only the attachment section 48Y is depicted in FIG. 2 for convenience) onto the installation sections 46C, 46M, 46Y and 46K. By installing the inkjet heads 16C, 16M, 16Y and 16K on the head supporting frame 40, the inkjet heads 16C, 16M, 16Y and 16K are disposed at uniform intervals apart radially on a circle concentric with the rotating shaft 18 of the image formation drum 14.

The head supporting frame 40 for installing the inkjet heads 16C, 16M, 16Y and 16K is arranged slidably in a direction parallel to the rotating shaft 18 of the image formation drum 14 by being guided by guide rails (not illustrated). The head supporting frame 40 is arranged movably between an "image recording position" indicated by the solid lines in FIG. 2 and a "maintenance position" indicated by the dotted lines in FIG. 2, by being driven by a linear drive mechanism (not illustrated) such as, for example, a screw feed mechanism.

When the head supporting frame 40 is disposed in the image recording position, the inkjet heads 16C, 16M, 16Y and 16K are disposed about the periphery of the image recording drum 14 and assume a state capable of image recording.

The maintenance position is set to a position where the inkjet heads 16C, 16M, 16Y and 16K are retracted from the image recording drum 14. A moisturizing unit 50 for moisturizing the inkjet heads 16C, 16M, 16Y and 16K is provided in this maintenance position.

The moisturizing unit 50 includes caps 52C, 52M, 52Y and 52K (only the cap 52Y is depicted in FIG. 2 for convenience) which cover the nozzle surfaces of the inkjet heads 16C, 16M, 16Y and 16K. When the inkjet heads 16C, 16M, 16Y and 16K are not used for a long time, or the like, the nozzle surfaces are covered with the caps 52C, 52M, 52Y and 52K. Thereby, ejection failure due to drying is prevented.

A pressurizing and suctioning mechanism (not illustrated) is provided for the caps 52C, 52M, 52Y and 52K, in such a manner that the interior of the nozzles can be pressurized and suctioned.

Moreover, a cleaning liquid supply mechanism (not illustrated) is provided for the caps 52C, 52M, 52Y and 52K, in such a manner that cleaning liquid can be supplied to the interior of the caps.

A waste liquid tray 54 is disposed in a position below the caps 52C, 52M, 52Y and 52K. The cleaning liquid supplied to the caps 52C, 52M, 52Y and 52K is discarded into the waste liquid tray 54 and is recovered into a waste liquid tank 58 through a waste liquid recovery pipe 56.

A nozzle surface cleaning device 60 for cleaning the nozzle surfaces 30C, 30M, 30Y and 30K of the inkjet heads 16C, 16M, 16Y and 16K is arranged between the image recording position and the maintenance position. The nozzle surfaces 30C, 30M, 30Y and 30K of the inkjet heads 16C, 16M, 16Y and 16K are cleaned by the nozzle surface cleaning device 60 while the inkjet heads are moved from the maintenance position to the image recording position.

Below, the composition of the nozzle surface cleaning device 60 is described.

Composition of Nozzle Surface Cleaning Device

As shown in FIG. 2, the nozzle surface cleaning device 60 includes: a cleaning liquid deposition device 62, which deposits the cleaning liquid onto the nozzle surfaces 30C, 30M, 30Y and 30K of the inkjet heads 16C, 16M, 16Y and 16K; and a wiping device 64, which wipes the nozzle surface 30C, 30M, 30Y and 30K of the inkjet heads 16C, 16M, 16Y and 16K on which the cleaning liquid has been deposited, with wiping members.

The cleaning liquid deposition device 62 deposits the cleaning liquid onto the nozzle surfaces 30C, 30M, 30Y and 30K of the inkjet heads 16C, 16M, 16Y and 16K which are moved from the maintenance position toward the image recording position.

The wiping device 64 wipes the nozzle surface 30C, 30M, 30Y and 30K of the inkjet heads 16C, 16M, 16Y and 16K on which the cleaning liquid has been deposited, by pressing the wiping members against the nozzle surfaces 30C, 30M, 30Y and 30K.

The cleaning liquid deposition device 62 and the wiping device 64 are disposed in the movement path of the head supporting frame 40. In this case, the cleaning liquid deposition device 62 is disposed to the maintenance position side of the wiping device 64. By this means, the nozzle surfaces 30C, 30M, 30Y and 30K of the inkjet heads 16C, 16M, 16Y and 16K can be washed in the course of movement of the inkjet heads from the maintenance position to the image recording position.

This arrangement can be reversed. In other words, the wiping device 64 can be arranged on the maintenance position side of the cleaning liquid deposition device 62. In this case, the nozzle surfaces 30C, 30M, 30Y and 30K of the inkjet heads 16C, 16M, 16Y and 16K are washed in the course of movement of the inkjet heads from the image recording position to the maintenance position.

Composition of Cleaning Liquid Deposition Device

Figure 5:
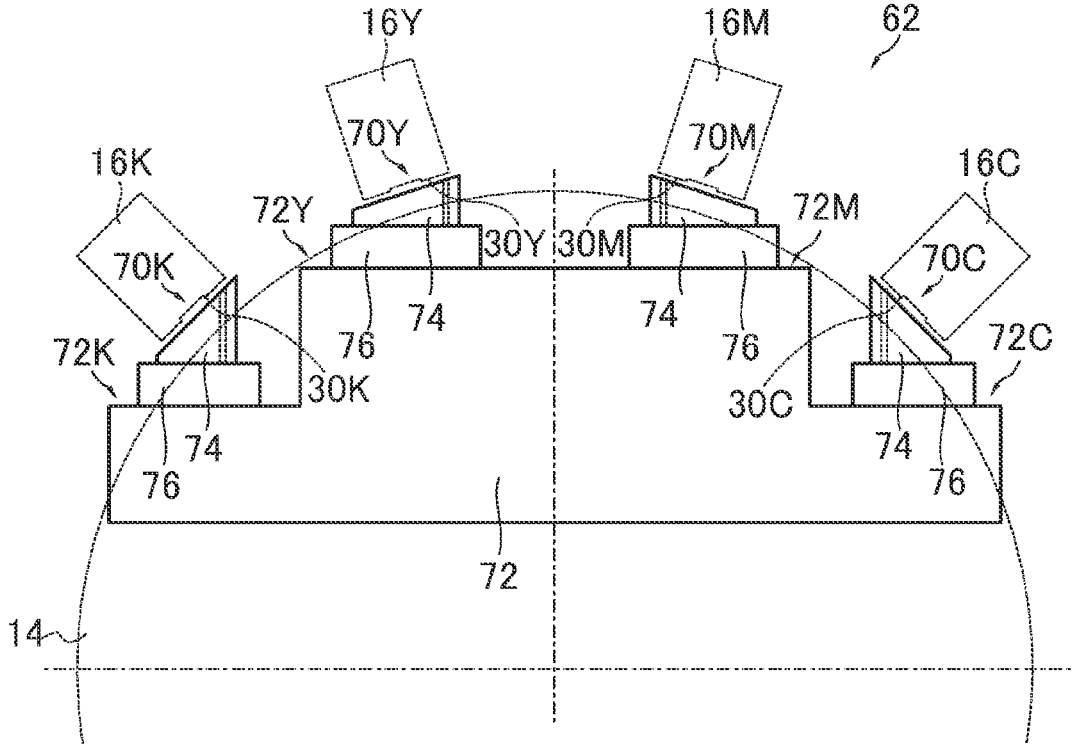
FIG. 5 is a side view diagram showing a cleaning liquid deposition device viewed from the maintenance position side.

FIG. 5 is a side view diagram showing the cleaning liquid deposition device 62 viewed from the maintenance position side.

The cleaning liquid deposition device 62 is disposed on the movement path of the head supporting frame 40. In particular, in the present embodiment, the cleaning liquid deposition device 62 is disposed to the inside of the waste liquid tray 54, which is arranged in the moisturizing unit 50 (see FIG. 2). The cleaning liquid deposition device 62 is constituted of cleaning liquid deposition units 70C, 70M, 70Y and 70K which are arranged correspondingly to the inkjet heads 16C, 16M, 16Y and 16K, and a cleaning liquid deposition device main body 72, on which the cleaning liquid deposition units 70C, 70M, 70Y and 70K are mounted.

<Composition of Cleaning Liquid Deposition Device Main Body>

The cleaning liquid deposition device main body 72 is horizontally arranged so as to be raisable and lowerable by an elevator device (not shown). Cleaning liquid deposition unit attachment sections 72C, 72M, 72Y and 72K are formed in the upper surface portion of the cleaning liquid deposition device main body 72. The cleaning liquid deposition units 70C, 70M, 70Y and 70K are fixed to the cleaning liquid deposition unit attachment sections 72C, 72M, 72Y and 72K formed on the cleaning liquid deposition device main body 72, by bolts, or the like, and are thereby installed in prescribed positions. By installing the cleaning liquid deposition units 70C, 70M, 70Y and 70K on the cleaning liquid deposition device main body 72, the cleaning liquid deposition units 70C, 70M, 70Y and 70K are arranged over the movement path of the corresponding inkjet heads 16C, 16M, 16Y and 16K (namely, over the movement path from the maintenance position to the image recording position).

<Composition of Cleaning Liquid Deposition Unit>

Next, the composition of the cleaning liquid deposition units 70C, 70M, 70Y and 70K is described.

The cleaning liquid deposition units 70C, 70M, 70Y and 70K each have the same basic composition and therefore the composition of a cleaning liquid deposition unit 70 is described here.

Figure 6:
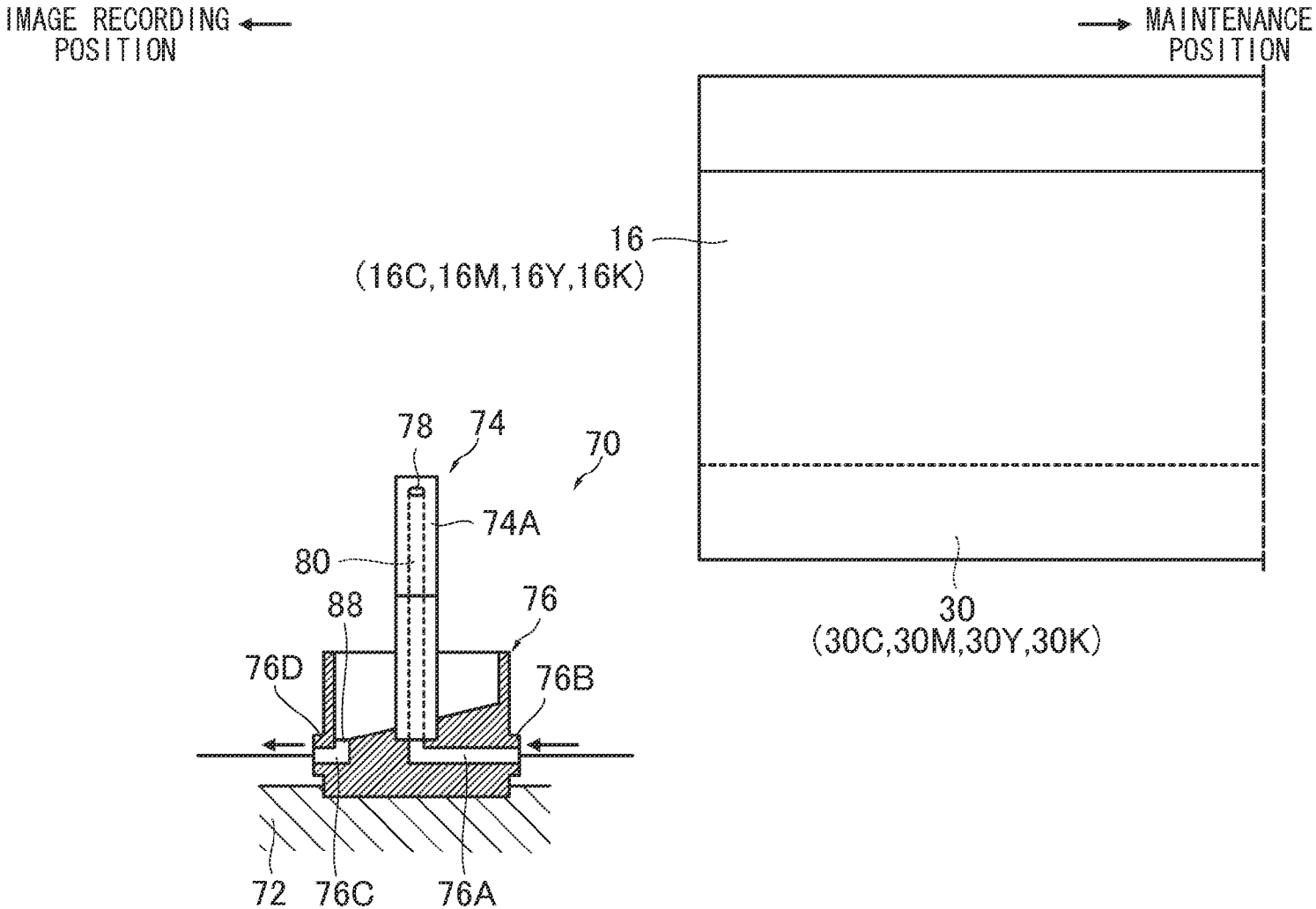
FIG. 6 is a front view diagram of a cleaning liquid deposition unit.
Figure 7:
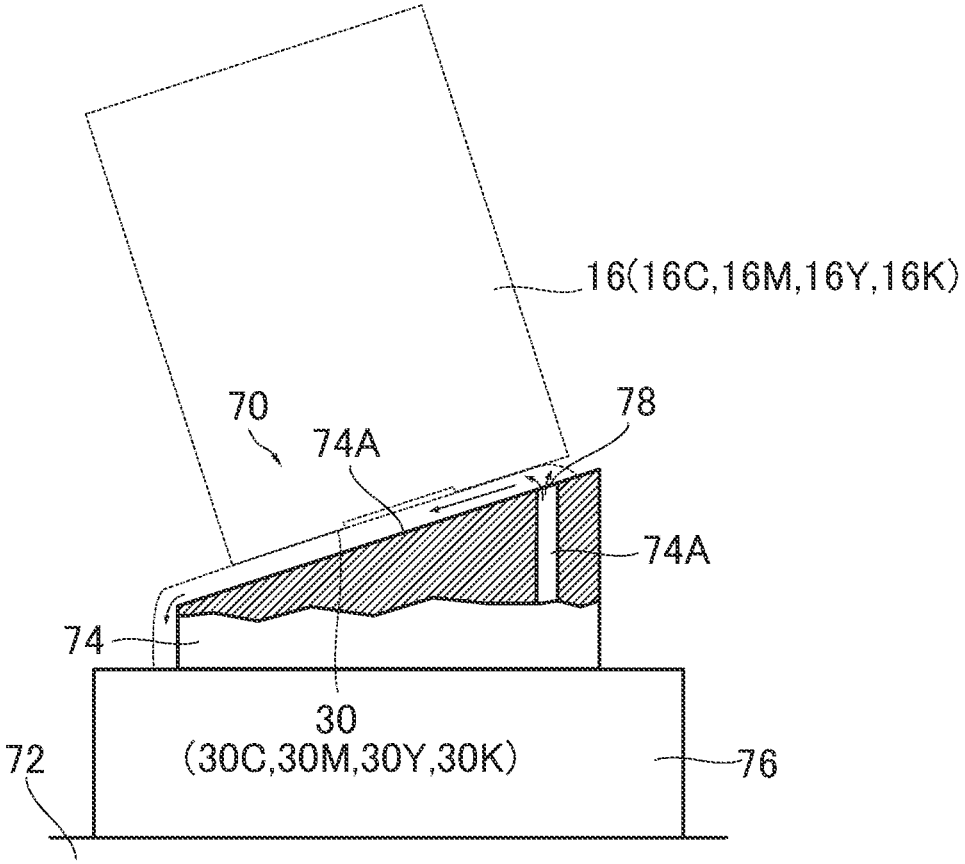
FIG. 7 is a side view diagram of the cleaning liquid deposition unit.

FIGS. 6 and 7 are a front view diagram and a side view diagram, respectively, of the cleaning liquid deposition unit 70.

As shown in FIGS. 6 and 7, the cleaning liquid deposition unit 70 includes: a cleaning liquid deposition head 74, which deposits the cleaning liquid onto the nozzle surface 30, and a cleaning liquid recovery tray 76, which recovers the cleaning liquid falling down from the nozzle surface 30.

The cleaning liquid recovery tray 76 is formed in the shape of a rectangular box of which the upper portion is open. The cleaning liquid deposition head 74 is vertically arranged inside the cleaning liquid recovery tray 76.

The cleaning liquid deposition head 74 is formed in a rectangular block shape with an inclined upper surface, and has an inclined cleaning liquid holding surface 74A on the upper portion thereof. The cleaning liquid holding surface 74A is formed at the same angle of inclination of the nozzle surface 30 of the head that is to be cleaned, and is formed to a slightly greater width than the width of the nozzle surface 30 (the width in the medium conveyance direction).

A cleaning liquid emission port 78 is formed in the vicinity of the upper part of the cleaning liquid holding surface 74A, and the cleaning liquid flows out from the cleaning liquid emission port 78. The cleaning liquid which has flowed out from the cleaning liquid emission port 78 flows down the inclined cleaning liquid holding surface 74A. By this means, a layer (film) of the cleaning liquid is formed on the cleaning liquid holding surface 74A. The cleaning liquid is deposited onto the nozzle surface 30 of the inkjet head 16 by bringing the nozzle surface 30 into contact with the layer of the cleaning liquid formed on the cleaning liquid holding surface 74A.

A cleaning liquid supply flow channel 80 connected to the cleaning liquid emission port 78 is formed inside the cleaning liquid deposition head 74. The cleaning liquid supply flow channel 80 is connected to a connection flow channel 76A formed in the cleaning liquid recovery tray 76, and the connection flow channel 76A is connected to a cleaning liquid supply port 76B formed in the cleaning liquid recovery tray 76. When the cleaning liquid is supplied to the cleaning liquid supply port 76B in the cleaning liquid deposition head 74, the cleaning liquid flows out from the cleaning liquid emission port 78.

The cleaning liquid is supplied from a cleaning liquid tank (not illustrated). A pipe (not illustrated) connected to the cleaning liquid tank is connected to the cleaning liquid supply port 76B. A cleaning liquid supply pump (not illustrated) and a valve (not illustrated) are arranged in this pipe, and by opening the valve and driving the cleaning liquid supply pump, the cleaning liquid is supplied from the cleaning liquid tank to the cleaning liquid deposition head 74.

The cleaning liquid recovery tray 76 is formed in the shape of the rectangular box, the upper portion of which is open, as described above. The bottom face of the interior of the cleaning liquid recovery tray 76 is formed at an inclination, and a cleaning liquid outlet 88 is formed in the lower end portion of the bottom face in the direction of inclination. The cleaning liquid outlet 88 is connected to a cleaning liquid recovery port 76D formed in the side face portion of the cleaning liquid recovery tray 76 through a cleaning liquid recovery flow channel 76C formed inside the cleaning liquid recovery tray 76.

The cleaning liquid emitted from the cleaning liquid emission port 78 of the cleaning liquid deposition head 74 falls down the cleaning liquid holding surface 74A and is recovered into the cleaning liquid recovery tray 76. The liquid is recovered to the waste liquid tank 58 through a pipe (not shown).

The cleaning liquid deposition units 70 (70C, 70M, 70Y, 70K) are each composed as described above. The cleaning liquid deposition device 62 is composed by installing the cleaning liquid deposition units 70C, 70M, 70Y and 70K on the cleaning liquid deposition unit installation sections 72C, 72M, 72Y and 72K formed on the cleaning liquid deposition device main body 72.

The operation of the cleaning liquid deposition device 62 is controlled by a controller, which is not illustrated. The controller controls the cleaning liquid deposition operation by the cleaning liquid deposition device 62 by controlling the driving of the elevator device, and the like.

Cleaning liquid having a main component of diethylene monobutyl ether, for example, is used as the cleaning liquid. By depositing the cleaning liquid of this type to the nozzle surface 30, it is possible to readily dissolve and remove solid attached matter originating from the ink which has adhered to the nozzle surface 30.

<Action of Cleaning Liquid Deposition Device>

Next, a cleaning liquid deposition operation by the cleaning liquid deposition device 62 according to the present embodiment having the composition described above is explained.

The cleaning liquid deposition device 62 deposits the cleaning liquid onto the nozzle surfaces 30 (30C, 30M, 30Y, 30K) of the inkjet heads 16 (16C, 16M, 16Y, 16K) while the inkjet heads 16 (16C, 16M, 16Y, 16K) move from the maintenance position to the image recording position. More specifically, the cleaning liquid is deposited as follows.

As described above, the cleaning liquid deposition device main body 72, on which the cleaning liquid deposition units 70C, 70M, 70Y and 70K are installed, is arranged so as to be raisable and lowerable by means of the elevator device (not shown). When the cleaning is not performed, the cleaning liquid deposition device main body 72 is disposed in a prescribed standby position. Only when the cleaning is being performed, the cleaning liquid deposition device main body 72 is raised by a prescribed amount from the standby position to a prescribed operating position.

When the cleaning liquid deposition device 62 is moved to the operating position, the cleaning liquid deposition units 70C, 70M, 70Y and 70K are set in prescribed cleaning liquid deposition positions. Thereby, it is possible to deposit the cleaning liquid onto the nozzle surfaces 30C, 30M, 30Y and 30K of the inkjet heads 16C, 16M, 16Y and 16K, by means of the cleaning liquid deposition heads 74 arranged in the cleaning liquid deposition units 70C, 70M, 70Y and 70K. In other words, when the cleaning liquid deposition units 70C, 70M, 70Y and 70K are set in the cleaning liquid deposition positions, they are set in the positions where the cleaning liquid which has flowed over the cleaning liquid holding surfaces 74A of the cleaning liquid deposition heads 74 makes contact with the nozzle surfaces 30C, 30M, 30Y and 30K (i.e., the positions where the gaps between the cleaning liquid holding surfaces 74A and the nozzle surfaces 30C, 30M, 30Y and 30K is in a prescribed range).

When the cleaning liquid deposition units 70C, 70M, 70Y and 70K are set in the prescribed cleaning liquid deposition positions, the controller drives the linear drive mechanism and causes the head supporting frame 40 to move at a prescribed speed of movement from the maintenance position to the image recording position.

On the other hand, the controller also drives the cleaning liquid supply pump in accordance with the timing at which the inkjet heads 16C, 16M, 16Y and 16K arrive at the cleaning liquid deposition heads 74 of the cleaning liquid deposition units 70C, 70M, 70Y and 70K. Thereby, the cleaning liquid flows out at a prescribed flow rate from the cleaning liquid emission ports 78 of the cleaning liquid deposition heads 74 arranged in the respective cleaning liquid deposition units 70C, 70M, 70Y and 70K. The cleaning liquid which has flowed out from the cleaning liquid emission ports 78 flows down over the cleaning liquid holding surfaces 74A. Thus, a layer (film) of the cleaning liquid is formed on the cleaning liquid holding surfaces 74A.

When the inkjet heads 16C, 16M, 16Y and 16K moving toward the image recording position pass the cleaning liquid deposition heads 74, the nozzle surfaces 30C, 30M, 30Y and 30K thereof make contact with the layer of cleaning liquid formed on the cleaning liquid holding surfaces 74A of the cleaning liquid deposition heads 74. Thereby, the cleaning liquid is deposited onto the nozzle surfaces 30C, 30M, 30Y and 30K.

Composition of Wiping Device

Figure 8:
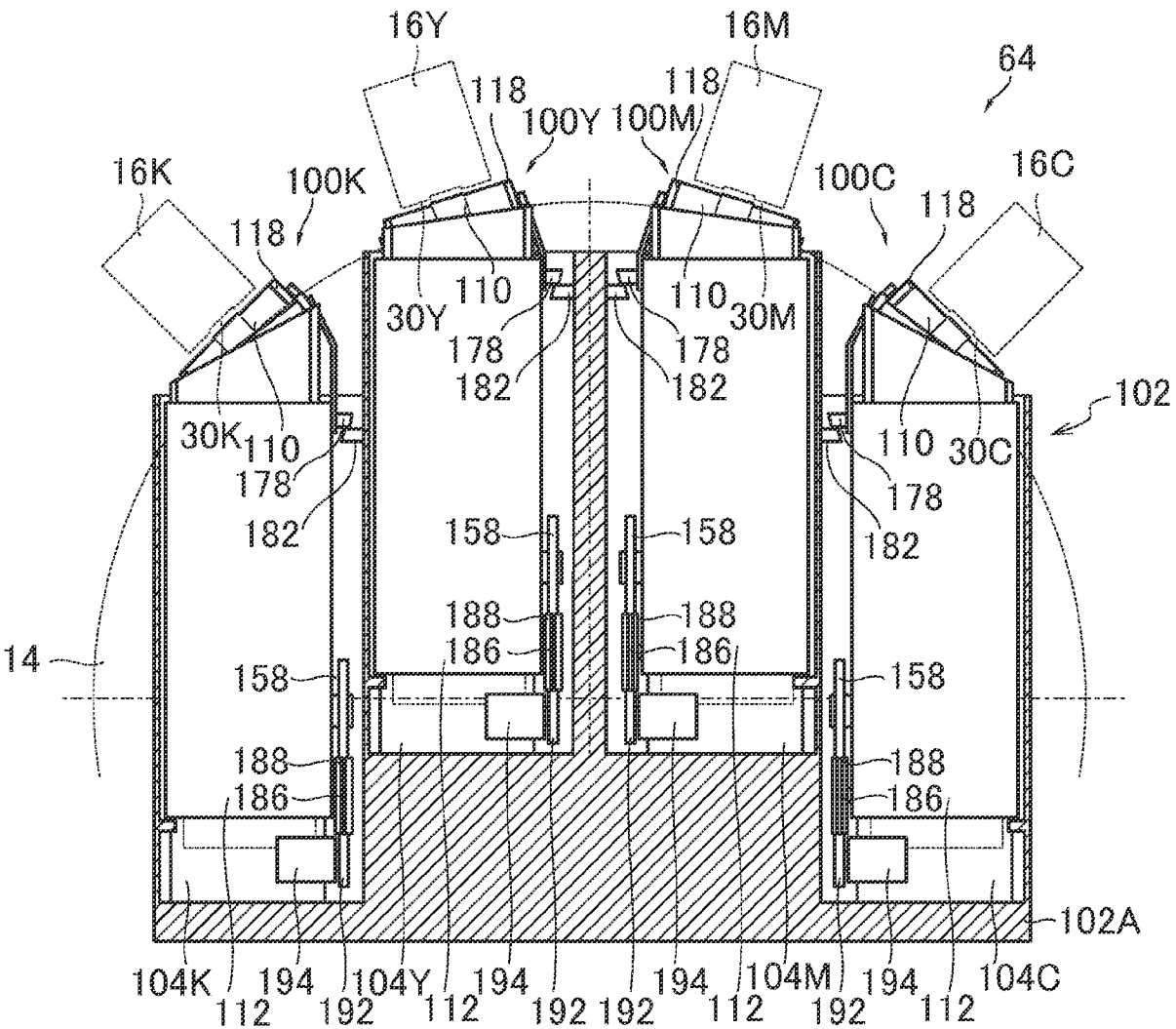
FIG. 8 is a side view diagram showing a wiping device viewed from the maintenance position side.

FIG. 8 is a side view diagram showing the wiping device 64 viewed from the maintenance position side.

The wiping device 64 includes: a wiping device main body 102; standard wiping units 100C, 100M, 100Y and 100K, which are installed detachably on the wiping device main body 102; and strong wiping units 300C, 300M, 300Y and 300K, which are installed interchangeably with the standard wiping units 100C, 100M, 100Y and 100K on the wiping device main body 102.

<Composition of Wiping Device Main Body>

The wiping device main body 102 is disposed on the movement path of the head supporting frame 40. In particular, in the present embodiment, the wiping device main body 102 is arranged between the installing position of the cleaning liquid deposition device 62 and the image recording position. The wiping device main body 102 includes a wiping device main body frame 102A and an elevator device (not shown), which vertically raises and lowers the wiping device main body frame 102A.

The wiping device main body frame 102A is formed in a box shape having an open upper end portion, and wiping unit installation sections 104C, 104M, 104Y and 104K for installing wiping units (the standard wiping units 100C, 100M, 100Y and 100K, or the strong wiping units 300C, 300M, 300Y and 300K) are arranged therein so as to correspond to the inkjet heads 16C, 16M, 16Y and 16K.

The wiping unit installation sections 104C, 104M, 104Y and 104K are respectively formed as recessed spaces which can accommodate the wiping units (the standard wiping units 100C, 100M, 100Y and 100K, or the strong wiping units 300C, 300M, 300Y and 300K), and the upper portions thereof are opened in the upper part of the wiping device main body frame 102A. The wiping units (the standard wiping units 100C, 100M, 100Y and 100K, or the strong wiping units 300C, 300M, 300Y and 300K) are installed in the respective wiping unit installation sections 104C, 104M, 104Y and 104K by being inserted vertically into the wiping unit installation sections 104C, 104M, 104Y and 104K through the open upper parts thereof.

A lock mechanism (not shown) is arranged on each of the wiping unit installation sections 104C, 104M, 104Y and 104K, in such a manner that the installed wiping units (the standard wiping units 100C, 100M, 100Y and 100K, or the strong wiping units 300C, 300M, 300Y and 300K) can be locked. The lock mechanisms are, for example, composed so as to automatically operate when the wiping units (the standard wiping units 100C, 100M, 100Y and 100K, or the strong wiping units 300C, 300M, 300Y and 300K) are inserted into the wiping unit installation sections 104C, 104M, 104Y and 104K.

<Composition of Wiping Unit>

Next, the composition of the wiping units is described.

As described above, the standard wiping units 100C, 100M, 100Y and 100K and the strong wiping units 300C, 300M, 300Y and 300K can be installed interchangeably in the wiping device main body 102.

<Composition of Standard Wiping Unit>

First, the composition of the standard wiping units 100C, 100M, 100Y and 100K is described.

The standard wiping units 100C, 100M, 100Y and 100K are arranged so as to respectively correspond to the inkjet heads 16C, 16M, 16Y and 16K of the respective colors, but all have the same basic composition, and therefore the composition is described here with respect to one "standard wiping unit 100". The same applies to the wiping unit installation sections 104C, 104M, 104Y and 104K in which the wiping units (the standard wiping units 100C, 100M, 100Y and 100K, or the strong wiping units 300C, 300M, 300Y and 300K) are installed, and therefore the composition is described here with respect to one "wiping unit installation section 104" except where specified otherwise.

Figure 9:
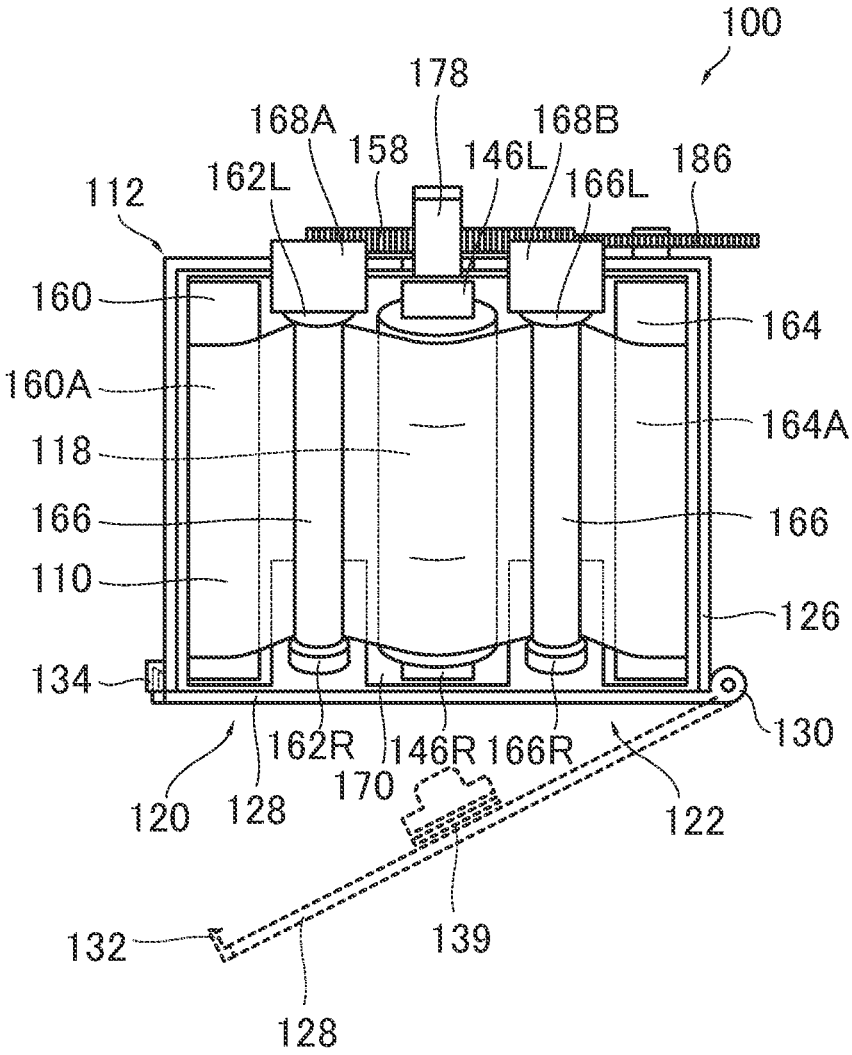
FIG. 9 is a plan view diagram of a standard wiping unit.
Figure 10:
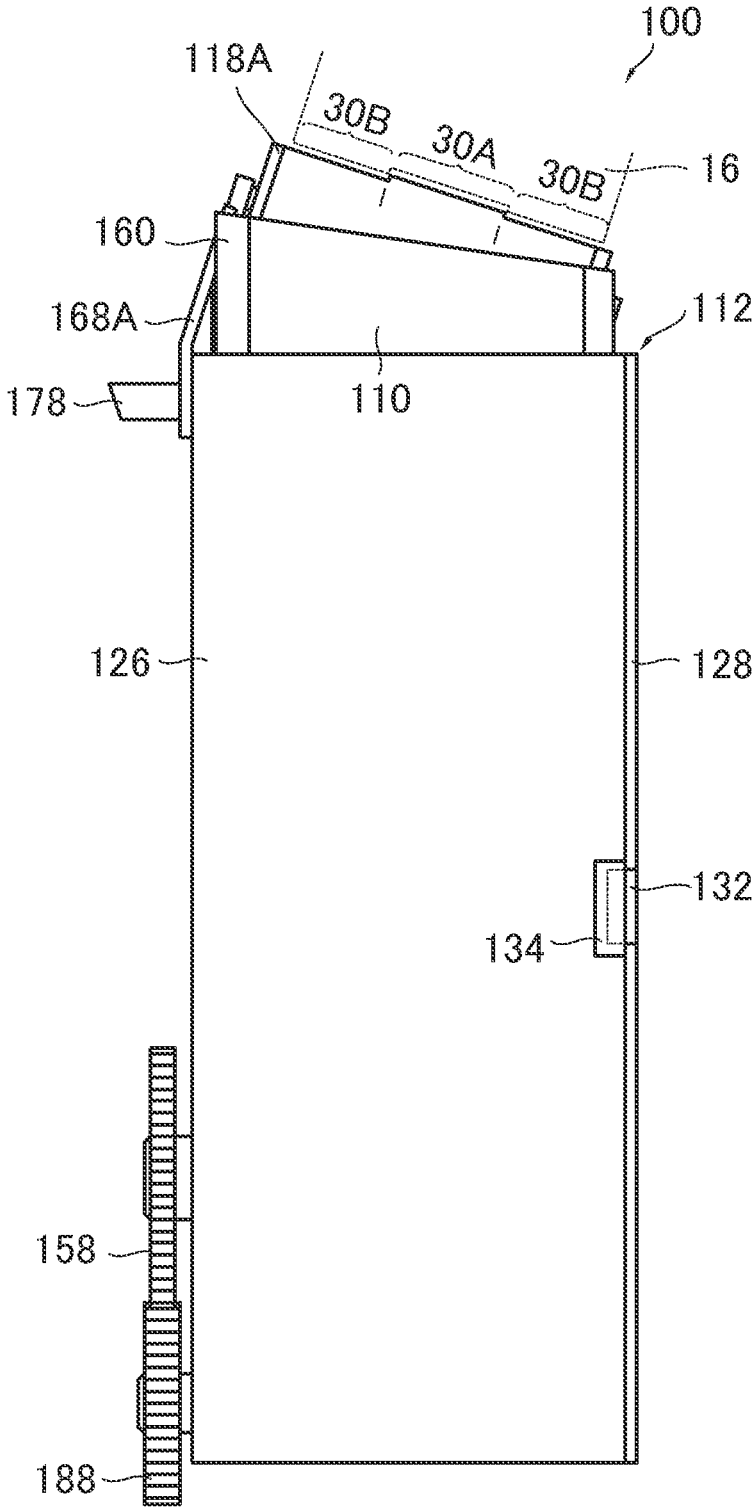
FIG. 10 is a side view diagram showing the standard wiping unit viewed from the image recording position side.
Figure 11:
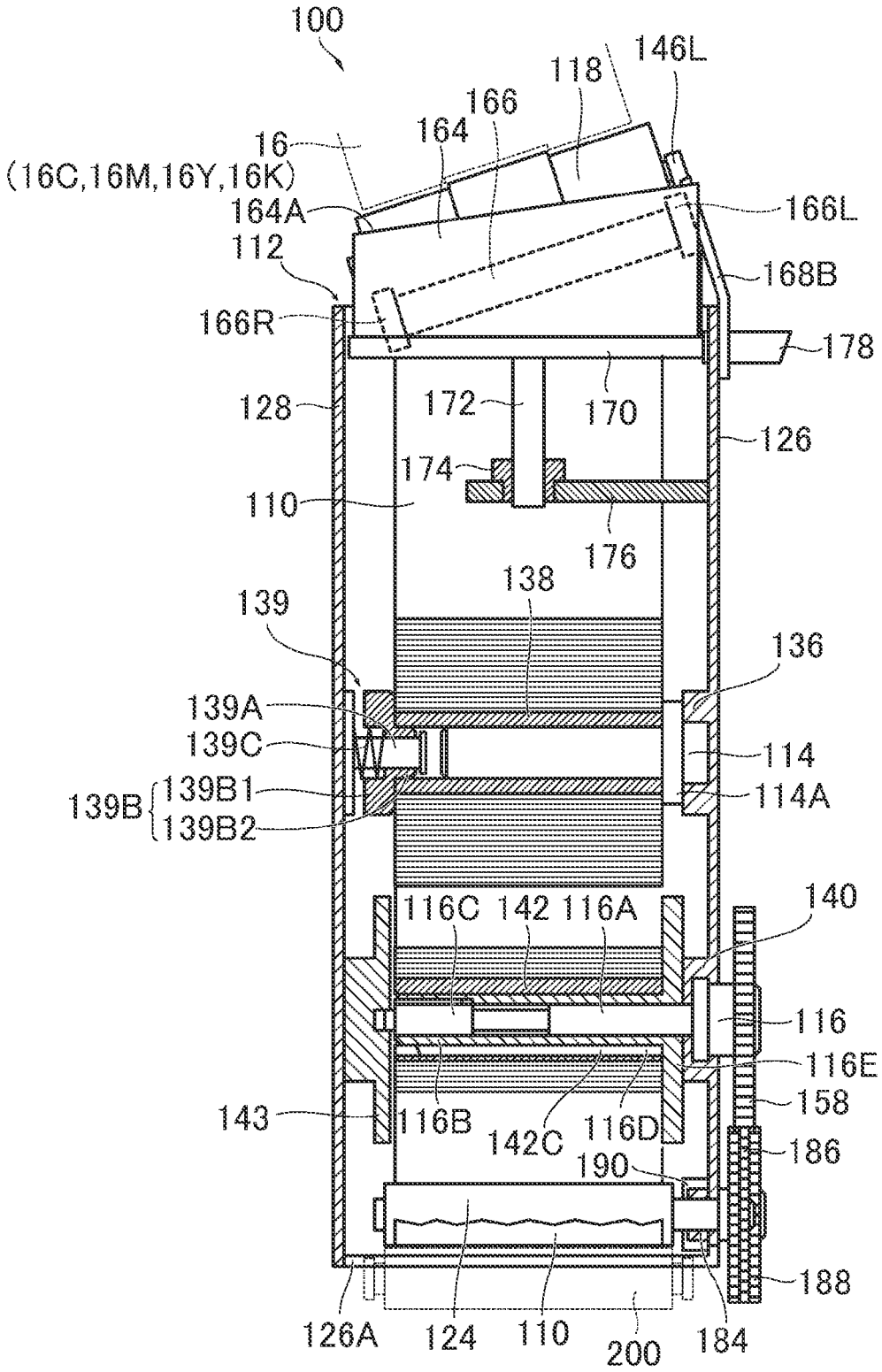
FIG. 11 is a partial cross-sectional side view diagram of the standard wiping unit.
Figure 12:
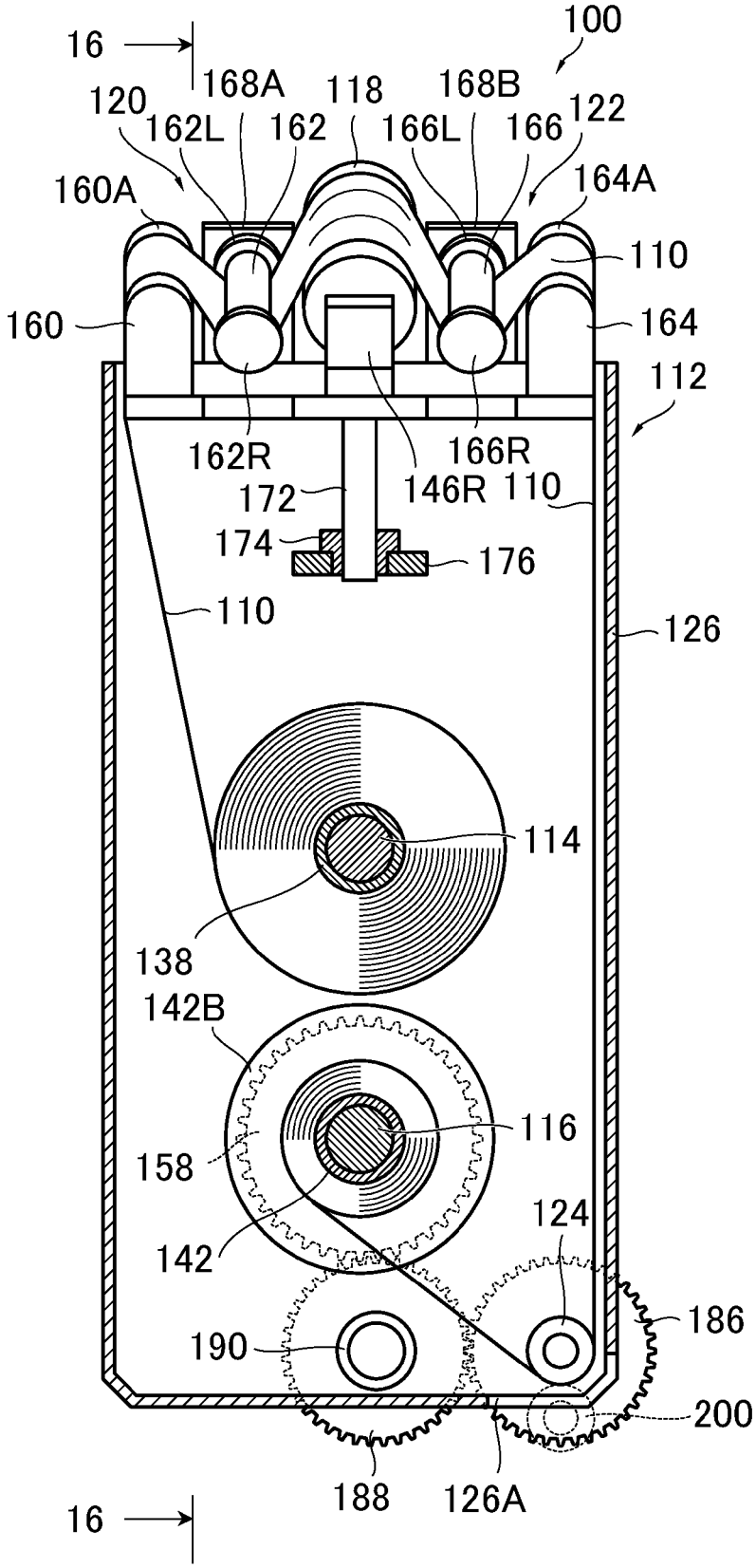
FIG. 12 is a partial cross-sectional front view diagram of the standard wiping unit.
Figure 13:
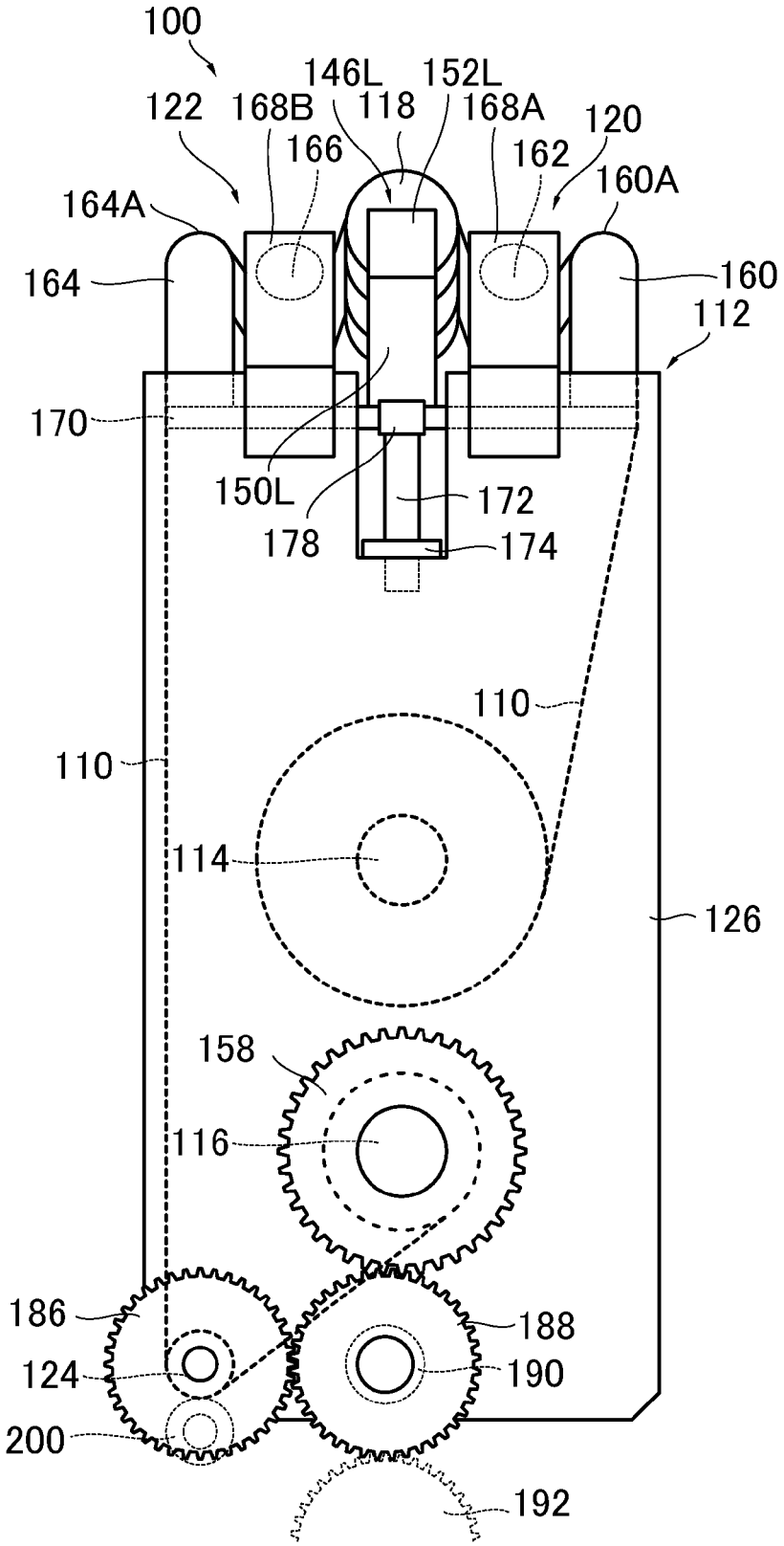
FIG. 13 is a rear view diagram of the standard wiping unit.

FIG. 9 is a plan view diagram of the standard wiping unit 100, FIG. 10 is a side view diagram of the standard wiping unit 100 viewed from the image recording position side, FIG. 11 is an partial cross-sectional side view of the standard wiping unit 100, FIG. 12 is a partial cross-sectional front view of the standard wiping unit 100, and FIG. 13 is a rear view of the standard wiping unit 100.

As shown in FIGS. 9 to 13, the standard wiping unit 100 has a wiping web 110 formed in a band shape, which is wrapped about a pressing roller 118 obliquely disposed, and the standard wiping unit 100 wipes and cleans the nozzle surface of the inkjet head by pressing the wiping web 110 wrapped about the pressing roller 118, against the nozzle surface of the inkjet head.

The standard wiping unit 100 includes: a case 112; a pay-out spindle 114, which pays out the wiping web 110 formed in a band shape; a take-up spindle 116, which takes up the wiping web 110; a front-stage guide 120, which guides the wiping web 110 paid out from the pay-out spindle 114 so as to be wrapped about the pressing roller 118; a rear-stage guide 122, which guides the wiping web 110 having been wrapped about the pressing roller 118 so as to be taken up onto the take-up spindle 116; and a grid roller 124, which conveys the wiping web 110.

The case 112 is constituted of a case main body 126 and a lid 128. The case main body 126 is formed in a box shape, which is long in the vertical direction, and the upper end portion and the front face portion thereof are open. The lid 128 is attached to the front face portion of the case main body 126 with a hinge 130. The front face portion of the case main body 126 is opened and closed by means of the lid 128.

The lid 128 is provided with an elastically deformable locking hook 132, and the lid 128 is fixed to the case main body 126 by means of the locking hook 132, which elastically deforms and engages with a hook receiving section 134 formed on the case main body 126.

The pay-out spindle 114 has a cylindrical shape, and the base end portion thereof is fixed (supported in cantilever fashion) on a spindle bearing section 136 arranged on the case main body 126, with the pay-out spindle 114 installed horizontally inside the case main body 126. A pay-out core 138 is detachably installed on the pay-out spindle 114. The pay-out spindle 114 is formed to be slightly shorter than the length of the pay-out core 138. Therefore, when the pay-out core 138 is installed, the pay-out spindle 114 recedes in the inner circumference portion of the pay-out core 138.

The pay-out core 138 has a cylindrical shape. The wiping web 110 formed in a band shape is wound in the form of a roll about the pay-out core 138.

The pay-out core 138 is installed on the pay-out spindle 114 by inserting the pay-out spindle 114 into the inner circumferential portion of the pay-out core 138 and thereby fitting the pay-out core 138 onto the pay-out spindle 114. The pay-out core 138 that has been installed on the pay-out spindle 114 rotates about the pay-out spindle 114 and is rotatably supported.

Here, as shown in FIG. 11, a pay-out core pressing block 139 is arranged in the lid 128 of the case 112 so as to correspond to the installation position of the pay-out spindle 114. When the lid 128 is closed, the pay-out core pressing block 139 presses the end face of the pay-out core 138 installed on the pay-out spindle 114, in the axial direction thereof, thereby applying friction to the pay-out core 138.

The pay-out core pressing block 139 includes: an axle section 139A, a pressing section 139B, which is slidably arranged on the axle section 139A; and a spring 139C, which impels the pressing section 139B in the axial direction.

The axle section 139A has a round bar shape, and is installed perpendicularly on the inner surface of the lid 128. The axle section 139A is arranged so as to be positioned coaxially with the pay-out spindle 114, when the lid 128 is closed.

The pressing section 139B includes a boss 139B1 and a flange section 139B2. The boss 139B1 has a cylindrical shape, and the outer circumference thereof is formed to have substantially the same diameter as the inner diameter of the pay-out core 138 and so as to be insertable in the inner circumference portion of the pay-out core 138. Furthermore, the inner diameter of the boss 139B1 is formed to have substantially the same diameter as the outer diameter of the axle section 139A, and is slidable along the axle section 139A. The flange section 139B2 is formed integrally with the base end portion of the boss 139B1 and is formed so as to extend in the outer radial direction. The base end portion of the flange section 139B2 is formed with an enlarged inner diameter, and the spring 139C is accommodated in the inner circumference portion of this enlarged flange 139B2. The pressing section 139B is impelled toward the front end direction of the axle section 139A by this spring 139C.

A flange section is formed in the front end of the axle section 139A and detachment of the pressing section 139B is prevented by this flange section.

In the pay-out core pressing block 139, which is composed in this way, when the lid 128 of the case 112 is closed, the boss 139B1 of the pressing section 139B fits into the inner circumference portion of the pay-out core 138, and furthermore the flange section 139B2 abuts against the end face of the pay-out core 138 and presses the pay-out core 138 in the axial direction by the force of the spring 139C. Thereby, the pay-out core 138 is disposed and pressed between the pay-out core pressing block 139 and the flange 114A, and friction is applied when the core 138 rotates.

The wiping web 110 uses, for example, a knitted or woven sheet made of ultra-fine fibers of PET (polyethylene terephthalate), PE (polyethylene), NY (nylon), or the like, and is formed in a flexible band shape having a width corresponding to the width of the nozzle surface of the head being wiped.

The take-up spindle 116 is disposed so that the axis thereof is horizontal, at a position below the pay-out spindle 114. More specifically, the take-up spindle 116 is arranged below and parallel with the pay-out spindle 114.

As shown in FIG. 11, the take-up spindle 116 includes: a main shaft 116A; a slipping shaft 116B, which is arranged rotatably in a circumferential direction about the main shaft 116A; and a torque limiter 116C, which couples the main shaft 116A and the slipping shaft 116B, and is composed in such a manner that the slipping shaft 116B slides with respect to the main shaft 116A if a load (torque) over a threshold is applied.

The main shaft 116A has a round rod shape, and the vicinity of the base end portion thereof is rotatably supported on a bearing section 140, which is arranged in the case main body 126.

The slipping shaft 116B has a cylindrical shape, and is arranged rotatably in the circumferential direction about the outer circumference portion of the main shaft 116A.

The torque limiter 116C is arranged in the inner circumference portion of the front end of the slipping shaft 116B, and couples together the main shaft 116A and the slipping shaft 116B. The torque limiter 116C includes an input side rotating body (not illustrated) and an output side rotating body (not illustrated) arranged coaxially with the input side rotating body, and when a load (torque) over the threshold is applied to the output side rotating body with respect to the input side rotating body, the torque limiter 116C slides between the input side rotating body and the output side rotating body. The input side rotating body of the torque limiter 116C is connected to the main shaft 116A (for example, through a key and key groove, or a boss and boss hole, or by fixing in an integrated fashion so as to transmit rotation), and the output side rotating body is connected to the slipping shaft 116B (for example, through a key and key groove, or a boss and boss hole, or by fixing in an integrated fashion so as to transmit rotation), whereby the main shaft 116A and the slipping shaft 116B are coupled so as to enable transmission of rotation therebetween. Thus, a function is achieved whereby the slipping shaft 116B slides with respect to the main shaft 116A, when a torque over the threshold is applied to the slipping shaft 116B.

In the take-up spindle 116 having the composition described above, if a load (torque) applied to the slipping shaft 116B is within a prescribed range, then no slipping occurs and the slipping shaft 116B rotates in unison with the main spindle 116A. On the other hand, if a load (torque) applied to the slipping shaft 116B exceeds the prescribed range, then slipping occurs between the slipping shaft 116B and the main shaft 116A, and it is possible to prevent an undue load being applied to the main shaft 116A.

A take-up core 142 which takes up the wiping web 110 paid out by the pay-out core 138 is installed on the take-up spindle 116.

The composition of the take-up core 142 is substantially the same as the composition of the pay-out core 138. More specifically, the take-up core 142 has a cylindrical shape. The leading end of the wiping web 110 wound up on the pay-out core 138 is fixed to the take-up core 142.

The take-up core 142 is installed on the take-up spindle 116 by fitting the take-up spindle 116 into the inner circumference portion of the take-up core 142.

Here, as shown in FIG. 11, the take-up core 142 has a key groove 142C formed in the inner circumference portion thereof. On the other hand, a key 116D which engages with the key groove 142C is formed in the outer circumference of the take-up spindle 116 (the outer circumference of the slipping shaft 116B). When installing the take-up core 142, the key 116D formed on the take-up spindle 116 is fitted into the key groove 142C formed in the take-up core 142. Thereby, the take-up core 142 is installed in such a manner that the rotation of the take-up spindle 116 can be transmitted to the take-up core 142.

Furthermore, as shown in FIG. 11, a guide plate 143 is arranged on the inner side of the lid 128 of the case 112 so as to correspond to the installation position of the take-up spindle 116. The guide plate 143 has a circular disk shape of a diameter corresponding to the take-up diameter of the wiping web 110, and is arranged at the front end of the take-up spindle 116 when the lid 128 is closed.

Furthermore, as shown in FIG. 11, a flange 116E of substantially the same diameter as the guide plate 143 is formed on the base end portion of the take-up spindle 116. The take-up core 142 is installed on the take-up spindle 116 and is disposed between the flange 116E and the guide plate 143 when the lid 128 of the case 112 is closed. The wiping web 110 taken up onto the take-up core 142 is wound about the take-up core 142 while both edges of the wiping web 110 are guided by the flange 116E and the guide plate 143.

The main shaft 116A of the take-up spindle 116 is arranged in such a manner that the base end portion thereof projects the outer side of the case main body 126, and a take-up spindle drive gear 158 is fixed to this projecting base end portion. The take-up spindle 116 (main shaft 116A) is rotated by driving and rotating the take-up spindle drive gear 158. The drive mechanism of the take-up spindle 116 is as described below.

The pressing roller 118 is disposed above the pay-out spindle 114 (in the present embodiment, the pressing roller 118, the pay-out spindle 114 and the take-up spindle 116 are disposed on the same straight line), and is arranged at a prescribed angular inclination with respect to the horizontal plane. In other words, the pressing roller 118 is disposed in accordance with the angular inclination of the nozzle surface 30 of the inkjet head 16 that is to be wiped (i.e., the axis of the pressing roller 118 is parallel with the nozzle surface) in order to press the wiping web 110 against the nozzle surface 30 of the inkjet head 16.

Figure 14:
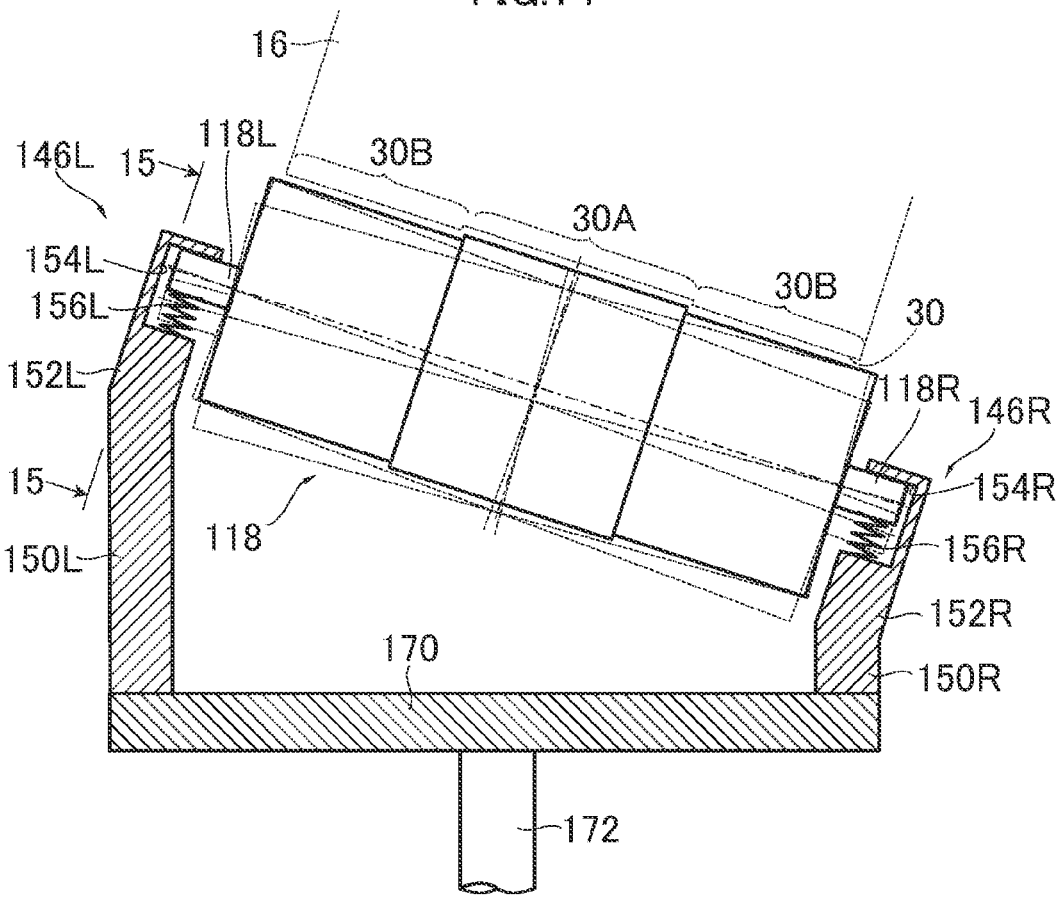
FIG. 14 is a partial cross-sectional front view diagram showing the composition of a bearing section which supports an axle section of a pressing roller.

The pressing roller 118 is formed in such a manner that the central portion thereof has an enlarged diameter in accordance with the cross-sectional shape of the nozzle surface 30 of the inkjet head 16 which is the object of cleaning (see FIG. 14). In the inkjet head 16 in the present embodiment, the central portion of the nozzle surface 30 (i.e., the nozzle forming region 30A) is formed so as to be withdrawn in the recessed shape, and therefore the central portion of the pressing roller 118 is formed so as to project (having a larger diameter than other portions) in accordance with the nozzle surface 30 which is formed in the recessed shape. More specifically, the region (the region which abuts during a wiping operation) corresponding to the nozzle forming region 30A which is withdrawn in the recessed shape is formed so as to project (expand) in accordance with the amount of withdrawal. By this means, it is possible to press the wiping web 110 appropriately against the nozzle forming region 30A which is formed in the withdrawn recessed shape.

The pressing roller 118 is provided with axle portions 118L and 118R, which project on either end portion thereof, and the axle portions 118L and 118R are supported by a pair of axle supporting sections 146L and 146R in a rotatable and swingable fashion.

Figure 15:
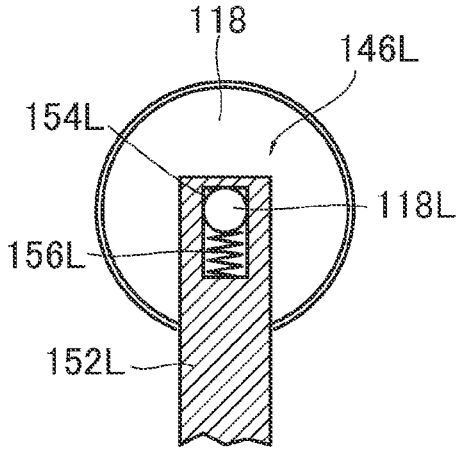
FIG. 15 is a cross-sectional view along line 15-15 in FIG. 14.

FIG. 14 is a partial cross-sectional front view diagram showing the composition of the axle supporting sections which support the axle sections 118L and 118R of the pressing roller 118, and FIG. 15 is a cross-sectional diagram along line 15-15 in FIG. 14.

As shown in FIG. 14, the axle supporting sections 146L and the 146R are arranged on an elevator stage 170, which is horizontally disposed. The axle supporting sections 146L and 146R are constituted of pillar sections 150L and 150R, which are vertically erected on the elevator stage 170, and supporting sections 152L and 152R, which are arranged in a bent fashion at the top ends of the pillar sections 150L and 150R.

The supporting sections 152L and 152R are arranged perpendicularly to the axle of the pressing roller 118, and recess sections 154L and 154R are formed in the inner sides thereof. Each of the recess sections 154L and 154R is formed in a rectangular shape, which has a breadth substantially equal to the diameter of each of the axle sections 118L and 118R of the pressing roller 118, and the lengthwise direction thereof is perpendicular to the nozzle surface of the inkjet head that is to be cleaned (see FIG. 15). The axle sections 118L and 118R on either end of the pressing roller 118 are fitted freely into the recess sections 154L and 154R of the supporting sections 152L and 152R. Thus, the pressing roller 118 is supported swingably within the plane perpendicular to the nozzle surface of the inkjet head that is to be cleaned.

Springs 156L and 156R are accommodated inside the recess sections 154L and 154R, and the axle sections 118L and 118R of the pressing roller 118 which are fitted freely inside the recess sections 154L and 154R are pressed upward by the springs 156L and 156R. By this means, it is possible to cause the circumferential surface of the pressing roller 118 to make close contact with the nozzle surface, by following the nozzle surface of the line head that is to be cleaned.

The front-stage guide 120 is constituted of a first front-stage guide 160 and a second front-stage guide 162, and the wiping web 110 paid out from the pay-out spindle 114 is guided so as to wrap about the pressing roller 118, which is obliquely disposed.

On the other hand, the rear-stage guide 122 is constituted of a first rear-stage guide 164 and a second rear-stage guide 166, and the wiping web 110 which has been wrapped about the pressing roller 118 obliquely disposed is guided so as to be taken up onto the horizontally disposed take-up spindle 116.

The front-stage guide 120 and the rear-stage guide 122 are disposed symmetrically about the pressing roller 118. More specifically, the first front-stage guide 160 and the first rear-stage guide 164 are disposed symmetrically about the pressing roller 118, and furthermore the second front-stage guide 162 and the second rear-stage guide 166 are disposed symmetrically about the pressing roller 118.

The first front-stage guide 160 is formed in a plate shape having a prescribed width and is vertically erected on the elevator stage 170. The upper edge portion 160A of the first front-stage guide 160 is formed as a supporting section for the wiping web 110, and the surface thereof is formed in a circular arc shape. Furthermore, the upper edge portion 160A is formed at a prescribed angular inclination with respect to the horizontal plane, whereby the travel direction of the wiping web 110 is changed.

The first rear-stage guide 164 has the same composition as the first front-stage guide 160. More specifically, the first rear-stage guide 164 is formed in a plate shape having a prescribed width and is vertically erected on the elevator stage 170. The upper edge portion 164A is formed as a supporting section for the wiping web 110 and is formed in a circular arc shape. Furthermore, the upper edge portion 164A is formed at a prescribed angular inclination with respect to the horizontal plane.

The first front-stage guide 160 and the first rear-stage guide 164 are disposed symmetrically about the pressing roller 118. The travel direction of the wiping web 110 which has been paid out from the pay-out spindle 114 is changed to a direction substantially perpendicular to the axis of the pressing roller 118 from the direction perpendicular to the axis of the pay-out spindle 114, by wrapping the wiping web 110 about the first front-stage guide 160. The travel direction of the wiping web 110 having been wrapped about the second rear-stage guide 166 described below is changed to a direction perpendicular to the axis of the take-up spindle 116 by wrapping the wiping web 110 about the first rear-stage guide 164.

The second front-stage guide 162 is formed as a guide roller having flanges 162L and 162R on the respective end portions thereof. The second front-stage guide 162 is disposed between the first front-stage guide 160 and the pressing roller 118, and guides the wiping web 110 which has wrapped about the first front-stage guide 160 so as to be wrapped about the pressing roller 118. More specifically, the travel direction of the wiping web 110 which has been changed to the direction substantially perpendicular to the axis of the pressing roller 118 by the first front-stage guide 160 is slightly adjusted so that the wiping web 110 travels in the direction just perpendicular to the axis of the pressing roller 118. Furthermore, skewed travel of the wiping web 110 is prevented by the flange sections 162L and 162R on the respective ends of the first front-stage guide 160.

Figure 16:
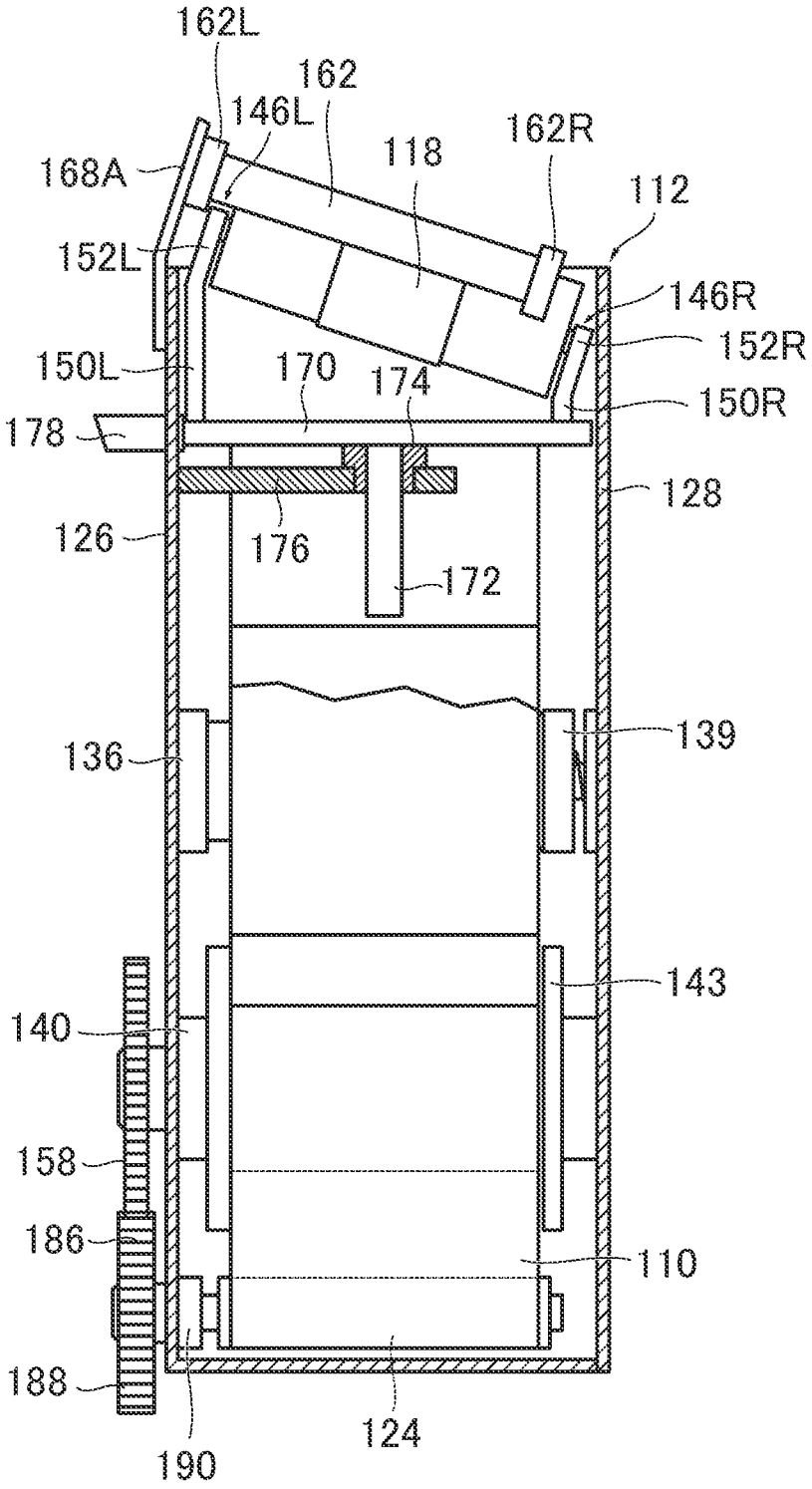
FIG. 16 is a cross-sectional view along line 16-16 in FIG. 12.

The second front-stage guide 162 is supported at only one end thereof on a bracket 168A, and the second front-stage guide 162 is disposed at a prescribed angular inclination. As shown in FIGS. 13 and 16, the bracket 168A is formed in a plate shape with a bent top end, and the base end portion of the bracket 168A is fixed to the upper end portion of the rear face of the case main body 126. The bracket 168A is arranged so as to project perpendicularly upward from the upper end portion of the case main body 126. The second front-stage guide 162 is rotatably supported at only one end thereof on the bent portion of the top end of the bracket 168A.

The second rear-stage guide 166 has the same composition as the second front-stage guide 162. More specifically, the second rear-stage guide 166 is formed as a guide roller having flanges 166L and 166R on either end portion thereof, and the second rear-stage guide 166 is supported at only one end thereof on a bracket 168B. The second rear-stage guide 166 is arranged at a prescribed angular inclination. The bracket 168B is formed in a plate shape with a bent top end, and the base end portion of the bracket 168B is fixed to the upper end portion of the rear face of the case main body 126. The second rear-stage guide 166 is rotatably supported at only one end thereof on the bent portion of the top end of the bracket 168B.

The second rear-stage guide 166 is disposed between the pressing roller 118 and the first rear-stage guide 164, and guides the wiping web 110 which has been wrapped about the pressing roller 118 so as to be wrapped about the first rear-stage guide 164.

The second front-stage guide 162 and the second rear-stage guide 166 are disposed symmetrically about the pressing roller 118. The wiping web 110 of which the travel direction has been changed to the direction substantially perpendicular to the axis of the pressing roller 118 by the first front-stage guide 160 is wrapped about the second front-stage guide 162, whereby the travel direction of the wiping web 110 is slightly adjusted so that the wiping web 110 travels in the direction just perpendicular to the axis of the pressing roller 118. Furthermore, the travel direction of the wiping web 110 having been wrapped about the pressing roller 118 is slightly adjusted by the second rear-stage guide 166 so that the wiping web 110 can be wrapped about the first rear-stage guide 164. By wrapping the wiping web 110 about the first rear-stage guide 164, the travel direction of the wiping web 110 is changed to the direction perpendicular to the axis of the take-up spindle 116.

Thus, the front-stage guide 120 and the rear-stage guide 122 guide the wiping web 110 by gradually changing the travel direction of the wiping web 110, so that the wiping web 110 can be wrapped about the pressing roller 118 readily.

Consequently, the angle of inclination of the second front-stage guide 162 is closer to the angle of inclination of the pressing roller 118 than the angle of inclination of the first front-stage guide 160, and similarly, the angle of inclination of the second rear-stage guide 166 is closer to the angle of inclination of the pressing roller 118 than the angle of inclination of the first rear-stage guide 164.

As described above, the first front-stage guide 160, the pressing roller 118 and the first rear-stage guide 164 are arranged on the elevator stage 170. The elevator stage 170 can be raised and lowered in the direction vertical to the horizontal plane.

As shown in FIG. 11, a guide shaft 172 is connected integrally with the elevator stage 170. The guide shaft 172 vertically extends downward from the lower face of the elevator stage 170 and is fitted into a guide bush 174 disposed inside the case main body 126. The guide bush 174 is fixed to the inner wall face of the case main body 126 through a supporting member 176, and guides the guide shaft 172 vertically.

Figure 17A:
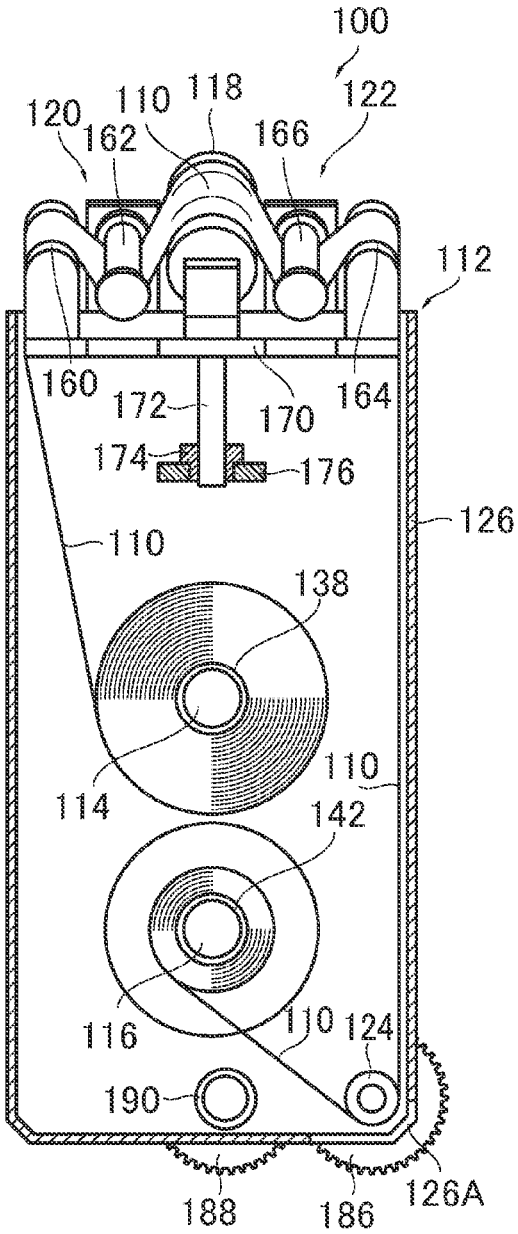
FIG. 17A is an illustrative diagram showing a state of a wiping web in the standard wiping unit during use.
Figure 17B:
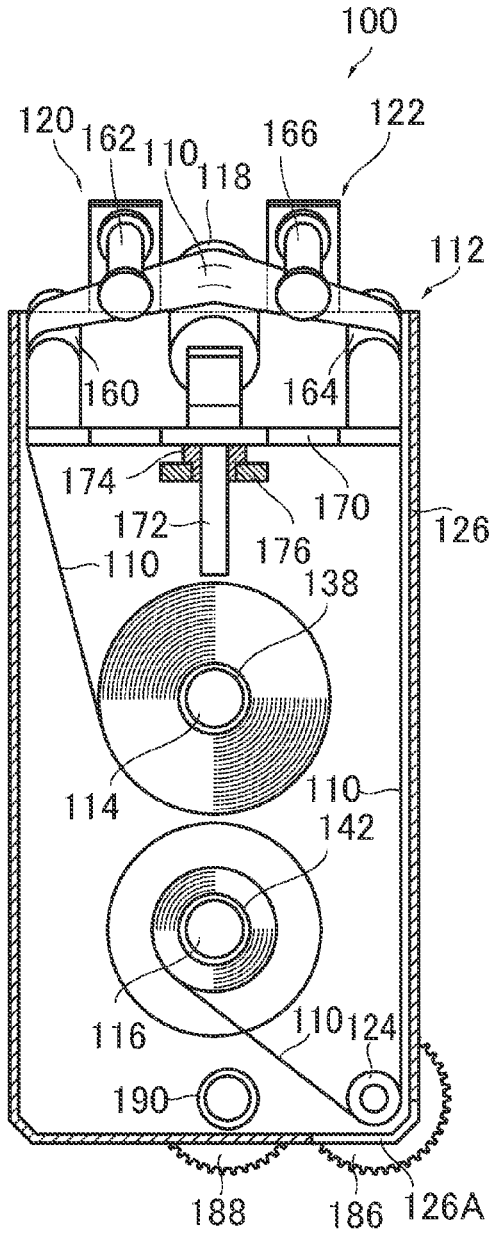
FIG. 17B is an illustrative diagram showing a state of the wiping web during replacement.

In this way, the elevator stage 170 on which the first front-stage guide 160, the pressing roller 118 and the first rear-stage guide 164 are disposed is arranged raisable and lower ably in the direction vertical to the horizontal plane. Therefore, as shown in FIGS. 17A and 17B, by raising and lowering the elevator stage 170, it is possible to cause the first front-stage guide 160, the pressing roller 118 and the first rear-stage guide 164 to advance and retreat with respect to the second front-stage guide 162 and the second rear-stage guide 166, which are fixedly arranged. By this means, it is possible to simply replace the wiping web 110.

More specifically, by lowering the elevator stage 170, as shown in FIG. 17B, the first front-side guide 160, the pressing roller 118 and the first rear-stage guide 164 can be retracted downward with respect to the second front-stage guide 162 and the second rear-stage guide 166, and therefore a large space between same can be ensured. Thereby, it is possible to simply carry out the task of wrapping the wiping web 110 about the respective sections. Furthermore, the wiping web 110 can be simply wrapped about the respective sections by wrapping the wiping web 110 about the first front-stage guide 160, the pressing roller 118 and the first rear-stage guide 164, with the first front-stage guide 160, the pressing roller 118 and the first rear-stage guide 164 in the downwardly retracted state, and then raising the elevator stage 170. In other words, if the wiping web 110 is wrapped about the first front-stage guide 160, the pressing roller 118 and the first rear-stage guide 164, whereupon the elevator stage 170 is raised, as shown in FIG. 17A, then the wiping web 110 is automatically wrapped about the second front-stage guide 162 and the second rear-stage guide 166.

In this way, by making the first front-stage guide 160, the pressing roller 118 and the first rear-stage guide 164 capable of advancing and retracting with respect to the second front-stage guide 162 and the second rear-stage guide 166, it is possible to simply carry out the task of replacing the wiping web 110.

The first front-stage guide 160, the pressing roller 118 and the first rear-stage guide 164 need to be positioned in the prescribed use position (the position in FIG. 17A) when being used, and the first front-stage guide 160, the pressing roller 118 and the first rear-stage guide 164 are moved to the use position in coordination with the installation of the standard wiping unit 100 on the wiping device main body 102.

This coordinated mechanism will now be described. As shown in FIGS. 11 and 13, an elevator lever (engagement section) 178 is arranged on the elevator stage 170, on which the first front-stage guide 160, the pressing roller 118 and the first rear-stage guide 164 are arranged. The elevator lever 178 is arranged so as to project from the rear face of the case main body 126 through a cutaway portion 180 formed on the rear face of the case main body 126. The elevator stage 170 is raised and lowered by sliding the elevator lever 178.

Figure 18A:
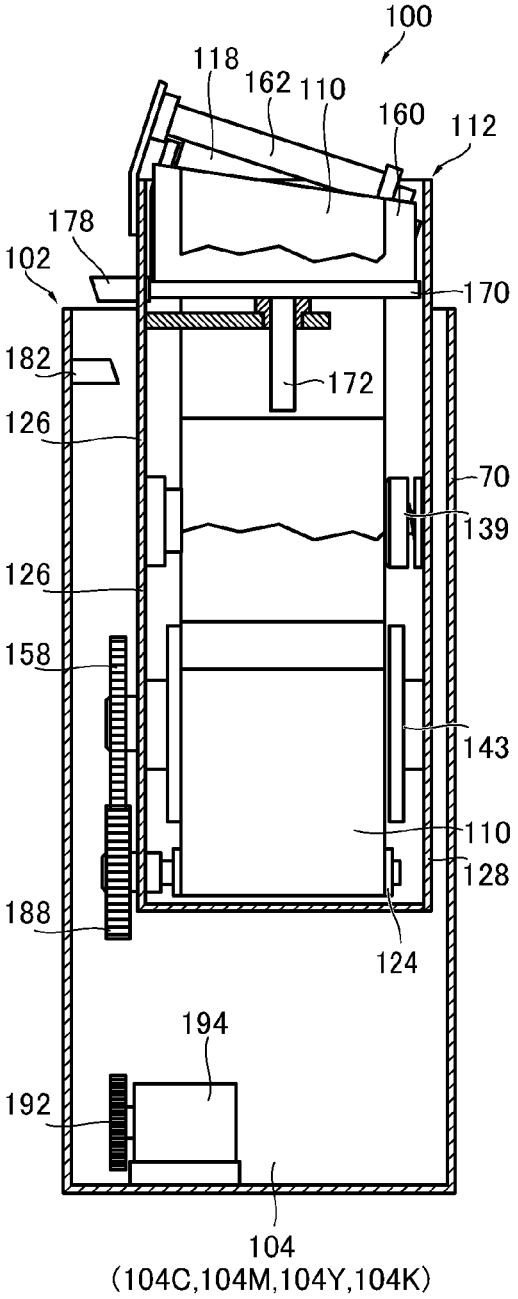
FIGS. 18A and 18B are illustrative diagrams of a coordination mechanism for raising and lowering an elevator table.
Figure 18B:
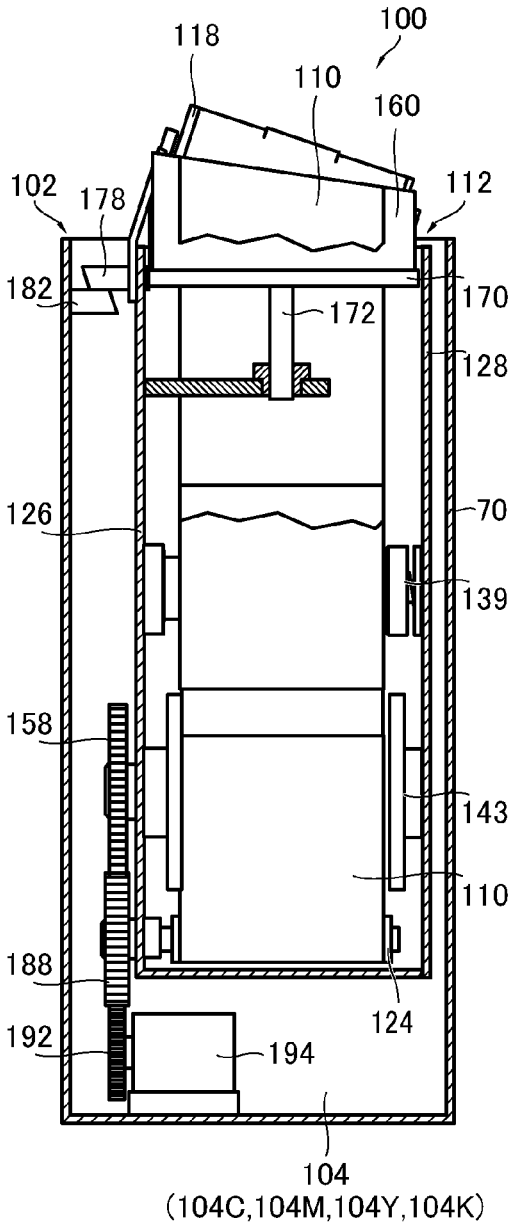

On the other hand, as shown in FIGS. 18A and 18B, a pin (engaged section) 182 is projectingly arranged on the inner side of the installation section 104 (104C, 104M, 104Y and 104K) formed in the wiping device main body frame 102A of the wiping device main body 102 in which the standard wiping unit 100 is set. The pin 182 is arranged so as to engage with the elevator lever 178 arranged on the standard wiping unit 100 when the standard wiping unit 100 is installed in the installation section 104.

According to the composition described above, as shown in FIGS. 18A and 18B, when the standard wiping unit 100 is inserted into the installation section 104, the elevator lever 178 engages with the pin 182 and is forcibly raised up to a prescribed position. Thereby, the first front-stage guide 160, the pressing roller 118 and the first rear-stage guide 164 are registered in the prescribed use position.

In this way, the first front-stage guide 160, the pressing roller 118 and the first rear-stage guide 164 are moved to the use position in coordination with the installation of the standard wiping unit 100 on the wiping device main body 102.

The grid roller 124 is disposed in the vicinity of the base face of the case main body 126, in a position below the first rear-stage guide 164. The grid roller 124 drives and guides the wiping web 110 of which the travel direction has been changed to the direction perpendicular to the take-up spindle 116 by the first rear-stage guide 164, so that the wiping web 110 is taken up onto the take-up spindle 116.

The grid roller 124 is arranged in parallel with the take-up spindle 116 (namely in parallel with the horizontal plane), and the vicinity of the base end portion thereof is rotatably supported on a bearing section 184, which is arranged on the case main body 126. Furthermore, the grid roller 124 is arranged in such a manner that the base end portion of the rotating shaft thereof projects to the outer side of the case main body 126, and a grid roller drive gear 186 is fixed to this projecting base end portion of the rotating shaft. The grid roller 124 is rotated by driving the grid roller drive gear 186 to rotate.

Here, the drive mechanism of the standard wiping unit 100 including the grid roller 124 is described.

In the standard wiping unit 100 according to the present embodiment, by driving the take-up spindle 116 to rotate while also driving the grid roller 124 to rotate, the wiping web 110 is caused to travel from the pay-out spindle 114 toward the take-up spindle 116.

As described above, the take-up spindle drive gear 158 is fixed to the take-up spindle 116 (the main spindle 116A which constitutes the take-up spindle 116). On the other hand, the grid roller drive gear 186 is fixed to the grid roller 124. As shown in FIG. 13, the take-up spindle drive gear 158 and the grid roller drive gear 186 mesh with a rotation transmission gear 188.

The rotating shaft of the rotation transmission gear 188 is horizontally arranged and is rotatably supported on a bearing section 190 arranged on the case main body 126. The take-up spindle drive gear 158 and the grid roller drive gear 186 are both caused to rotate in the same direction by driving the rotation transmission gear 188. Due to the rotation of the take-up spindle drive gear 158 and the grid roller drive gear 186, the take-up spindle 116 and the grid roller 124 rotate.

Here, in the wiping device 64 according to the present embodiment, the gears of different diameters (the gears having different numbers of teeth) are used for the take-up spindle drive gear 158 and the grid roller drive gear 186, and the take-up spindle 116 and the grid roller 124 are set so as to rotate at different velocities. More specifically, in the wiping device 64 according to present embodiment, in order to be able to convey the wiping web 110 without any slackness, the rotational velocity of the take-up spindle 116 and the rotational velocity of the grid roller 124 are set in such a manner that the velocity at which the wiping web 110 is taken up onto the take-up core 142 is faster than the velocity at which the wiping web 110 is conveyed by the grid roller 124. Thereby, it is possible to stably take up the wiping web 110 without any slackness.

More specifically, the rotational velocity of the take-up spindle 116 and the rotational velocity of the grid roller 124 are set in such a manner that the circumferential velocity V1 of the take-up core 142 installed on the take-up spindle 116 is greater than the circumferential velocity V2 of the grid roller 124 (V1>V2), and the gear ratio of the take-up spindle drive gear 158 and the grid roller drive gear 186 is set on the basis of these velocities.

The rotational velocities actually set are determined by finding optimal velocities through experimentation, and the like. More specifically, if there is too large a difference between these velocities, then this can cause abrasion, breakdown, or the like, and therefore the rotational velocities are set by finding optimal values on the basis of experimentation, or the like.

Even if there is a difference between the take-up speed and the conveyance speed in this way, since the slipping mechanism (based on the torque limiter 116C) is arranged in the take-up spindle 116 of the wiping device 64 according to the present embodiment, then it is possible to drive the take-up spindle 116, the grid roller 124, the motor 194, and the like, without placing excessive load thereon.

The rotation transmission gear 188, which causes the take-up spindle drive gear 158 and the grid roller drive gear 186 to rotate, meshes with a drive gear 192 arranged inside the installation section 104 when the standard wiping unit 100 is installed in the wiping unit installation section 104 of the wiping device main body 102.

The drive gear 192 is fixed to the output shaft of the motor 194 and when the standard wiping unit 100 is installed in the wiping unit installation section 104, the drive gear 192 is disposed in a position so as to mesh with the rotational transmission gear 188.

The motor 194 is constituted of a pulse motor, for example, and is installed on the base portion of the wiping unit installation section 104. The driving of the motor 194 is controlled by the controller (not shown).

The drive mechanism of the standard wiping unit 100 is composed as described above.

In this way, by installing the standard wiping unit 100 on the wiping unit installation section 104 of the wiping device main body 102, the rotation transmission gear 188 arranged in the case 112 of the standard wiping unit 100 meshes with the drive gear 192 arranged in the wiping unit installation section 104 (see FIGS. 18A and 18B). When the motor 194 is driven in this state, then the drive gear 192 fixed to the output shaft of the motor 194 rotates and this rotation is transmitted to the rotation transmission gear 188 and causes the rotation transmission gear 188 to rotate.

When the rotation transmission gear 188 rotates, this rotation of the rotation transmission gear 188 is transmitted to the take-up spindle drive gear 158 and the grid roller drive gear 186, and hence the take-up spindle drive gear 158 and the grid roller drive gear 186 rotate. Thereby, the take-up spindle 116 and the grid roller 124 rotate. Due to this rotation of the take-up spindle 116 and the grid roller 124, the wiping web 110 is paid out from the pay-out core 138 installed on the pay-out spindle 114 and is wound up onto the take-up core 142 installed on the take-up spindle 116 through a prescribed path of travel.

As described above, when the standard wiping unit 100 is installed in the wiping unit installation section 104, the rotation transmission gear 188 meshes with the drive gear 192, and the take-up spindle 116 and the grid roller 124 can be driven.

Figure 19:
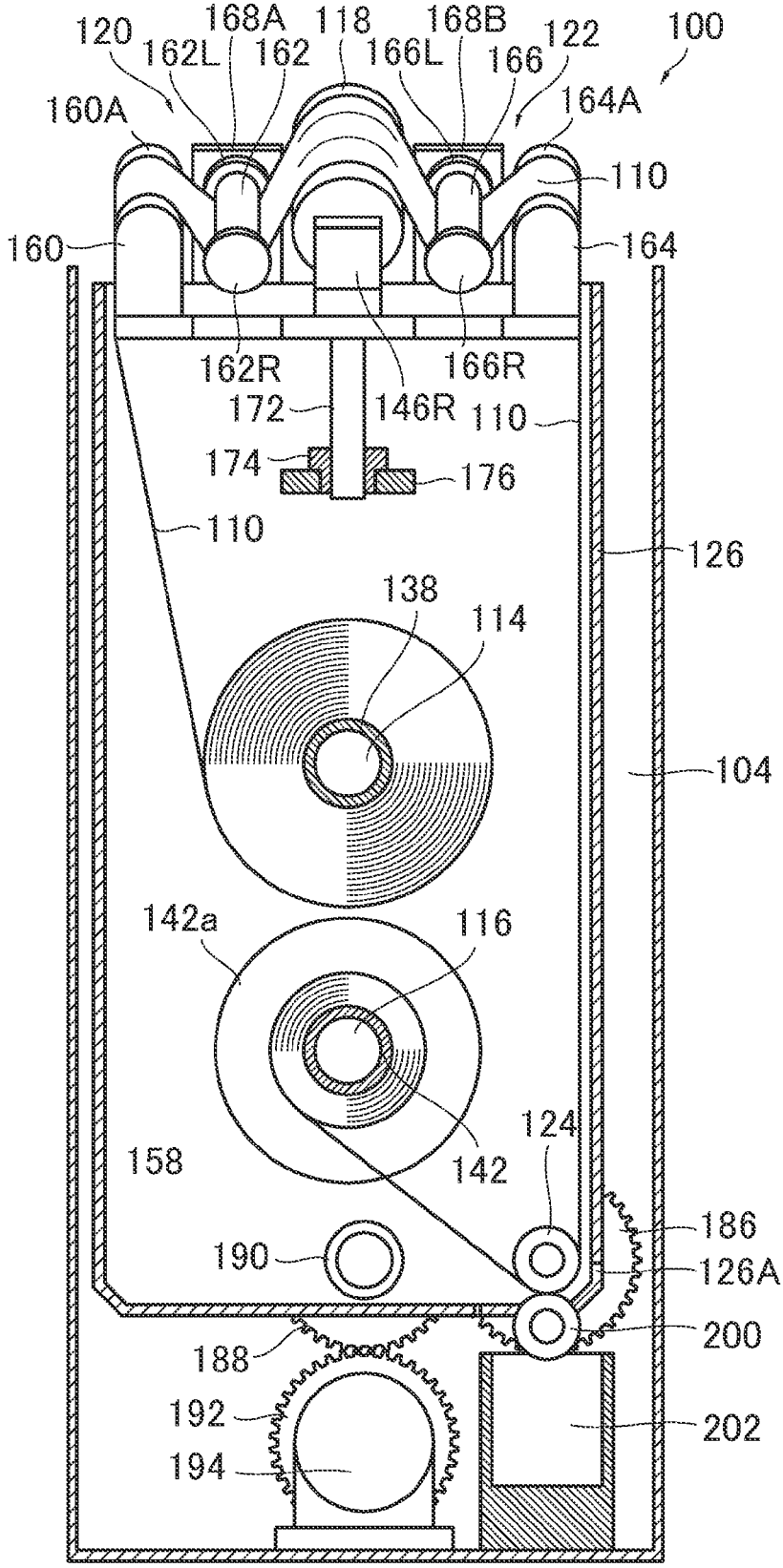
FIG. 19 is a partial cross-sectional front view diagram showing a state where the standard wiping unit has been installed in an installation section.
Figure 20:
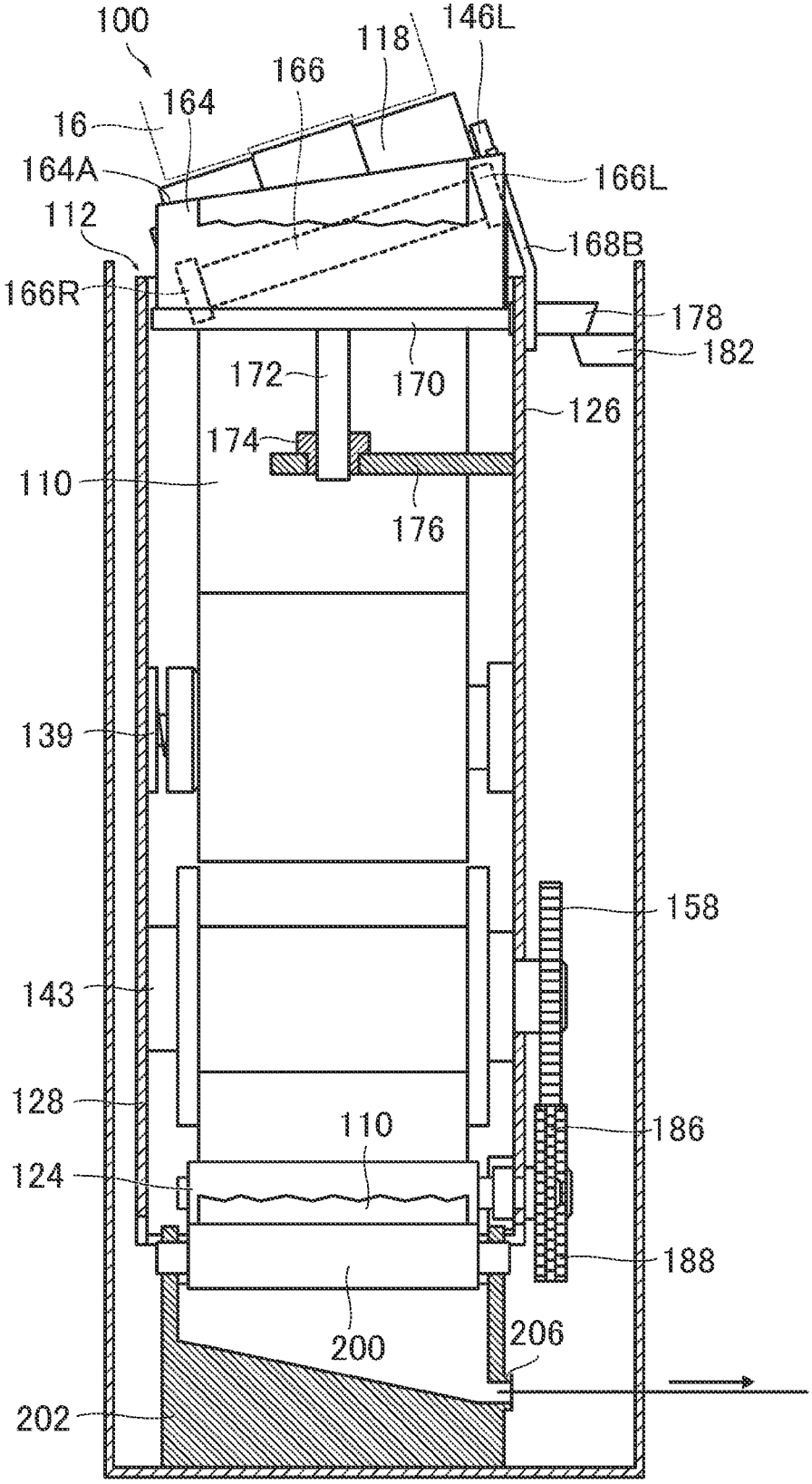
FIG. 20 is a partial cross-sectional side view diagram showing the state where the standard wiping unit has been installed in the installation section.

On the other hand, when the standard wiping unit 100 is installed in the wiping unit installation section 104, as shown in FIGS. 19 and 20, a nip roller 200 arranged in the wiping unit installation section 104 is pressed against the outer circumference portion of the grip roller 124 through an opening 126A formed in the bottom portion of the case main body 126.

The nip roller 200 has substantially the same width as the grid roller 124 and the outer circumference portion of the nip roller 200 is covered with an elastic body made of rubber, or the like. The nip roller 200 is installed horizontally on in a waste liquid receptacle 202 which is disposed in the wiping unit installation section 104.

The waste liquid receptacle 202 has a rectangular box shape of which the upper portion is open, and bearing sections (not shown) for supporting the nip roller 200 are arranged on the upper edge portions thereof. The nip roller 200 is supported by the bearing sections so as to be rotatable in the waste liquid receptacle 202.

The bottom face of the interior of the waste liquid receptacle 202 is formed with an inclination, and a waste liquid outlet 206 is formed in the lower end portion of the bottom face in the direction of inclination. The waste liquid outlet 206 is connected to the waste liquid tank 58 through a pipe (not shown).

When the standard wiping unit 100 on which the wiping web 110 has been installed is fitted into the wiping unit installation section 104, then the wiping web 110 wound about the grid roller 124 is nipped between the nip roller 200 and the grid roller 124. The wiping web 110 which is nipped between the nip roller 200 and the grid roller 124 is sent toward the take-up core 142 by driving the grid roller 124 to rotate in this state.

Here, the wiping web 110 nipped between the nip roller 200 and the grid roller 124 is the wiping web 110 that has been wiped the nozzle surface, and therefore this wiping web 110 has absorbed the cleaning liquid, and the like. The liquid absorbed by the wiping web 110 is removed from the wiping web 110 and recovered in the waste liquid receptacle 202 when the wiping web 110 passes between the grid roller 124 and the nip roller 200.

Thereby, the nip roller 200 and the grid roller 124 function as the conveyance device for the wiping web 110, and also function as the device for removing liquid (waste liquid) which has been absorbed by the wiping web 110. Thus, it is possible to prevent the waste liquid from dripping down off the wiping web 110 which is taken up on the take-up core 142 and soiling the peripheral area or causing breakdown of the apparatus.

The standard wiping units 100 (100C, 100M, 100Y, 100K) are composed as described above.

The wiping device 64 is composed by installing the standard wiping units 100C, 100M, 100Y and 100K in the wiping unit installation section 104 of the wiping device main body 102.

The operation of the wiping device 64 is controlled by the controller (not shown). The controller controls the wiping operation by the wiping device 64 by controlling the driving of the elevator device, motor 194, and the like.

<Action of Standard Wiping Unit>

Next, a wiping operation using the standard wiping unit 100 (100C, 100M, 100Y, 100K) is described.

<<Installation of Wiping Web>>

The method of installing the wiping web 110 is described.

The wiping web 110 is presented in a wound state in the form of a roll on the pay-out core 138, and the leading end of the wiping web 110 is fixed to the take-up core 142.

Firstly, the standard wiping unit 100 is taken out from the wiping device main body 102 and the lid 128 of the case 112 is opened. When the lid 128 is opened, the pay-out spindle 114 and the take-up spindle 116 are exposed, and then the pay-out core 138 is installed on the pay-out spindle 114 and the take-up core 142 is installed on the take-up spindle 116.

At this time, the pay-out core 138 and the take-up core 142 are installed while wrapping the wiping web 110 about the first front-stage guide 160, the pressing roller 118, the first rear-stage guide 164, and the grid roller 124.

More specifically, firstly, the pay-out core 138 is installed on the pay-out spindle 114. The pay-out core 138 is installed by fitting the pay-out core 138 onto the pay-out spindle 114. Thereby, the pay-out core 138 is rotatably supported about the pay-out spindle 114.

Thereupon, the wiping web 110 is paid out by a prescribed amount from the pay-out core 138, passed below the second front-stage guide 162 and the second rear-stage guide 166, and the wiping web 110 is wrapped about the upper side of the first front-stage guide 160, the pressing roller 118 and the first rear-stage guide 164. At this time, the wiping web 110 is wrapped about the first front-stage guide 160, the pressing roller 118 and the first rear-stage guide 164 while the elevator stage 170 is in the lowered state, in other words, while the first front-stage guide 160, the pressing roller 118 and the first rear-stage guide 164 are in the downwardly retracted state. Thereby, it is possible to ensure sufficient space with respect to the second front-stage guide 162 and the second front-stage guide 166, and the wiping web 110 can be easily wrapped about the first front-stage guide 160, the pressing roller 118 and the first rear-stage guide 164 by passing below the second front-stage guide 162 and the second rear-stage guide 166.

The wiping web 110 wrapped around the first front-stage guide 160, the pressing roller 118 and the first rear-stage guide 164 is further wrapped around the grid roller 124, and finally the take-up core 142 is installed on the take-up spindle 116.

The take-up core 142 is installed by fitting the take-up core 142 onto the take-up spindle 116. In this case, the key groove 142C formed in the inner circumference of the take-up core 142 is fitted onto the key 116D formed on the outer circumference of the take-up spindle 116. Thereby, the take-up core 142 is installed on the take-up spindle 116 in a state where the rotation in the circumferential direction is restricted. Accordingly, the rotation of the take-up spindle 116 can be transmitted to the take-up core 142, and the take-up core 142 can be rotated together with the take-up spindle 116.

As described above, since the torque limiter 116C is arranged on the take-up spindle 116, then slipping occurs if a load over the prescribed threshold is applied, and therefore it is possible to wind up the wiping web 110 while avoiding undue load.

By means of the foregoing steps, the installation of the wiping web 110 is completed. Thereupon, the lid 128 of the case 112 is closed.

Here, when the lid 128 is closed, the pay-out core pressing block 139 arranged inside the lid 128 abuts against the end face of the pay-out core 138 installed on the pay-out spindle 114, and presses the pay-out core 138 in the axial direction thereof. Thus, the pay-out core 138 is disposed between the pay-out core pressing block 139 and the flange 114A of the pay-out spindle 114, and thereby receives friction. Due to friction being applied to the pay-out core 138 in this way, the wiping web 110 can be caused to stably travel without slackness, even if there is a sudden change in the tension.

Furthermore, when the lid 128 is closed, the guide plate 143 arranged on the inside of the lid 128 is disposed on the front end of the take-up spindle 116. Thus, it is possible to take the wiping web 110 up onto the take-up core 142 while aligning the side end of the wiping web 110.

<<Setting in Wiping Device Main Body>>

Next, a method for setting the standard wiping unit 100 in the wiping device main body 102 is described.

The standard wiping unit 100 is set in the wiping device main body 102 by vertically inserting the standard wiping unit 100 into the wiping unit installation section 104 formed in the wiping device main body frame 102A of the wiping device main body 102.

When the standard wiping unit 100 has been set in the wiping unit installation section 104, as shown in FIG. 18B, the rotation transmission gear 188 of the standard wiping unit 100 meshes with the drive gear 192 arranged in the wiping unit installation section 104. Thereby, the take-up spindle 116 and the grid roller 124 become drivable.

Furthermore, when the standard wiping unit 100 is set in the wiping unit installation section 104, the elevator lever 178 arranged on the elevator stage 170 engages with the pin 182 arranged on the wiping unit installation section 104, and the elevator stage 170 is forcibly raised up to the prescribed position. Thereby, the first front-stage guide 160, the pressing roller 118 and the first rear-stage guide 164 are registered in the prescribed use position. By registering the first front-stage guide 160, the pressing roller 118 and the first rear-stage guide 164 in the prescribed use position, the wiping web 110 becomes wrapped about the second front-stage guide 162, which is disposed between the first front-stage guide 160 and the pressing roller 118, and furthermore the wiping web 110 also becomes wrapped about the second rear-stage guide 166, which is disposed between the pressing roller 118 and the first rear-stage guide 164. Thus, the wiping web 110 is tautly wrapped about the circumferential surface of the pressing roller 118.

Moreover, when the standard wiping unit 100 is set in the wiping unit installation section 104, as shown in FIGS. 19 and 20, the nip roller 200 arranged on the wiping unit installation section 104 is pressed against the grid roller 124. Thereby, the wiping web 110 wrapped around the grid roller 124 is nipped between the nip roller 200 and the grid roller 124.

By means of the foregoing, the setting of the standard wiping unit 100 in the wiping device main body 102 is completed.

In the thus set standard wiping unit 100 in the wiping device main body 102, by driving the motor 194, the wiping web 110 is paid out from the pay-out spindle 114 and taken up onto the take-up spindle 116 after passing along the prescribed path of travel.

Furthermore, as shown in FIG. 8, the pressing rollers 118 of the standard wiping units 100C, 100M, 100Y and 100K, which correspond respectively to the nozzle surfaces 30C, 30M, 30Y and 30K of the inkjet heads 16C, 16M, 16Y and 16K disposed with their nozzle surfaces 30C, 30M, 30Y and 30K at the inclinations with respect to the horizontal plane, are positioned in parallel with the nozzle surfaces 30C, 30M, 30Y and 30K, respectively. Thus, it is possible to cause the wiping webs 110 wrapped about the respective pressing rollers 118 to make tight contact with the corresponding nozzle surfaces 30C, 30M, 30Y and 30K.

<<Wiping Operation>>

Similarly to the cleaning liquid deposition device 62, the wiping device 64 wipes the nozzle surfaces 30 (30C, 30M, 30Y, 30K) of the inkjet heads 16 (16C, 16M, 16Y, 16K) while the inkjet heads move from the maintenance position to the image recording position. More specifically, the nozzle surfaces are wiped as follows.

As described above, the wiping device main body frame 102A of the wiping device main body 102 is arranged raisably and lowerably by means of the elevator device (not shown). The wiping device main body frame 102A is disposed in the prescribed standby position, when not performing cleaning, and is raised by the prescribed amount from the standby position and moved to the prescribed operating position only when cleaning is being performed.

When the wiping device main body frame 102A is moved to the operating position, the nozzle surfaces 30C, 30M, 30Y and 30K of the inkjet heads 16C, 16M, 16Y and 16K can be wiped by the respective standard wiping units 100C, 100M, 100Y and 100K. More specifically, when the inkjet heads 16C, 16M, 16Y and 16K pass the respective standard wiping units 100C, 100M, 100Y and 100K, it is possible for the wiping webs 110 wound about the pressing rollers 118 to be pressed against the nozzle surfaces 30C, 30M, 30Y and 30K.

When the inkjet heads 16C, 16M, 16Y and 16K in which the cleaning liquid has been deposited on the nozzle surfaces 30C, 30M, 30Y and 30K by the cleaning liquid deposition device 62 are moved past the standard wiping units 100C, 100M, 100Y and 100K, the wiping webs 110 wrapped around the pressing rollers 118 are respectively pressed against the nozzle surfaces 30C, 30M, 30Y and 30K. Thereby, the nozzle surfaces 30C, 30M, 30Y and 30K are wiped.

The controller drives the motors 194 and causes the wiping webs 110 to travel, in accordance with the timing at which the inkjet heads 16C, 16M, 16Y and 16K arrive at the standard wiping units 100C, 100M, 100Y and 100K. Thereby, the traveling wiping webs 110 are pressed against the nozzle surfaces 30C, 30M, 30Y and 30K, thus wiping and cleaning the nozzle surfaces 30C, 30M, 30Y and 30K by means of the traveling wiping webs 110.

During this, the wiping webs 110 wipe the nozzle surfaces 30C, 30M, 30Y and 30K while traveling in the direction opposite to the direction of movement of the nozzle surfaces 30C, 30M, 30Y and 30K. Thus, the nozzle surfaces 30C, 30M, 30Y and 30K can be wiped efficiently. Furthermore, it is also possible to perform wiping of the nozzle surfaces 30C, 30M, 30Y and 30K, by using new surfaces of the webs at all times.

The wiping webs 110 each travel in the following manner.

When the motor 194 is driven, the rotation of the motor 194 is transmitted to the take-up spindle drive gear 158 and the grid roller drive gear 186 through the drive gear 192 and the rotation transmission gear 188. Thereby, the take-up spindle 116 and the grid roller 124 rotate.

When the grid roller 124 rotates, the conveyance action is applied to the wiping web 110 and the wiping web 110 is paid out from the pay-out core 138. The wiping web 110 is then conveyed toward the take-up core 142.

In so doing, as described above, friction is applied to the pay-out core 138, and therefore it is possible to pay-out the wiping web 110 without the occurrence of slackness, even if there is a sudden change in tension in the wiping web 110.

Furthermore, due to the rotation of the take-up spindle drive gear 158, the take-up core 142 rotates and accordingly the wiping web 110 is taken up.

In this way, in the wiping device 64 according to the present embodiment, the velocity at which the wiping web 110 is wound up by the take-up core 142 is set to be faster than the velocity at which the wiping web 110 is conveyed by the grid roller 124. Thus, it is possible to take up the wiping web 110 in a stable fashion, without any slackness.

On the other hand, if the take-up velocity of the wiping web 110 is made faster than the conveyance speed in this way, then when the winding diameter in the winding core 142 is raised, a load is applied to the take-up spindle 116, but because the torque limiter 116C is arranged on the take-up spindle 116 in the wiping device 64 according to the present embodiment, then it is possible to wind up the wiping web 110 without applying undue load, and the wiping web 110 can be made to travel stably.

In the manner described above, the wiping web 110 can be made to travel by driving the motor 194. By pressing the traveling wiping web 110 against the nozzle surface in this way, the nozzle surface is wiped by the wiping web 110.

The wiping web 110 that has finished wiping is wound up on the take-up core 142 as described above, but is nipped between the grid roller 124 and the nip roller 200 at the front-stage position. By this means, the absorbed liquid (cleaning liquid, ink, etc.) is removed from the wiping web 110 as waste liquid.

The waste liquid removed from the wiping web 110 drops down under its own weight and is recovered in the waste liquid receptacle 202. The waste liquid recovered in the waste liquid receptacle 202 is recovered to the waste liquid tank 58 from the waste liquid outlet 206 through a pipe (not shown).

<Composition of Strong Wiping Unit>

Next, the composition of the strong wiping units 300C, 300M, 300Y and 300K is described.

Similarly to the standard wiping units 100C, 100M, 100Y and 100K, the strong wiping units 300C, 300M, 300Y and 300K are arranged so as to respectively correspond to the inkjet heads 16C, 16M, 16Y and 16K of the respective colors, but all have the same basic composition, and therefore the composition is described here with respect to one "strong wiping unit 300".

Figure 21:
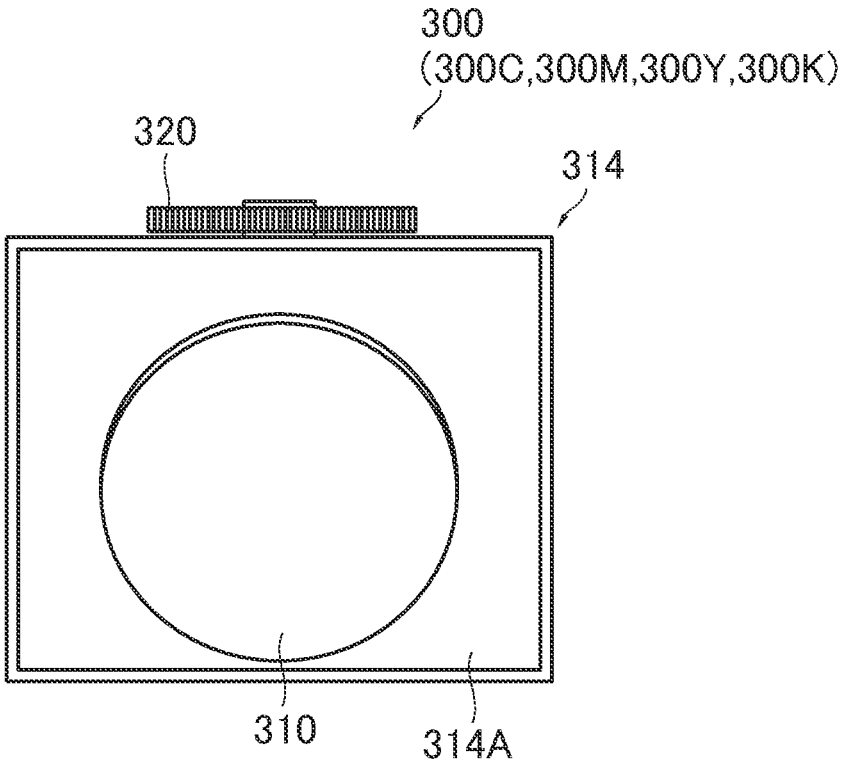
FIG. 21 is a plan view diagram of a strong wiping unit.
Figure 22:
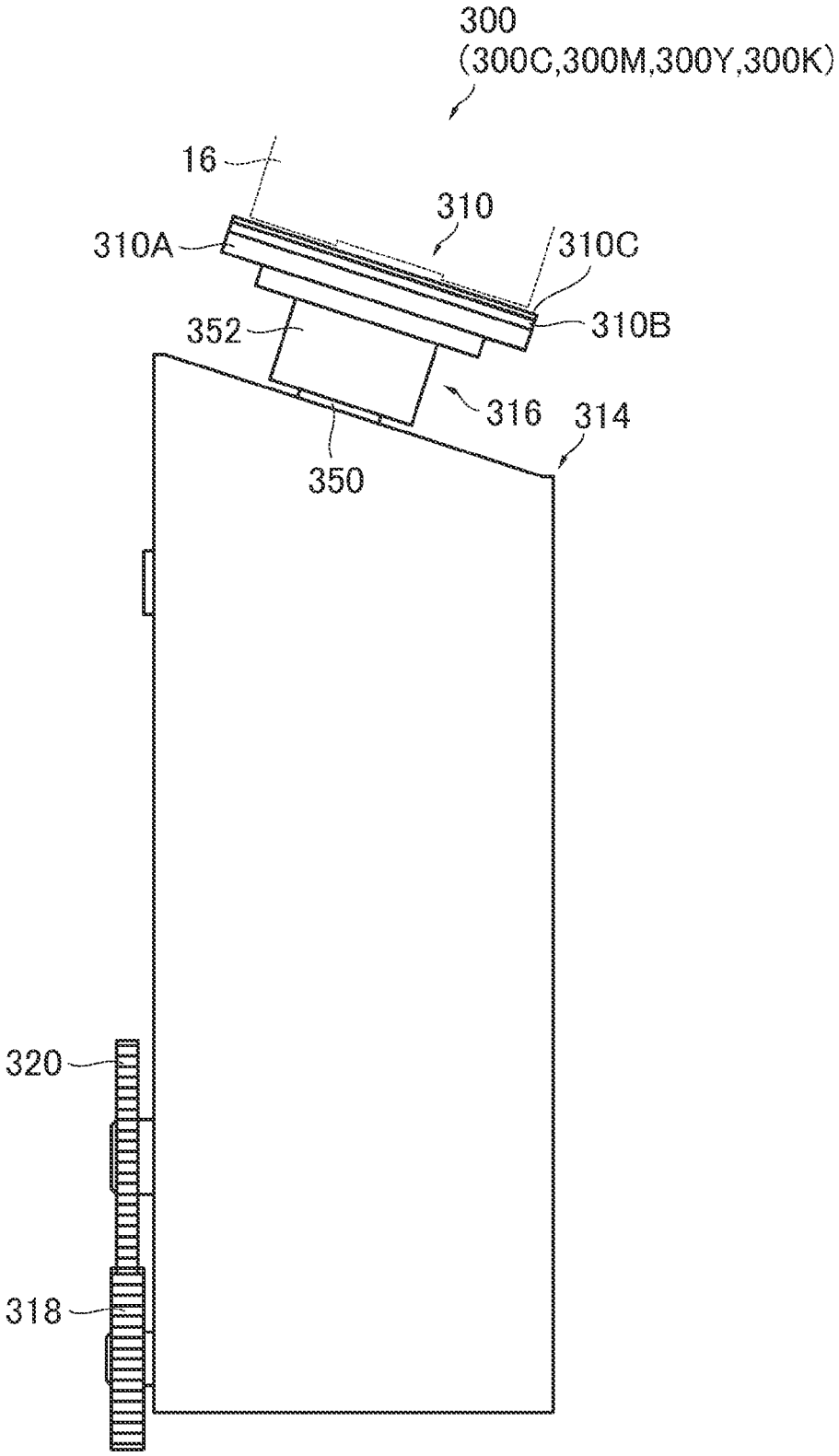
FIG. 22 is a side view diagram showing the strong wiping unit viewed from the image recording position side.
Figure 23:
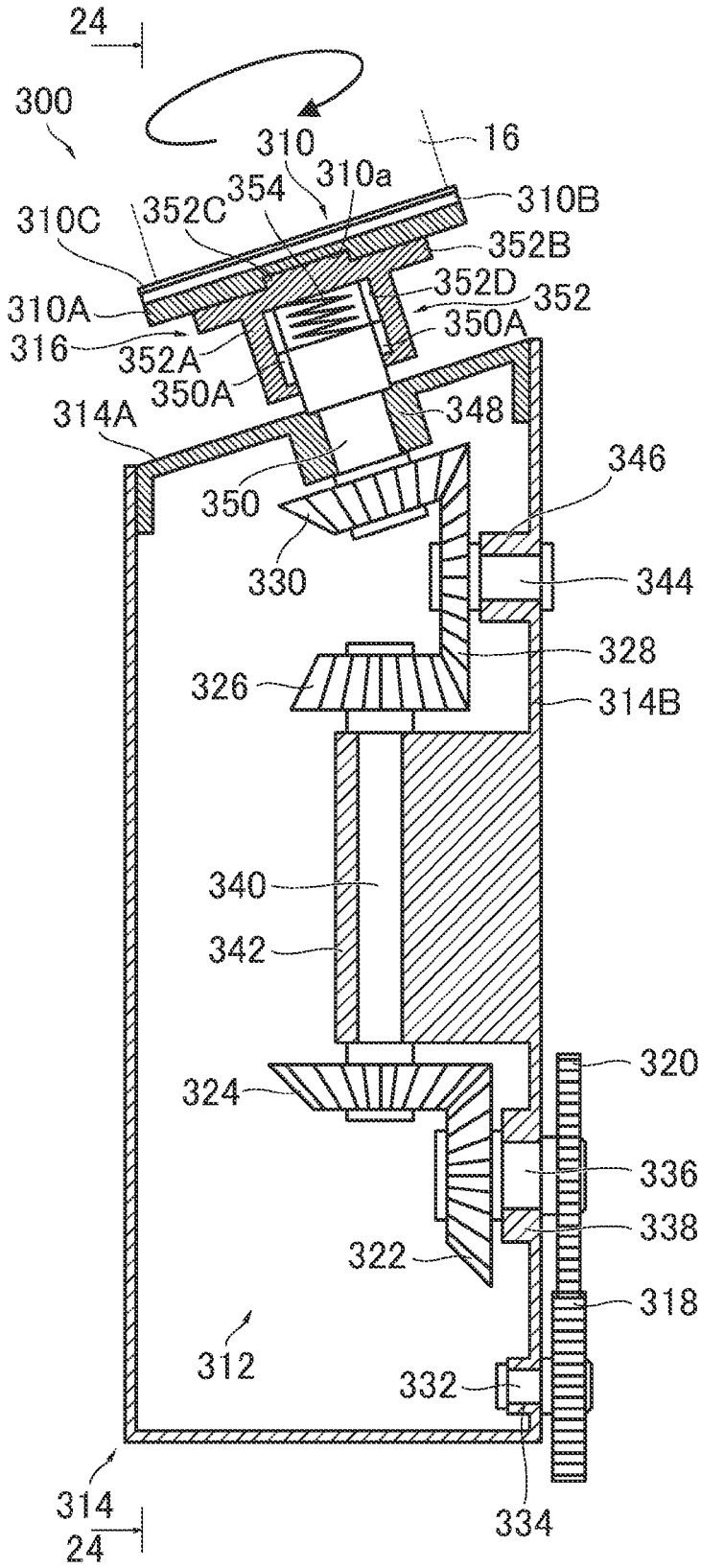
FIG. 23 is a partial cross-sectional side view diagram of the strong wiping unit.
Figure 24:
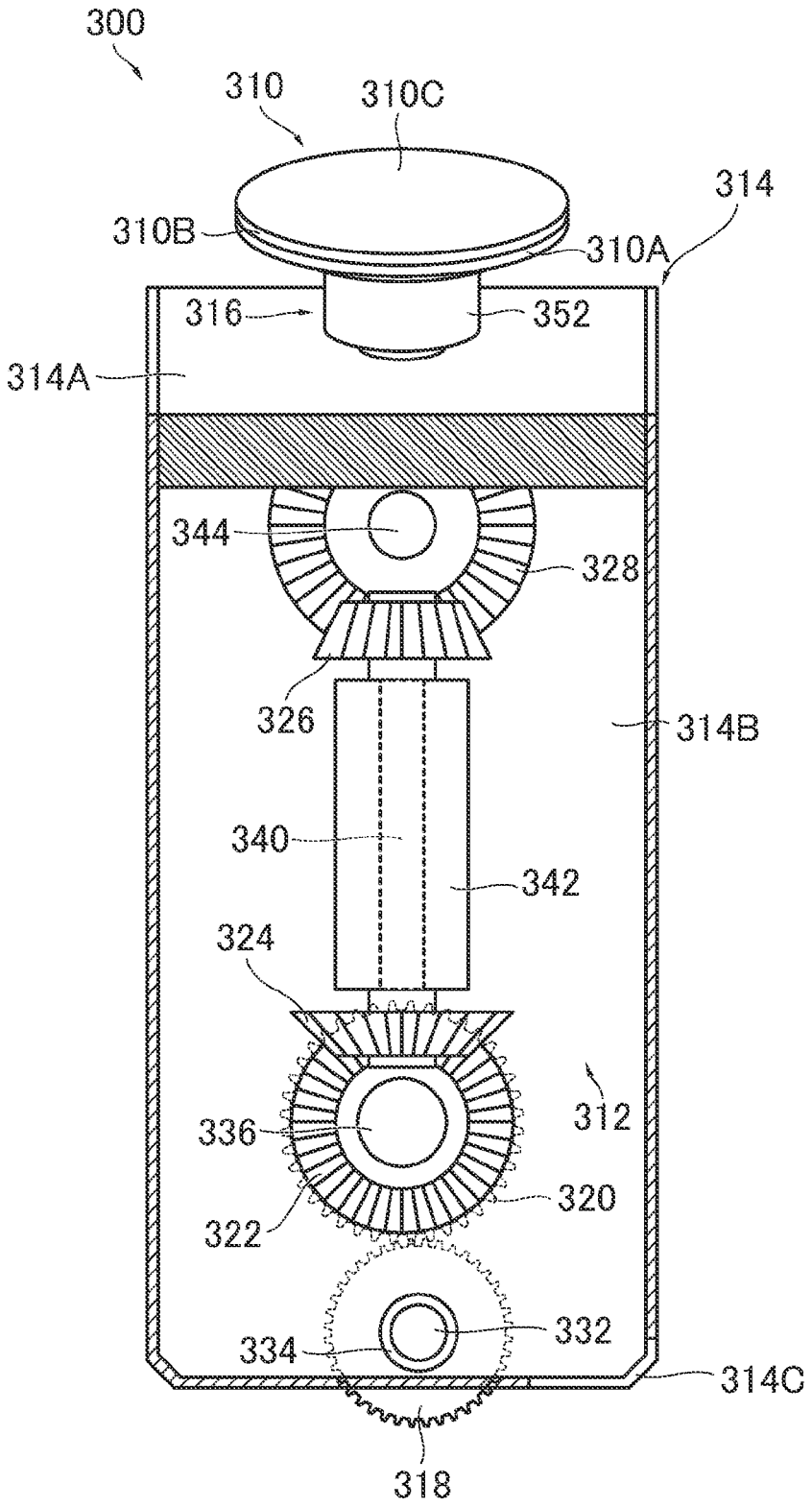
FIG. 24 is a partial cross-sectional front view diagram of the strong wiping unit.

FIG. 21 is a plan view diagram of the strong wiping unit 300; FIG. 22 is a side view diagram of the strong wiping unit 300 viewed from the image recording position side, FIG. 23 is a partial cross-sectional side view of the strong wiping unit 300, and FIG. 24 is a partial cross-sectional front view of the strong wiping unit 300.

As shown in FIGS. 21 to 24, the strong wiping unit 300 wipes the nozzle surface of the inkjet head by pressing a rotating circular disk-shaped wiping pad 310 against the nozzle surface of the inkjet head.

The strong wiping unit 300 includes: the wiping pad 310; a rotational drive mechanism 312, which drives the wing pad 310 so as to rotate; and a case 314, which accommodates the rotational drive mechanism 312.

The case 314 is formed in a box-shape, which is long in the vertical direction, and an upper surface portion 314A thereof is inclined. The case 314 is formed to have substantially the same dimensions (length, width and height) with the case 112 of the standard wiping unit 100 in such a manner that the case 314 can be installed interchangeably in the wiping unit installation section 104.

The upper surface portion 314A of the case 314 is formed so as to be inclined at substantially the same angle as the nozzle surface of the inkjet head that is to be wiped. More specifically, the upper surface portion 314A is formed so as to be parallel to the nozzle surface of the inkjet head that is to be wiped, when the case 314 is installed in the wiping unit installation unit 104.

A cutaway 314C is formed in the bottom portion of the case 314 so as not to contact with the grid roller 124 when the case 314 is installed in the wiping unit installation section 104.

The wiping pad 310 is constituted of: a base plate 310A, which is formed in a circular disk shape; a cushion plate 310B, which is attached to the upper surface of the base plate 310A; and a wiping cloth 310C, which is attached to the upper portion of the cushion plate 310B.

The base plate 310A is formed in the circular disk shape from a hard material which does not readily deform, and a screw hole 310*a* is formed in the center of the rear surface thereof.

The cushion plate 310B is formed in the circular disk shape from an elastic material, such as silicone rubber or polyolefin, and is attached to the upper surface of the base plate 310A.

The wiping cloth 310C is formed in the circular shape from a sheet of the same material as the wiping web 110 of the standard wiping unit 100 described above (for example, a knitted or woven sheet made of ultra-fine fibers of PET (polyethylene terephthalate), PE (polyethylene), NY (nylon), or the like), and is attached to the upper surface of the cushion plate 310B.

The wiping pad 310 having the above-described composition is attached to a wiping pad drive axle 316, which is arranged projectingly from the upper surface portion 314A of the case 314.

When the strong wiping unit 300 is installed in the wiping unit installation section 104, the rotational drive mechanism 312 receives the drive force from the motor 194 arranged in the wiping unit installation section 104 and drives the wiping pad drive axle 316 to rotate.

As shown in FIG. 23, the rotational drive mechanism 312 includes: a first gear 318; a second gear 320, which meshes with the first gear 318; a third gear 322, which is attached coaxially with the second gear 320; a fourth gear 324, which meshes with the third gear 322; a fifth gear 326, which is attached coaxially with the fourth gear 324; a sixth gear 328, which meshes with the fifth gear 326; and a seventh gear 330, which is attached to the wiping pad drive axle 316 and meshes with the sixth gear 328.

The first gear 318 is a flat gear wheel. The first gear 318 is installed on a first rotational axle 332 and is disposed on the lower end portion of the rear surface of the case 314.

The first rotational axle 332 is rotatably supported by a first bearing section 334, which is arranged on the rear wall surface section 314B of the case 314, and the first rotational axle 332 is horizontally arranged on the rear wall surface section 314B of the case 314.

The first gear 318 meshes with the drive gear 192 when the strong wiping unit 300 is installed in the wiping unit installation section 104.

The second gear 320, which meshes with the first gear 318, is a flat gear wheel. The second gear 320 is installed on one end of a second rotational axle 336 and meshes with the first gear 318.

The second rotational axle 336 is rotatably supported by a second bearing section 338, which is arranged on the rear wall surface section 314B of the case 314, and the second rotational axle 336 is horizontally arranged on the rear wall surface section 314B of the case 314. The second rotational axle 336 is arranged so as to pass through the rear wall surface section 314B of the case 314, and the third gear 322 is installed on the other end of the second rotational axle 336.

The third gear 322 is a bevel gear wheel. As described above, the third gear 322 is installed on the other end of the second rotational axle 336. Therefore, when the second gear 320 rotates, the third gear 322 also rotates at the same speed of rotation as the second gear 320.

The fourth gear 324, which meshes with the third gear 322, is a bevel gear wheel. The fourth gear 324 is installed on the lower end of a third rotational axle 340, which is vertically arranged, and meshes with the third gear 322.

The third rotational axle 340 is rotatably supported by a third bearing section 342, which is arranged on the inside of the rear wall surface section 314B of the case 314, and the third rotational axle 340 is vertically arranged inside the case 314. The fifth gear 326 is installed on the upper end of the third rotational axle 340.

The fifth gear 326 is a bevel gear wheel. As described above, the fifth gear 326 is installed on the upper end of the third rotational axle 340. Therefore, when the fourth gear 324 rotates, the fifth gear 326 also rotates at the same speed of rotation as the fourth gear 324.

The sixth gear 328, which meshes with the fifth gear 326, is a bevel gear wheel. The sixth gear 328 is installed on one end of a fourth rotational axle 344 and meshes with the fifth gear 326.

The fourth rotational axle 344 is rotatably supported by a fourth bearing section 346, which is arranged on the rear wall surface section 314B of the case 314, and the fourth rotational axle 344 is horizontally arranged on the rear wall surface section 314B of the case 314.

The seventh gear 330, which meshes with the sixth gear 328, is a bevel gear wheel. As described above, the seventh gear 330 is installed on the wiping pad drive axle 316.

The wiping pad drive axle 316 is constituted of: a main axle 350; a cap 352, which is installed on the upper end of the main axle 350; and a spring 354, which impels the cap 352 in the axial direction.

The main axle 350 is rotatably supported by a main bearing section 348, which is arranged on the upper surface section 314A of the case 314, and the main axle 350 is arranged perpendicularly to the upper surface section 314A of the case 314. Since the upper surface section 314A of the case 314 is inclined, the main axle 350 is also inclined. Thus, the main axle 350 is arranged so as to be perpendicular to the nozzle surface when the strong wiping unit 300 is installed in the wiping unit installation section 104. The seventh gear 330 is installed on the lower end portion of the main axle 350.

The cap 352 is constituted of: a cap main body section 352A, which is formed in a cylindrical shape; a circular disk-shaped pad supporting section 352B, which is arranged on the upper end of the cap main body section 352A; and a screw section 352C, which is formed so as to project in the central part of the upper surface of the pad supporting section 352B.

The cap main body section 352A is formed in the cylindrical shape, and the inner diameter thereof is formed to substantially the same diameter as the outer diameter of the main axle 350. More specifically, the cap main body section 352A is formed in such a manner that the main axle 350 can be inserted therein.

The cap 352 is installed on the main axle 350 by inserting the main axle 350 into the inner circumference portion of the cap main body section 352A.

Here, as shown in FIG. 23, a plurality of key grooves 352D are formed at uniform intervals in the circumferential direction, in the inner circumference portion of the cap main body section 352A. On the other hand, a plurality of keys 350A are formed at uniform intervals in the circumferential direction, on the outer circumference of the upper end section of the main axle 350.

When the cap 352 is installed on the main axle 350 by inserting the main axle 350 into the inner circumference portion of the cap main body section 352A, the keys 350A formed on the main axle 350 are fitted into the key grooves 352D formed in the inner circumference portion of the cap main body section 352A. The cap 352 that has been fitted in this way is movable with respect to the main axle 350 in the axial direction, whereas the movement of the cap 352 in the circumferential direction with respect to the main axle 350 is restricted. Thus, the cap 352 is installed movably in the axial direction, while being able to receive transmission of the rotation of the main axle 350.

The pad supporting section 352B is formed in the circular disk shape and is integrated with the upper end of the cap main body section 352A.

The screw section 352C is formed so as to project in the central portion of the cap main body section 352A. The screw section 352C functions as an attachment device (fastening device) for the wiping pad 310, and is formed with a male screw thread that turns in the opposite direction to the direction of rotation of the wiping pad drive axle 316. The wiping pad 310 is attached to the wiping pad drive axle 316 by screwing the screw hole 310*a* formed in the rear surface of the base plate 310A onto the screw section 352C.

The spring 354 is accommodated in the inner circumference portion of the cap main body section 352A. The cap 352 is installed on the main axle 350 with the spring 354 in the accommodated state. Thereby, the gap 352 is impelled in the axial direction.

In the rotational drive mechanism 312 composed as described above, when the first gear 318 is rotated, the rotation is transmitted through the second gear 320, the third gear 322, the fourth gear 324, the fifth gear 326 and the sixth gear 328, to the seventh gear 330, and the wiping pad drive axle 316 on which the seventh gear 330 is installed also rotates. By rotating the wiping pad drive axle 316, the wiping pad 310 attached to the wiping pad drive axle 316 is rotated.

The strong wiping unit 300 has the composition described above.

<Action of Strong Wiping Unit>

Next, a wiping operation using the strong wiping unit 300 (300C, 300M, 300Y, 300K) is described.

<<Installation of Wiping Pad>>

The method of installing the wiping pad 310 on the strong wiping unit 300 is described.

The wiping pad 310 is installed on the wiping pad drive axle 316 by screwing the screw hole 310*a* formed in the rear surface of the base plate 310A onto the screw section 352C, which is formed on the upper end of the wiping pad drive axle 316.

The screw hole 310*a* and the screw section 352C are coupled by the screw threads which turn in the opposite direction to the direction of rotation of the wiping pad drive axle 316 (i.e., the coupling becomes tighten when the wiping pad drive axle 316 is rotated with respect to the wiping pad 310 in the direction of the rotation during the wiping operation), and therefore the wiping pad 310 does not become detached during the rotation.

<<Setting in Wiping Device Main Body>>

Next, a method for setting the strong wiping unit 300 in which the wiping pad 310 has been installed, in the wiping device main body 102, is described.

Similarly to the case of the standard wiping unit 100, the strong wiping unit 300 is set in the wiping device main body 102 by vertically inserting the strong wiping unit 300 into the wiping unit installation section 104 formed in the wiping device main body frame 102A of the wiping device main body 102.

The strong wiping unit 300 is locked with a locking mechanism (not shown) at a prescribed position, when vertically inserted in the wiping unit installation section 104. Thereby, the strong wiping unit 300 is set in the wiping unit installation section 104.

Figure 25A:
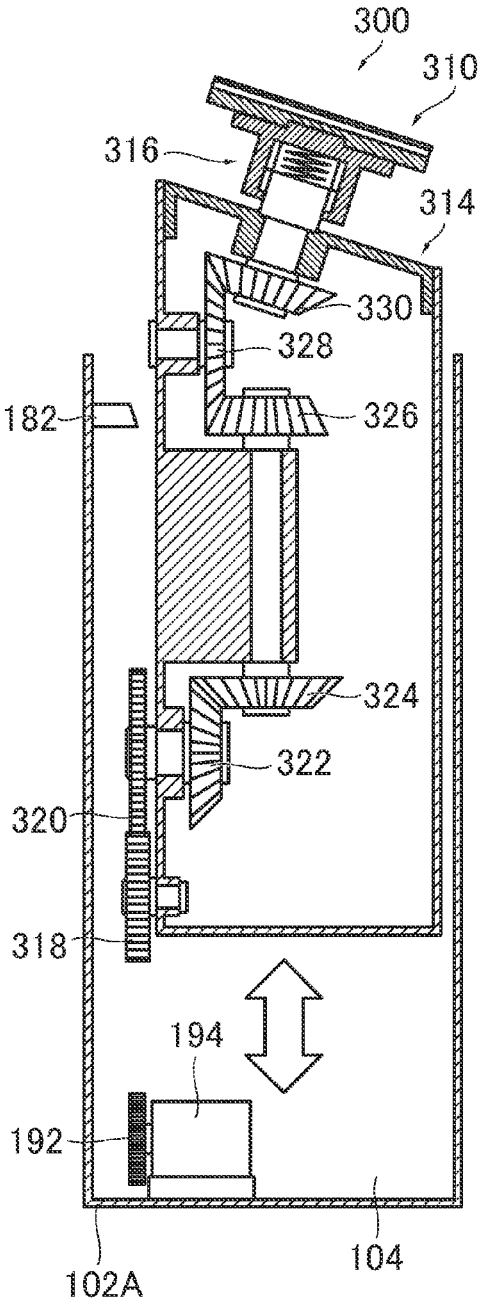
FIGS. 25A and 25B are illustrative diagrams of a method of installing the strong wiping unit.
Figure 25B:
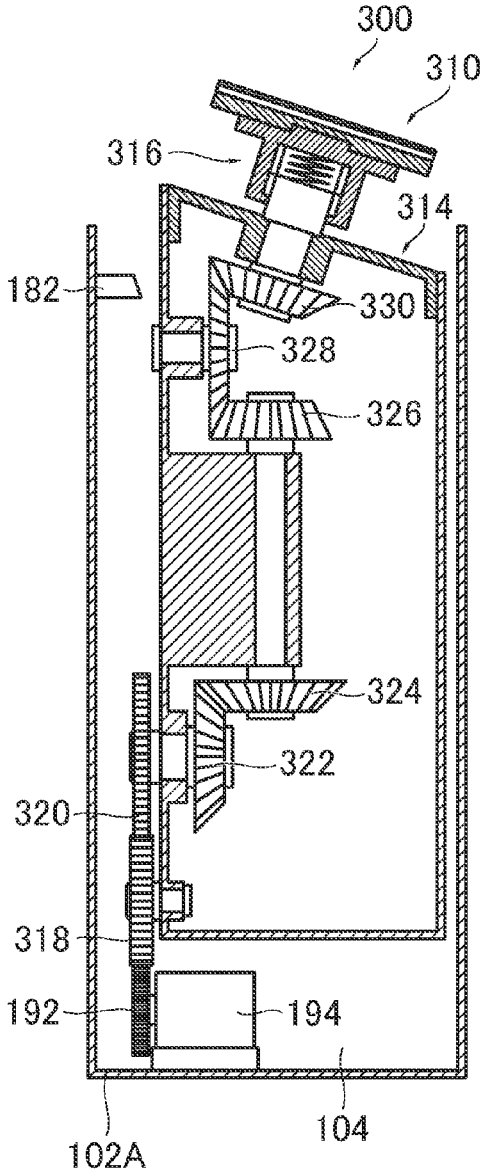
Figure 26:
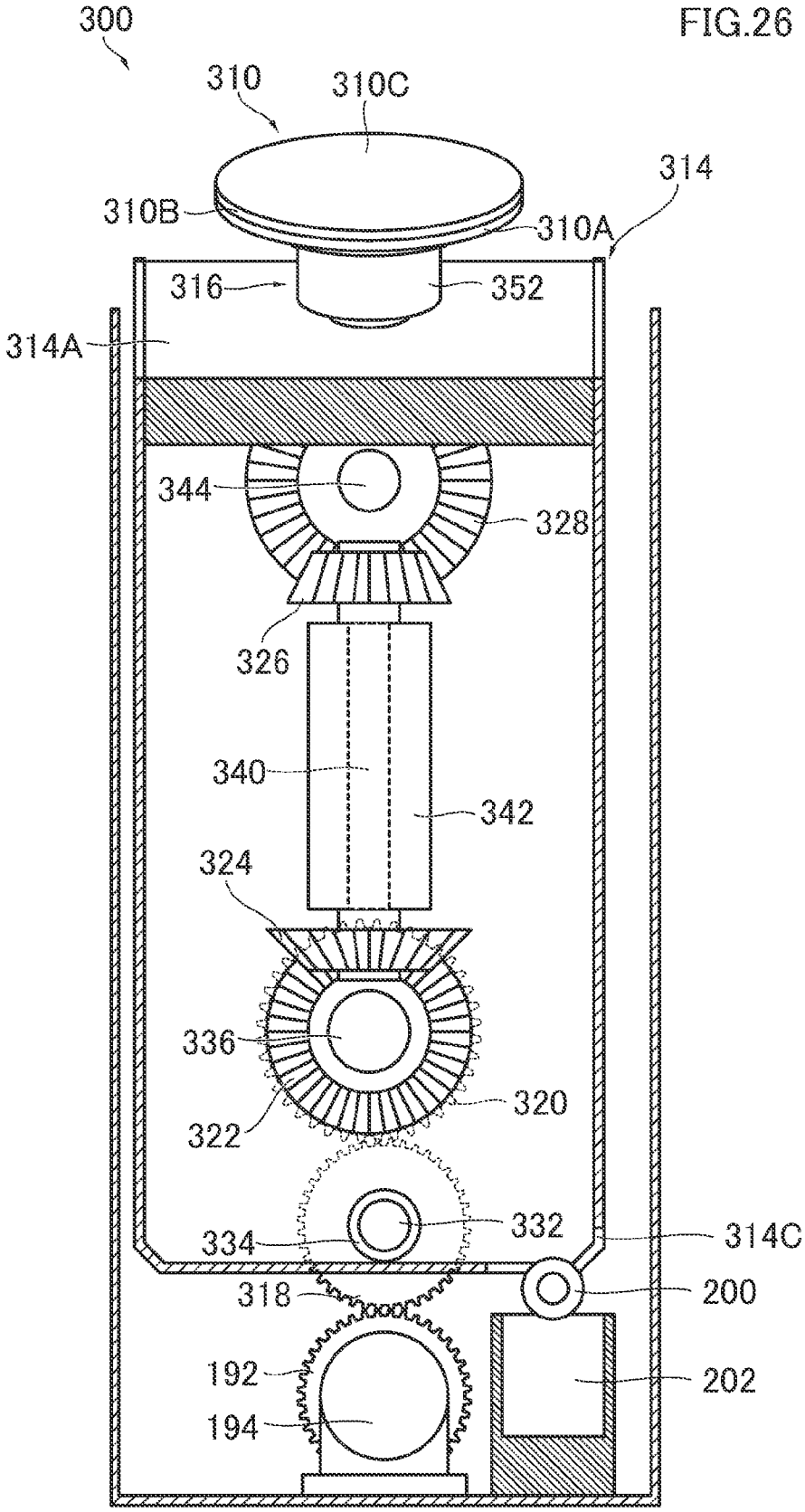
FIG. 26 is a front cross-sectional diagram showing a state where the strong wiping unit has been installed in the installation section.

When the strong wiping unit 300 has been set in the wiping unit installation section 104, as shown in FIGS. 25B and 26, the first gear 318 of the strong wiping unit 300 meshes with the drive gear 192 arranged in the wiping unit installation section 104. Thereby, it becomes possible to drive the first gear 318 to rotate and the strong wiping unit 300 can be operated.

Moreover, as shown in FIG. 22, the wiping pad 310 is arranged in parallel with the nozzle surface 30. By this means, it is possible to abut the wiping pad 310 against the nozzle surface 30.

<<Wiping Operation>>

Similarly to the case of the standard wiping unit 100, the nozzle surfaces 30 (30C, 30M, 30Y, 30K) of the inkjet heads 16 (16C, 16M, 16Y, 16K) are wiped by pressing the wiping pads 310 against the nozzle surfaces 30, which perform a sliding movement. In so doing, the wiping pads 310 are pressed against the nozzle surfaces 30 while the wiping pads 310 are rotated to wipe the nozzle surfaces 30. More specifically, the procedure is as follows.

As described above, the wiping device main body frame 102A of the wiping device main body 102 in the wiping device 64 is arranged raisably and lowerably by means of the elevator device (not shown). The wiping device main body frame 102A is disposed in the prescribed standby position, when not performing cleaning, and is raised by the prescribed amount from the standby position and moved to the prescribed operating position only when cleaning is being performed.

When the wiping device main body frame 102A is moved to the operating position, the nozzle surfaces 30C, 30M, 30Y and 30K of the inkjet heads 16C, 16M, 16Y and 16K can be wiped by the respective strong wiping units 300C, 300M, 300Y and 300K. More specifically, when the inkjet heads 16C, 16M, 16Y and 16K pass the respective strong wiping units 300C, 300M, 300Y and 300K, the wiping pads 310 can be pressed against the nozzle surfaces 30C, 30M, 30Y and 30K.

When the inkjet heads 16C, 16M, 16Y and 16K in which the cleaning liquid has been deposited on the nozzle surfaces 30C, 30M, 30Y and 30K by the cleaning liquid deposition device 62 are moved past the respective strong wiping units 300C, 300M, 300Y and 300K, the rotating wiping pads 310 are respectively pressed against the nozzle surfaces 30C, 30M, 30Y and 30K. Thereby, the nozzle surfaces 30C, 30M, 30Y and 30K are wiped.

The controller drives the motors 194 to rotate the wiping pads 310 in accordance with the timing at which the inkjet heads 16C, 16M, 16Y and 16K arrive at the strong wiping units 300C, 300M, 300Y and 300K. The controller also drives the elevator device to move the wiping device main body frame 102A to the operating position in accordance with the timing at which the inkjet heads 16C, 16M, 16Y and 16K arrive at the strong wiping units 300C, 300M, 300Y and 300K, so that the rotating wiping pads 310 are pressed respectively against the nozzle surfaces 30C, 30M, 30Y and 30K. Thus, the rotating wiping pads 310 are pressed against the nozzle surfaces 30C, 30M, 30Y and 30K, and the nozzle surfaces 30C, 30M, 30Y and 30K are wiped by the wiping pads 310.

Here, because the wiping pads 310 are rotating, the nozzle surfaces 30C, 30M, 30Y and 30K can be wiped in various directions and therefore adhering material can be effectively removed. In particular, soiling, or the like, which is adhering to the inner edges of the nozzle apertures can be effectively removed.

Moreover, the wiping pads 310 are impelled in the axial direction by the wiping pad drive axle 316 and are therefore able to wipe the nozzle surfaces 30C, 30M, 30Y and 30K without applying undue force.

Thus, in wiping using the strong wiping units 300, the nozzle surfaces are wiped by pressing the rotating wiping pads 310 against the nozzle surfaces.

Action of Nozzle Surface Cleaning Device

Next, a nozzle surface cleaning operation performed by the nozzle surface cleaning device 60 in the present embodiment having the composition described above is described.

The cleaning of the nozzle surfaces is performed while the inkjet heads 16C, 16M, 16Y and 16K are moved from the maintenance position to the image recording position.

Firstly, the cleaning liquid is deposited on the nozzle surfaces 30C, 30M, 30Y and 30K of the inkjet heads 16C, 16M, 16Y and 16K by the cleaning liquid deposition device 62 during the movement of the inkjet heads 16C, 16M, 16Y and 16K from the maintenance position to the image recording position, whereupon the nozzle surfaces 30C, 30M, 30Y and 30K are wiped by the wiping device 64.

Here, in the inkjet recording apparatus according to the present embodiment, it is possible to change the wiping operations by the wiping device 64, and hence wiping can be carried out in accordance with the circumstances. More specifically, it is possible to select the standard wiping using the standard wiping units 100, or the strong wiping using the strong wiping units 300, the respective wiping units being selectively usable in accordance with the circumstances.

The standard wiping is normally carried out using the standard wiping units 100, whereas the strong wiping using the strong wiping units 300 is carried out when soiling is very severe, for instance.

<Cleaning Method using Standard Wiping Units 100>

Firstly, the cleaning method using the standard wiping units 100 is described.

In this case, the standard wiping units 100 are installed in the wiping device main body 102 of the wiping device 64.

When a nozzle surface cleaning instruction is input to the controller, the controller moves the cleaning liquid deposition device main body 72 of the cleaning liquid deposition device 62 to the prescribed operating position. By this means, the cleaning liquid can be deposited by the cleaning liquid deposition device 62.

After the cleaning liquid deposition device 62 has been moved to the prescribed operating position, the controller causes the head supporting frame 40 to move from the maintenance position to the image recording position at a prescribed movement speed.

On the other hand, the controller also drives the cleaning liquid supply pump in accordance with the timing at which the inkjet heads 16C, 16M, 16Y and 16K arrive at the cleaning liquid deposition heads 74 of the cleaning liquid deposition units 70C, 70M, 70Y and 70K. Thereby, the cleaning liquid flows out at a prescribed flow rate from the cleaning liquid emission ports 78 of the cleaning liquid deposition heads 74 arranged in the respective cleaning liquid deposition units 70C, 70M, 70Y and 70K. The cleaning liquid which has flowed out from the cleaning liquid emission ports 78 flows down over the cleaning liquid holding surfaces 74A.

When the inkjet heads 16C, 16M, 16Y and 16K moving toward the image recording position pass the cleaning liquid deposition heads 74, the cleaning liquid which has flowed over the cleaning liquid holding surfaces 74A of the cleaning liquid deposition heads 74 contacts the nozzle surfaces 30C, 30M, 30Y and 30K, and the cleaning liquid is thereby deposited on the nozzle surfaces 30C, 30M, 30Y and 30K.

The nozzle surfaces 30C, 30M, 30Y and 30K on which the cleaning liquid has been deposited are moved in this state toward the image recording position. In passing the standard wiping units 100C, 100M, 100Y and 100K, the nozzle surfaces 30C, 30M, 30Y and 30K are cleaned by wiping.

The controller drives the motors 194 and causes the wiping webs 110 to travel, in accordance with the timing at which the inkjet heads 16C, 16M, 16Y and 16K arrive at the standard wiping units 100C, 100M, 100Y and 100K.

Moreover, the controller drives the elevator device (not shown) and moves the wiping device main body frame 102A of the wiping device main body 102 to the operating position, in accordance with the timing at which the inkjet heads 16C, 16M, 16Y and 16K arrive at the standard wiping units 100C, 100M, 100Y and 100K.

Thereby, the traveling wiping webs 110 are pressed against the nozzle surfaces 30C, 30M, 30Y and 30K, and the nozzle surfaces 30C, 30M, 30Y and 30K are thereby wiped and cleaned.

When the nozzle surfaces 30C, 30M, 30Y and 30K have completely passed the cleaning liquid deposition units 70C, 70M 70Y and 70K, the controller halts the driving of the cleaning liquid supply pump, and halts the supply of cleaning liquid. Thereupon, the controller withdraws the cleaning liquid deposition device 62 to the standby position.

When the nozzle surfaces 30C, 30M, 30Y and 30K have completely passed the standard wiping units 100C, 100M, 100Y and 100K, the controller halts the driving of the motors 194, and halts the travel of the wiping webs 110. Thereupon, the controller withdraws the wiping device main body frame 102A of the wiping device main body 102 to the standby position.

The cleaning of the nozzle surfaces 30C, 30M, 30Y and 30K of the inkjet heads 16C, 16M, 16Y and 16K is completed by the series of steps described above.

As described above, in the cleaning using the standard wiping units 100, the cleaning liquid is deposited onto the nozzle surfaces 30C, 30M, 30Y and 30K, whereupon the wiping webs 110 traveling in the opposite direction to the direction of travel of the nozzle surfaces 30C, 30M, 30Y and 30K are pressed to the nozzle surfaces 30C, 30M, 30Y and 30K, and thereby the nozzle surfaces 30C, 30M, 30Y and 30K are wiped and cleaned.

<Cleaning Method using Strong Wiping Units 300>

Next, the cleaning method using the strong wiping units 300 is described.

In the cleaning using the standard wiping units 100, the wiping is only performed in one direction, and hence it may be impossible sufficiently to remove adhering material originating from the ink which is located inside the nozzle holes and on the upstream side in the wiping direction.

Therefore, in order to ensure a normal nozzle surface without accumulation of adhering material of this kind, wiping using the strong wiping units 300 is carried out.

The wiping using the strong wiping units 300 is carried out by installing the strong wiping units 300 in the wiping device 64, instead of the standard wiping units 100.

When a nozzle surface cleaning instruction is input to the controller, the controller moves the cleaning liquid deposition device main body 72 of the cleaning liquid deposition device 62 to the prescribed operating position. By this means, the cleaning liquid can be deposited by the cleaning liquid deposition device 62.

After the cleaning liquid deposition device 62 has been moved to the prescribed operating position, the controller causes the head supporting frame 40 to move from the maintenance position to the image recording position at a prescribed movement speed.

On the other hand, the controller also drives the cleaning liquid supply pump in accordance with the timing at which the inkjet heads 16C, 16M, 16Y and 16K arrive at the cleaning liquid deposition heads 74 of the cleaning liquid deposition units 70C, 70M, 70Y and 70K. Thereby, the cleaning liquid flows out at a prescribed flow rate from the cleaning liquid emission ports 78 of the cleaning liquid deposition heads 74 arranged in the respective cleaning liquid deposition units 70C, 70M, 70Y and 70K. The cleaning liquid which has flowed out from the cleaning liquid emission ports 78 flows down over the cleaning liquid holding surfaces 74A.

When the inkjet heads 16C, 16M, 16Y and 16K moving toward the image recording position pass the cleaning liquid deposition heads 74, the cleaning liquid which has flowed over the cleaning liquid holding surfaces 74A of the cleaning liquid deposition heads 74 contacts the nozzle surfaces 30C, 30M, 30Y and 30K, and the cleaning liquid is thereby deposited on the nozzle surfaces 30C, 30M, 30Y and 30K.

The nozzle surfaces 30C, 30M, 30Y and 30K on which the cleaning liquid has been deposited are moved in this state toward the image recording position. In passing the strong wiping units 300C, 300M, 300Y and 300K, the nozzle surfaces 30C, 30M, 30Y and 30K are cleaned by wiping.

The controller drives the motors 194 and causes the wiping pads 310 to rotate, in accordance with the timing at which the inkjet heads 16C, 16M, 16Y and 16K arrive at the strong wiping units 300C, 300M, 300Y and 300K.

Moreover, the controller drives the elevator device (not shown) and moves the wiping device main body frame 102A of the wiping device main body 102 to the operating position, in accordance with the timing at which the inkjet heads 16C, 16M, 16Y and 16K arrive at the strong wiping units 300C, 300M, 300Y and 300K.

Thereby, the rotating wiping pads 310 are pressed against the nozzle surfaces 30C, 30M, 30Y and 30K, and the nozzle surfaces 30C, 30M, 30Y and 30K are thereby wiped and cleaned.

When the nozzle surfaces 30C, 30M, 30Y and 30K have completely passed the cleaning liquid deposition units 70C, 70M 70Y and 70K, the controller halts the driving of the cleaning liquid supply pump, and halts the supply of cleaning liquid. Thereupon, the controller withdraws the cleaning liquid deposition device 62 to the standby position.

When the nozzle surfaces 30C, 30M, 30Y and 30K have completely passed the strong wiping units 300C, 300M, 300Y and 300K, the controller halts the driving of the motors 194, and halts the rotation of the wiping pads 310. Thereupon, the controller withdraws the wiping device main body frame 102A of the wiping device main body 102 to the standby position.

The cleaning of the nozzle surfaces 30C, 30M, 30Y, 30K of the inkjet heads 16C, 16M, 16Y and 16K is completed by the sequence of steps described above.

Thus, in the cleaning using the strong wiping units 300, the cleaning liquid is deposited onto the nozzle surfaces 30C, 30M, 30Y and 30K, whereupon the rotating wiping pads 310 are pressed against the nozzle surfaces 30C, 30M, 30Y and 30K, and thereby the nozzle surfaces 30C, 30M, 30Y and 30K are wiped and cleaned.

As described above, in the wiping device 64 according to the present embodiment, it is possible to change the wiping operations and therefore the nozzle surfaces can be effectively wiped. In particular, adhering material originating from ink inside the nozzle holes can be effectively removed.

Moreover, switching of the wiping units can be carried out simply, since it only requires the interchange of the wiping units.

Furthermore, since the wiping units share the same drive source (the motor 194), it is possible to simplify the composition, as well as restricting manufacturing costs.

OTHER EMBODIMENTS

Other Embodiments of Wiping Units

In the embodiment described above, the composition is adopted in which the two types of wiping units are prepared, namely, the standard wiping units 100, which wipe the nozzle surfaces by pressing the traveling band-shaped wiping webs 110 against the nozzle surfaces, and the strong wiping units 300, which wipe the nozzle surfaces by pressing the rotating circular disk-shaped wiping pads 310 against the nozzle surfaces, in such a manner that the units can be installed interchangeably, but the wiping operation by the wiping units is not limited to this.

Figure 27:
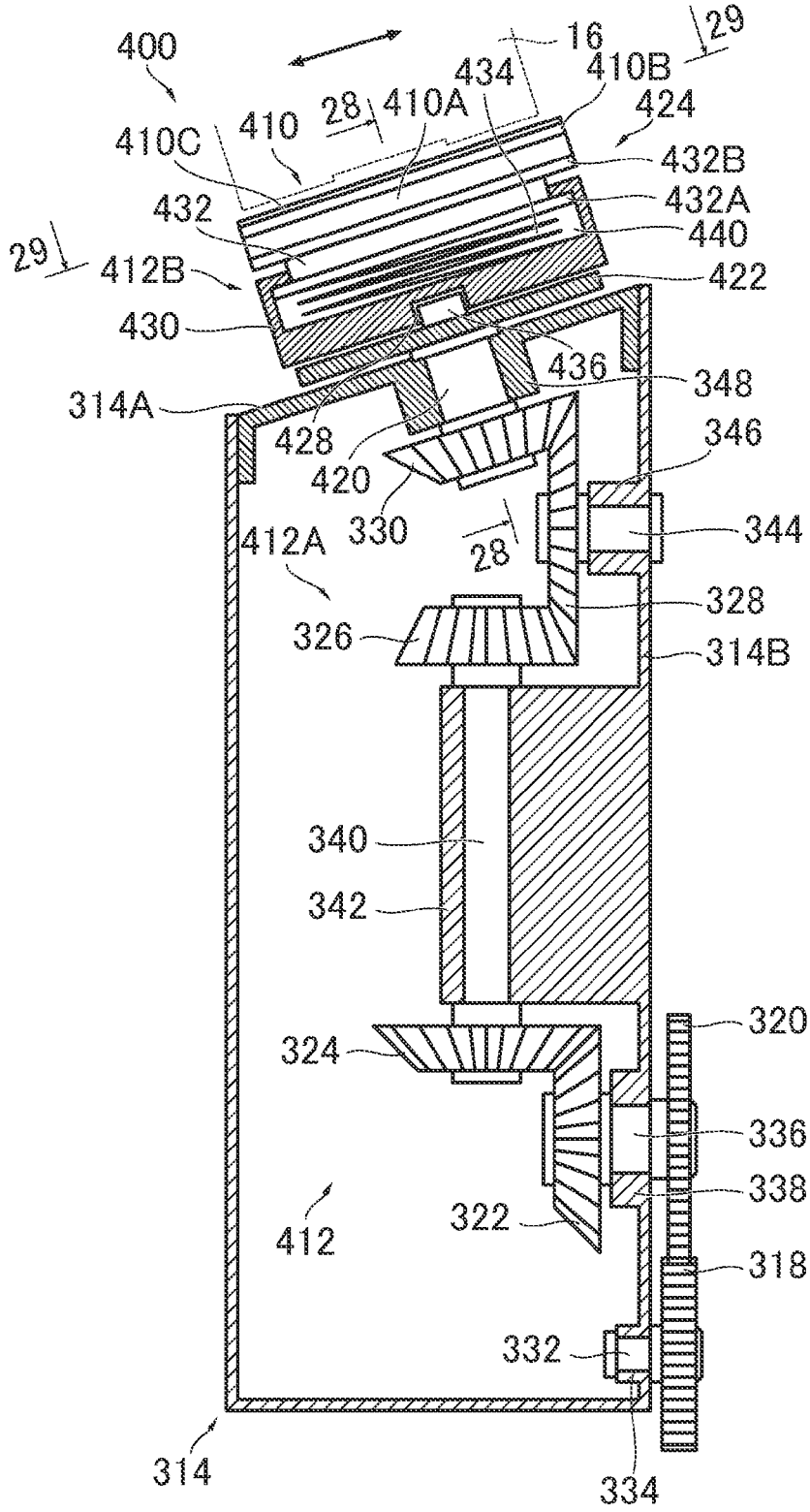
FIG. 27 is a partial cross-sectional side view showing a further embodiment of a wiping unit.

FIG. 27 is a partial cross-sectional side view showing a wiping unit according to a further embodiment of the present invention.

As shown in FIG. 27, the wiping unit in the present embodiment wipes the nozzle surface by pressing a reciprocally moving wiping pad against the nozzle surface.

The wiping unit (hereinafter referred to as the "reciprocal wiping unit") 400 includes: a wiping pad 410; a reciprocal drive mechanism 412, which drives the wiping pad 412 so as to move reciprocally back and forth; and a case 314, which accommodates the reciprocal drive mechanism 412.

The basic composition of the case 314 is the same as the composition of the case 314 of the strong wiping unit 300 described above. Therefore, the same members are denoted with the same reference numerals, and description thereof is omitted here.

The wiping pad 410 has the same composition as the wiping pad 310 of the strong wiping unit 300 described above, apart from the fact that it is formed in a square plate-shaped form. More specifically, the wiping pad 410 is constituted of: a base plate 410A, a cushion plate 410B, which is attached to the upper surface of the base plate 410A; and a wiping cloth 410C, which is attached to the upper surface of the cushion plate 410B.

The reciprocal drive mechanism 412 is constituted of a rotational drive transmission section 412A and a drive force conversion unit 412B.

When the reciprocal wiping unit 400 is installed in the wiping unit installation section 104, the rotational drive force transmission unit 412A receives rotational drive force from the motor 194 arranged in the wiping unit installation section 104, and transmits the rotational drive force to the drive force conversion unit 412B.

The basic composition of the rotational drive force transmission unit 412A is the same as the composition of the rotational drive mechanism 312 of the strong wiping unit 300 described above. More specifically, the rotational drive force transmission mechanism 412A includes: the first gear 318;

the second gear 320, which meshes with the first gear 318; the third gear 322, which is installed coaxially with the second gear 320; the fourth gear 324, which meshes with the third gear 322; the fifth gear 326, which is installed coaxially with the fourth gear 324; the sixth gear 328, which meshes with the fifth gear 326; and the seventh gear 330, which is installed on an input axle 420 of the drive force conversion unit 412B and meshes with the sixth gear 328.

Since the basic composition of the rotational drive force transmission unit 412A is the same as the composition of the rotational drive mechanism 312 of the strong wiping unit 300 in this way, then detailed description thereof is omitted here.

Figure 28:
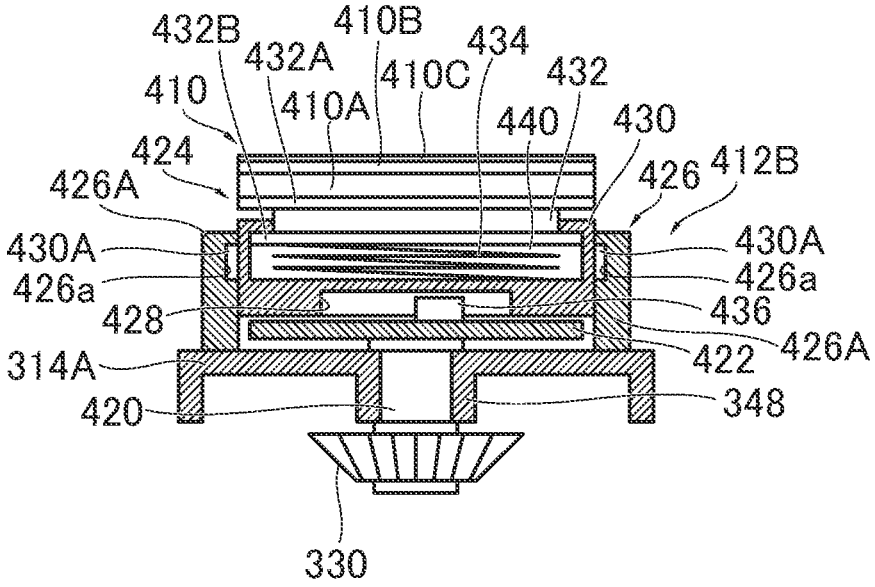
FIG. 28 is a cross-sectional view along line 28-28 in FIG. 27.
Figure 29:
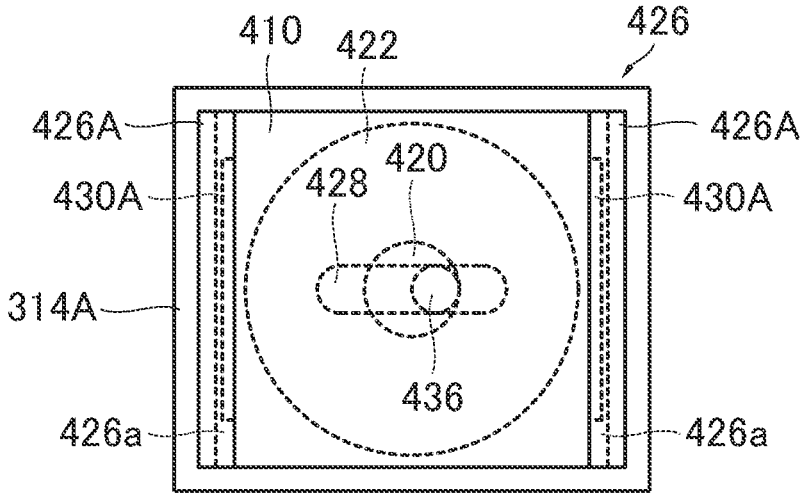
FIG. 29 is a diagram viewed in arrow 29-29 in FIG. 27.
Figure 30A:
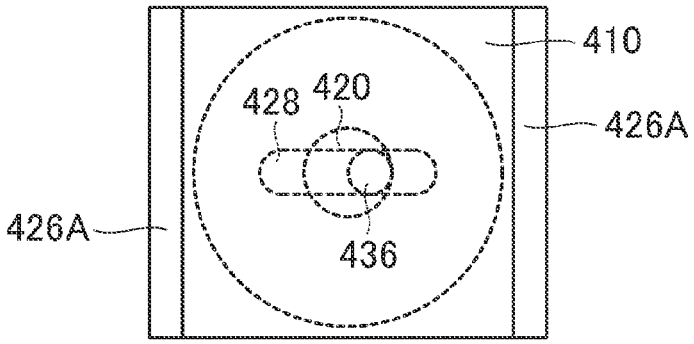
FIGS. 30A to 30D are illustrative diagrams of the operation of the wiping pad.
Figure 30B:
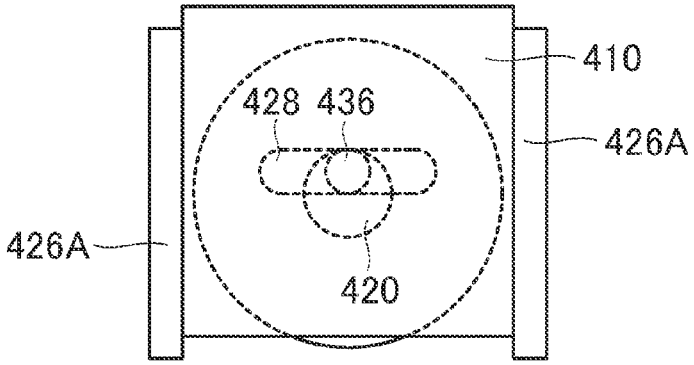
Figure 30C:
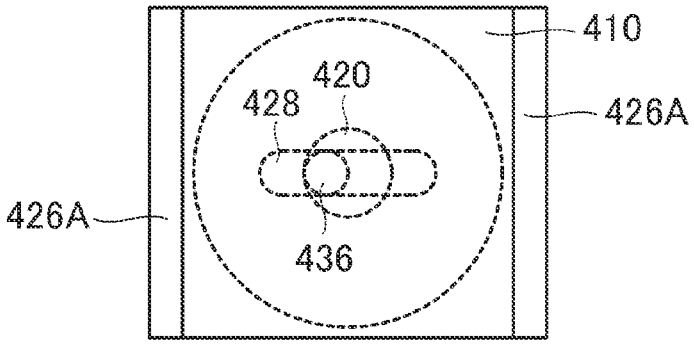
Figure 30D:
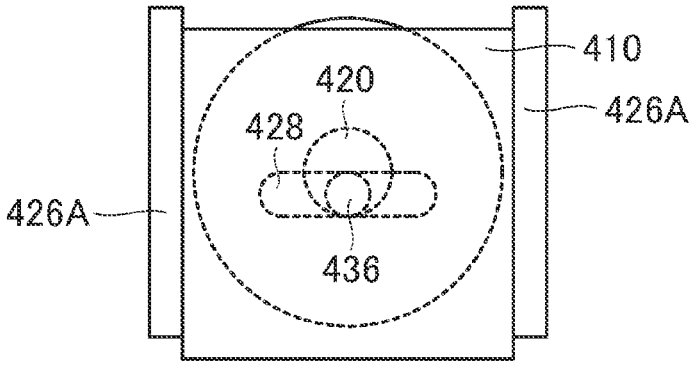

The drive force conversion unit 412B converts the rotational drive force transmitted from the rotational drive force transmission unit 412A, into reciprocal drive force. As shown in FIGS. 27 to 29, the drive force conversion unit 412B includes the input axle 420, a rotating plate 422, a reciprocally moving body 424 and a reciprocal movement guide 426.

The input axle 420 is rotatably supported by the main bearing section 348, which is formed in the upper surface section 314A of the case 314, and the input axle 420 is arranged perpendicularly to the upper surface section 314A of the case 314. The seventh gear 330 of the rotational drive force transmission unit 412A is attached to the input axle 420. Therefore, the input axle 420 rotates when the seventh gear 330 rotates.

The rotating plate 422 is formed in a circular disk shape and is attached coaxially to the upper end of the input axle 420. Therefore, when the input axle 420 rotates, the rotating plate 422 also rotates. A round bar-shaped eccentric pin 436 is arranged projectingly in the upper surface of the rotating plate 422, in an eccentric position with respect to the center of rotation of the rotating plate 422.

The reciprocally moving body 424 is constituted of: a base section 430; a wiping pad installation plate 432, which is arranged slidably in the upward and downward directions with respect to the base section 430; and a spring 434, which impels the wiping pad installation plate 432 in a projecting direction.

The base section 430 is formed in a square flat plate shape and has sliding sections 430A on both sides. The sliding sections 430A of the base section 430 are guided by the reciprocal movement guide 426 and are supported in reciprocally movable fashion in the directions perpendicular to the direction of movement of the inkjet heads 16.

The reciprocal movement guide 426 is constituted of a pair of guide rails 426A, which are installed on the upper surface section 314A of the case 314 to face each other across the reciprocally moving body 424. The sliding sections 430A of the base section 430 are slidably supported by being fitted inside guide grooves 426*a* in the guide rails 426A.

An elongated hole 428 is formed in the center of the lower surface of the base section 430. The eccentric pin 436 arranged in the upper surface of the rotating plate 428 is fitted into the elongated hole 428.

As shown in FIGS. 30A to 30D, when the rotating plate 422 rotates, the eccentric pin 436 arranged on the rotating plate 428 presses the inner wall surface of the elongated hole 428, and consequently the base section 430 moves reciprocally along the guide rails 426A.

A recess section 440 is formed in the upper surface of the base section 430. The wiping pad installation plate 432 includes: a fitting section 432A, which fits into the recess section 440; a wiping pad installation section 432B, on which the wiping pad 410 is installed; and a coupling section 432C, which couples together the fitting section 432A and the wiping pad installation section 432B. The wiping pad installation plate 432 is supported slidably in the upward and downward directions by means of the fitting section 432A sliding inside the recess section 440 of the base section 430.

The spring 434 is accommodated in the recess section 440 of the base section 430, and impels the wiping pad installation plate 432 in the projecting direction.

In the drive force conversion section 412B having the composition described above, when the input axle 420 is driven to rotate, the rotating plate 422 rotates, this rotation is converted into the reciprocal movement by the action of the eccentric pin 436 and the elongated hole 428, and the reciprocally moving body 424 performs the reciprocal movement. The wiping pad 410 that is installed on the reciprocally moving body 424 reciprocally moves due to the reciprocal movement of the reciprocally moving body 424.

Similarly to the strong wiping unit 300 described above, the wiping pad 410 is installed on the wiping pad installation plate 432 of the reciprocally moving body 424 through a screw, for example.

<Action of Reciprocal Wiping Unit>

Next, a wiping operation using the reciprocal wiping unit 400 is described.

<<Setting in Wiping Device Main Body>>

Similarly to the case of the standard wiping unit 100, the reciprocal wiping unit 400 is set in the wiping device main body 102 by vertically inserting the reciprocal wiping unit 400 into the wiping unit installation section 104 formed in the wiping device main body frame 102A of the wiping device main body 102.

The reciprocal wiping unit 400 is locked with a locking mechanism (not shown) at a prescribed position, when vertically inserted in the wiping unit installation section 104. Thereby, the reciprocal wiping unit 400 is set in the wiping unit installation section 104.

When the reciprocal wiping unit 400 has been set in the wiping unit installation section 104, the first gear 318 of the reciprocal wiping unit 400 meshes with the drive gear 192 arranged in the wiping unit installation section 104. Thereby, it becomes possible to drive the first gear 318 to rotate and the reciprocal wiping unit 400 can be operated.

<<Wiping Operation>>

Similarly to the case of the standard wiping unit 100, the nozzle surface 30 of the inkjet head 16 is wiped by pressing the wiping pad 410 against the nozzle surface 30, which performs a sliding movement. In so doing, the wiping pad 410 is pressed against the nozzle surface 30 while the wiping pad 410 is reciprocally moved to wipe the nozzle surface 30. More specifically, the procedure is as follows.

As described above, the wiping device main body frame 102A of the wiping device main body 102 in the wiping device 64 is arranged raisably and lowerably by means of the elevator device (not shown). The wiping device main body frame 102A is disposed in the prescribed standby position, when not performing cleaning, and is raised by the prescribed amount from the standby position and moved to the prescribed operating position only when cleaning is being performed.

When the wiping device main body frame 102A is moved to the operating position, the nozzle surface 30 of the inkjet head 16 can be wiped by the reciprocal wiping unit 400. More specifically, when the inkjet head 16 passes the reciprocal wiping unit 400, the wiping pad 410 can be pressed against the nozzle surface 30.

When the inkjet head 16 in which the cleaning liquid has been deposited on the nozzle surface 30 by the cleaning liquid deposition device 62 is moved past the reciprocal wiping unit 400, the reciprocally moving wiping pad 410 is pressed against the nozzle surface 30. Thereby, the nozzle surface 30 is wiped.

The controller drives the motor 194 to cause the wiping pad 410 to move reciprocally in accordance with the timing at which the inkjet head 16 arrives at the reciprocal wiping unit 400. The controller also drives the elevator device to move the wiping device main body frame 102A to the operating position in accordance with the timing at which the inkjet head 16 arrives at the reciprocal wiping unit 400, so that the reciprocally moving wiping pad 410 is pressed against the nozzle surface 30. Thus, the reciprocally moving wiping pad 410 is pressed against the nozzle surface 30, and the nozzle surface 30 is wiped by the wiping pad 410.

Here, because the wiping pad 410 is reciprocally moving, the nozzle surface 30 can be wiped in two directions and therefore adhering material can be effectively removed. In particular, soiling, or the like, which is adhering to the inner edges of the nozzle apertures can be effectively removed.

Moreover, the wiping pad 410 is impelled in the axial direction by the input axle 420, to and is therefore able to wipe the nozzle surface 30 without applying undue force.

FURTHER EMBODIMENTS

The wiping operation performed by the wiping units is not limited to that described above. Apart from this, it is possible to adopt various wiping operations.

For example, in the embodiments described above, when wiping the nozzle surface with the band-shaped wiping web 110, the nozzle surface is wiped by causing the wiping web 110 to travel in one direction, but it is also possible to wipe the nozzle surface by causing the wiping web 110 to perform reciprocal movement.

Moreover, in the embodiments described above, when wiping the nozzle surface with the rotating wiping pad 310, the nozzle surface is wiped by rotating the wiping pad 310 in one direction, but it is also possible to adopt a composition in which the wiping pad 310 wipes the nozzle surface by performing an oscillating movement (rotating in the forward and reverse directions at periodic intervals).

Further, it is also possible to adopt a composition which performs wiping by rotating the wiping pad 310 eccentrically, rather than rotating the pad coaxially.

Furthermore, in the embodiment described above, the wiping cloth of the similar composition to the wiping web 110 is used as the wiping pads 310 and 410, but it is also possible to compose the wiping pads as a brush, or the like.

Moreover, the wiping pad 310 can be attached with the screw so as to be replaceable, but the composition for replaceably attaching the wiping pads 310 and 410 is not limited to this.

Further, in the embodiment described above, the wiping web made of ultra-fine knitted or woven material is used as the wiping web 110, but the composition of the wiping web 110 is not limited to this. It is also possible to use wiping webs having other compositions, provided that they have absorbency. The same applies to the wiping cloth 310C used for the wiping pad 310.

By using a wiping web made of extremely fine knitted or woven material, it is possible to remove adhering material effectively by means of the unevenness of the surface of the wiping web. Moreover, by using the wiping web having absorbency as in the present embodiment, it is possible to draw out the cleaning liquid that has entered into the nozzles or ink of increased viscosity inside the nozzles nearby the nozzle apertures, from the nozzle apertures.

Furthermore, in the embodiment described above, the nozzle surfaces 30 are wiped while causing the wiping webs 110 to travel in the opposite direction to the direction of travel of the nozzle surfaces 30, but it is also possible to wipe the nozzle surfaces 30 by causing the wiping webs 110 to travel in the same direction as the direction of travel of the nozzle surfaces 30.

Moreover, in the embodiment described above, the composition is adopted in which the inkjet heads are moved and the cleaning liquid is deposited onto the nozzle surfaces 30 of the moving inkjet heads, but it is also possible to adopt a composition in which the cleaning liquid is deposited onto the nozzle surfaces 30 by moving the cleaning liquid deposition device 62. Further, it is also possible to adopt a composition in which the cleaning liquid is deposited onto the nozzle surfaces 30 by moving both the inkjet heads 16 and the cleaning liquid deposition device 62. Similarly, it is also possible to wipe the nozzle surfaces 30 by moving the wiping device 64. Furthermore, it is also possible to adopt a composition in which the nozzle surfaces 30 are wiped by moving both the inkjet heads 16 and the wiping device 64.

Further, in the embodiment described above, the nozzle surfaces are cleaned in the process of moving the inkjet heads 16 from the maintenance position to the image recording position, but it is also possible to adopt a composition in which the nozzle surfaces are cleaned in the process of moving the inkjet heads 16 from the image recording position to the maintenance position. In this case, the cleaning liquid deposition device 62 is disposed to the image recording position side of the wiping device 64.

Furthermore, in the embodiment described above, the cleaning liquid is deposited on the nozzle surfaces by the cleaning liquid deposition device 62, but the composition for depositing the cleaning liquid onto the nozzle surfaces (the composition for wetting the nozzle surfaces) is not limited to this. Apart from this, for example, it is also possible to adopt a composition in which the cleaning liquid is deposited on the nozzle surfaces by a spray, or the like.

Moreover, it is also possible to cover the nozzle surface with the cap 52 and to wet the nozzle surface by sucking. Further, a composition can be adopted in which wiping is performed by a wiping web, without depositing cleaning liquid.

Furthermore, the embodiments described above relate to a case of cleaning the nozzle surface which is arranged at an inclination, but the application of the present invention is not limited to this. It can also be applied similarly to the case of cleaning a nozzle surface which is disposed horizontally.

Moreover, the embodiments described above relate to a case where the nozzle forming region 30A is formed in the recessed shape, but the nozzle forming region 30A may also be formed to the same height as the nozzle protection regions 30B. In other words, the nozzle surface may be formed in a flat shape.

Furthermore, the embodiments described above relate to a case where the liquid repelling treatment is applied only on the nozzle forming region 30A, but it is also possible to apply a liquid repelling treatment on the nozzle protecting regions 30B as well.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection apparatus, comprising:

a droplet ejection head having a nozzle surface in which a nozzle aperture is formed, the droplet ejection head ejecting droplets through the nozzle aperture; and a wiping device which wipes the nozzle surface of the droplet ejection head by moving relatively with respect to the droplet ejection head, wherein the wiping device includes:

a wiping device main body which moves relatively with respect to the droplet ejection head;

a drive source which is arranged on the wiping device main body; and a plurality of wiping units configured to be interchangeably installed on the wiping device main body, the wiping units respectively having wiping members configured to be pressed against the nozzle surface to perform respectively different wiping operations to the nozzle surface, the wiping units respectively having driving mechanisms configured to drive the wiping members, wherein:

the drive source includes a motor;

when each of the wiping units is installed on the wiping device main body, a corresponding one of the driving mechanisms of the wiping members receives obtains rotational drive force from the motor of the drive source to perform a corresponding one of the wiping operations to the nozzle surface; and one of the wiping units includes a wiping pad which serves as the wiping member and is configured to rotate on an axis perpendicular to the nozzle surface, and the one of the wiping units wipes the nozzle surface by causing the wiping pad to rotate by the rotational drive force obtained from the motor, while pressing the rotating wiping pad against the nozzle surface.

2. The droplet ejection apparatus as defined in claim 1, wherein one of the wiping units includes:

a band-shaped wiping web which serves as the wiping member; and a pair of reels between which the wiping web travels, wherein the one of the wiping units wipes the nozzle surface by causing the wiping web to travel by rotating at least one of the reels by the rotational drive force obtained from the motor, while pressing the travelling wiping web against the nozzle surface.

3. The droplet ejection apparatus as defined in claim 1, wherein the wiping pad is arranged so as to be advanceable and retractable with respect to the nozzle surface, and is impelled toward the nozzle surface by an impelling device.

4. The droplet ejection apparatus as defined in claim 1, wherein the wiping pad is replaceable.

5. The droplet ejection apparatus as defined in claim 1, wherein one of the wiping units includes a wiping pad which serves as the wiping member and reciprocally moves, and the one of the wiping units wipes the nozzle surface by causing the wiping pad to perform reciprocal movement by converting the rotational drive force obtained from the motor into the reciprocal movement, while pressing the reciprocally moving wiping pad against the nozzle surface.

6. The droplet ejection apparatus as defined in claim 5, wherein the wiping pad is arranged so as to be advanceable and retractable with respect to the nozzle surface, and is impelled toward the nozzle surface by an impelling device.

7. The droplet ejection apparatus as defined in claim 5, wherein the wiping pad is replaceable.

8. The droplet ejection apparatus as defined in claim 1, wherein each of the wiping units is installed detachably by being inserted vertically into a recessed installation section arranged in the wiping device main body.

9. The droplet ejection apparatus as defined in claim 8, wherein the droplet ejection head is arranged such that the nozzle surface thereof is inclined with respect to a horizontal plane.

10. A droplet ejection apparatus comprising:

a droplet ejection head having a nozzle surface in which a nozzle aperture is formed, the droplet ejection head ejecting droplets through the nozzle aperture; and a wiping device which wipes the nozzle surface of the droplet ejection head by moving relatively with respect to the droplet ejection head, wherein the wiping device includes:

a wiping device main body which moves relatively with respect to the droplet ejection head;

a drive source which is arranged on the wiping device main body; and a plurality of wiping units configured to be interchangeably installed on the wiping device main body, the wiping units respectively having wiping members configured to be pressed against the nozzle surface to perform respectively different wiping operations to the nozzle surface, the wiping units respectively having driving mechanisms configured to drive the wiping members, wherein:

when each of the wiping units is installed on the wiping device main body, a corresponding one of the driving mechanisms of the wiping members receives drive force from the drive source to perform a corresponding one of the wiping operations to the nozzle surface;

the wiping units respectively have cases in which the respective driving mechanisms are contained; and the cases of the wiping units are configured to be detachably installed on the wiping device main body.

11. A droplet ejection apparatus comprising:

a droplet ejection head having a nozzle surface in which a nozzle aperture is fouled, the droplet ejection head ejecting droplets through the nozzle aperture; and a wiping device which wipes the nozzle surface of the droplet ejection head by moving relatively with respect to the droplet ejection head, wherein the wiping device includes:

a wiping device main body which moves relatively with respect to the droplet ejection head;

a drive source which is arranged on the wiping device main body; and a plurality of wiping units configured to be interchangeably installed on the wiping device main body, the wiping units respectively having wiping members configured to be pressed against the nozzle surface to perform respectively different wiping operations to the nozzle surface the wiping units respectively having driving mechanisms configured to drive the wiping members, wherein:

the drive source includes a motor;

when each of the wiping units is installed on the wiping device main body, a corresponding one of the driving mechanisms of the wiping members obtains rotational drive force from the motor of the drive source to perform a corresponding one of the wiping operations to the nozzle surface;

each of the wiping units is installed detachably by being inserted vertically into a recessed installation section arranged in the wiping device main body;

the wiping units respectively have cases in which the respective driving mechanisms are contained; and the cases of the wiping units are configured to be detachably installed on the wiping device main body.

* * * * *